US011382471B2

(12) United States Patent
Kim et al.

(10) Patent No.: US 11,382,471 B2
(45) Date of Patent: Jul. 12, 2022

(54) CLEANING APPARATUS HAVING VACUUM CLEANER AND DOCKING STATION

(71) Applicant: Samsung Electronics Co., Ltd., Suwon-si (KR)

(72) Inventors: See Hyun Kim, Suwon-si (KR); In Gyu Choi, Suwon-si (KR); Ki Hwan Kwon, Suwon-si (KR); Shin Kim, Suwon-si (KR); Hyeon Cheol Kim, Suwon-si (KR); Do Kyung Lee, Suwon-si (KR); Hyun Ju Lee, Suwon-si (KR); Yun Soo Jang, Suwon-si (KR); Seung Ryong Cha, Suwon-si (KR); Jung Gyun Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/344,223

(22) Filed: Jun. 10, 2021

(65) Prior Publication Data

US 2021/0298549 A1 Sep. 30, 2021

Related U.S. Application Data

(63) Continuation of application No. 17/092,822, which is a continuation of application No. PCT/KR2019/017587, filed on Dec. 12, 2019.

(30) Foreign Application Priority Data

Dec. 14, 2018 (KR) ..... 10-2018-0162375
Jun. 21, 2019 (KR) ..... 10-2019-0074217
(Continued)

(51) Int. Cl.
*A47L 9/14* (2006.01)
*A47L 9/16* (2006.01)
(Continued)

(52) U.S. Cl.
CPC ..... *A47L 9/149* (2013.01); *A47L 9/1608* (2013.01); *A47L 9/1683* (2013.01); *A47L 9/2894* (2013.01); *A47L 9/30* (2013.01)

(58) Field of Classification Search
CPC ... A47L 5/24; A47L 5/38; A47L 1/106; A47L 9/149; A47L 9/122; A47L 9/1608;
(Continued)

(56) References Cited

U.S. PATENT DOCUMENTS 5,216,778 A 6/1993 Suzuki et al.
8,984,708 B2 3/2015 Kuhe et al.
(Continued)

FOREIGN PATENT DOCUMENTS

CN 1545972 A 11/2004
CN 105708389 * 12/2015
(Continued)

OTHER PUBLICATIONS

ES2528696 translation Espacenet (Year: 2021).*
(Continued)

*Primary Examiner* — Joseph J Hail
*Assistant Examiner* — Timothy Brady
(74) *Attorney, Agent, or Firm* — Jefferson IP Law, LLP

(57) ABSTRACT

A cleaning apparatus including a vacuum cleaner and a docking station is provided. The cleaning apparatus includes a vacuum cleaner including a dust collecting chamber in which foreign substances are collected, and a docking station configured to be connected to the dust collecting chamber to remove the foreign substances collected in the dust collecting chamber. The dust collecting chamber is configured to collect foreign substances through centrifugation, and configured to be docked to the docking station, and the docking station includes a suction device configured to
(Continued)

suction the foreign substances and air in the dust collecting chamber docked to the docking station.

15 Claims, 54 Drawing Sheets

(30) Foreign Application Priority Data

Sep. 5, 2019 (KR) ..... 10-2019-0110291
Dec. 3, 2019 (KR) ..... 10-2019-0158871

(51) Int. Cl.
*A47L 9/28* (2006.01)
*A47L 9/30* (2006.01)

(58) Field of Classification Search
CPC ..... A47L 9/16; A47L 9/1683; A47L 9/2873; A47L 9/2894; A47L 9/30; A47L 7/0047; A47L 7/009; A47L 9/00; A47L 9/0072; B65F 1/105; B65F 1/1607; B65F 1/16; B65F 2210/1795; B65F 2210/188
USPC ..... 15/347, 300.1, 301, 303
See application file for complete search history.

(56) References Cited

U.S. PATENT DOCUMENTS

| | | | | |
|---|---|---|---|---|
| 9,192,272 | B2 | 11/2015 | Ota | |
| 9,271,618 | B2 | 3/2016 | Mantyla et al. | |
| 9,462,920 | B1 | 10/2016 | Morin et al. | |
| 9,788,698 | B2 | 10/2017 | Morin et al. | |
| 9,808,135 | B2 | 11/2017 | Mantyla et al. | |
| 9,924,846 | B2 | 3/2018 | Morin et al. | |
| 10,022,029 | B2 | 7/2018 | Machida et al. | |
| 10,143,348 | B2 | 12/2018 | Machida et al. | |
| 10,214,349 | B2 | 2/2019 | Conrad | |
| 10,244,909 | B2 | 4/2019 | Conrad | |
| 10,244,910 | B2 * | 4/2019 | Conrad | A47L 9/106 |
| 10,322,873 | B2 | 6/2019 | Conrad | |
| 10,463,215 | B2 | 11/2019 | Morin et al. | |
| 10,464,746 | B2 | 11/2019 | Conrad | |
| 10,952,578 | B2 | 3/2021 | Gill et al. | |
| 11,006,806 | B2 | 5/2021 | Cargill et al. | |
| 2006/0162117 | A1 * | 7/2006 | Thomas | A47L 9/20 15/344 |
| 2007/0157415 | A1 | 7/2007 | Lee et al. | |
| 2007/0157416 | A1 | 7/2007 | Lee et al. | |
| 2007/0294858 | A1 | 12/2007 | Murphy | |
| 2008/0201895 | A1 | 8/2008 | Kim et al. | |
| 2011/0119860 | A1 * | 5/2011 | Marcil | A47L 5/38 15/314 |
| 2011/0219571 | A1 * | 9/2011 | Dyson | A47L 9/2873 15/344 |
| 2013/0144232 | A1 | 6/2013 | Michaels et al. | |
| 2013/0305481 | A1 | 11/2013 | Jung et al. | |
| 2015/0135470 | A1 | 5/2015 | Mantyla et al. | |
| 2016/0106284 | A1 | 4/2016 | Mantyla et al. | |
| 2016/0183752 | A1 * | 6/2016 | Morin | A47L 9/1683 134/18 |
| 2016/0374528 | A1 * | 12/2016 | Morin | A47L 9/2842 15/319 |
| 2017/0055796 | A1 | 3/2017 | Won et al. | |
| 2017/0273532 | A1 * | 9/2017 | Machida | A47L 5/22 |
| 2017/0296007 | A1 * | 10/2017 | Warren | B01D 46/521 |
| 2017/0332860 | A1 * | 11/2017 | Nam | A47L 9/1625 |
| 2017/0340177 | A1 | 11/2017 | Conrad | |
| 2017/0361362 | A1 * | 12/2017 | Elam, Sr. | A47L 5/24 |
| 2018/0078107 | A1 | 3/2018 | Gagnon et al. | |
| 2018/0177357 | A1 * | 6/2018 | Conrad | B08B 17/00 |
| 2018/0177358 | A1 * | 6/2018 | Conrad | A47L 9/12 |
| 2018/0177359 | A1 * | 6/2018 | Conrad | A47L 9/149 |
| 2018/0177364 | A1 * | 6/2018 | Conrad | B65F 1/105 |
| 2018/0199778 | A1 * | 7/2018 | Kim | A47L 9/28 |
| 2020/0069139 | A1 | 3/2020 | Johnson et al. | |
| 2020/0100640 | A1 | 4/2020 | Marutani et al. | |
| 2021/0010685 | A1 | 1/2021 | Hackert et al. | |

FOREIGN PATENT DOCUMENTS

| | | | | |
|---|---|---|---|---|
| CN | 105559703 | A | 5/2016 | |
| CN | 106923745 | A | 7/2017 | |
| CN | 107405031 | A | 11/2017 | |
| CN | 107529930 | A | 1/2018 | |
| DE | 10 2015 108 462 | A1 | 12/2016 | |
| EP | 2 023 788 | B1 | 9/2011 | |
| EP | 2 582 279 | B1 | 1/2015 | |
| EP | 3 033 982 | A1 | 6/2016 | |
| ES | 2528696 | * | 1/2015 | A47L 9/0072 |
| JP | 3301452 | B2 | 7/2002 | |
| JP | 2009-082542 | A | 4/2009 | |
| JP | 4323854 | B2 | 9/2009 | |
| JP | 4531206 | B2 | 8/2010 | |
| JP | 2014-100572 | A | 6/2014 | |
| JP | 2014-128393 | A | 7/2014 | |
| JP | 2017189453 | * | 4/2016 | |
| JP | 2017-189453 | A | 10/2017 | |
| KR | 10-2007-0074146 | A | 7/2007 | |
| KR | 10-0992221 | B1 | 11/2010 | |
| KR | 10-2011-0041721 | A | 4/2011 | |
| KR | 10-1506175 | B1 | 3/2015 | |
| KR | 10-2017-0126381 | A | 11/2017 | |
| RU | 2391036 | C1 | 6/2010 | |
| WO | 2018/100772 | A1 | 6/2018 | |
| WO | 2018/100773 | A1 | 6/2018 | |

OTHER PUBLICATIONS

CN 105708389 translation Espacenet (Year: 2021).*
JP2017189453 translation Espacenet (Year: 2021).*
Korean Office Action dated Dec. 3, 2019, in the Korean Application No. 10-2019-0158871.
International Search Report dated Apr. 14, 2020, issued in International Patent Application No. PCT/KR2019/017587.
U.S. Notice of Allowance dated Jul. 23, 2021, issued in U.S. Appl. No. 17/319,608.
U.S. Non-final Office Action dated Jul. 30, 2021, issued in U.S. Appl. No. 17/319,644.
U.S. Notice of Allowance dated Aug. 3, 2021, issued in U.S. Appl. No. 17/319,718.
Korean Office Action dated May 13, 2021, issued in Korean Patent Application No. 10-2021-0035919.
Korean Office Action dated May 13, 2021, issued in Korean Patent Application No. 10-2021-0035947.
Korean Office Action dated May 13, 2021, issued in Korean Patent Application No. 10-2021-0035980.
Korean Office Action dated Jul. 15, 2021, issued in Korean Patent Application No. 10-2021-0064725.
Korean Office Action dated Jul. 15, 2021, issued in Korean Patent Application No. 10-2021-0064744.
Korean Office Action dated Aug. 5, 2021, issued in Korean Patent Application No. 10-2020-0152622.
U.S. Final Office Action dated Feb. 7, 2022, issued in U.S. Appl. No. 17/344,212.
U.S. Advisory Action dated Dec. 30, 2021, issued in U.S. Appl. No. 17/319,644.
U.S. Non-final Office Action dated Nov. 23, 2021, issued in U.S. Appl. No. 17/344,234.
Korean Office Action dated Sep. 1, 2021, issued in Korean Patent Application No. 10-2021-0035919.
Korean Office Action dated Aug. 23, 2021, issued in Korean Patent Application No. 10-2021-0035947.
Korean Notice of Allowance dated Sep. 7, 2021, issued in Korean Patent Application No. 10-2021-0035980.
U.S. Non-final Office Action dated Aug. 23, 2021, issued in U.S. Appl. No. 17/092,822.
U.S. Non-final Office Action dated Oct. 26, 2021, issued in U.S. Appl. No. 17/344,212.

(56) References Cited

OTHER PUBLICATIONS

U.S. Final Office Action dated Oct. 22, 2021, issued in U.S. Appl. No. 17/319,644.
U.S. Advisory Action dated Nov. 4, 2021, issued in U.S. Appl. No. 17/319,644.
European Search Report dated Dec. 23, 2021, issued in European Patent Application No. 19896997.4.
Korean Notice of Patent Allowance dated Jan. 26, 2022, issued in Korean Patent Application No. 10-2020-0152622.
Korean Office Action dated Jan. 3, 2022, issued in Korean Patent Application No. 10-2021-0035919.
Korean Office Action dated Jan. 3, 2022, issued in Korean Patent Application No. 10-2021-0035947.
Korean Notice of Patent Allowance dated Jan. 26, 2022, issued in Korean Patent Application No. 10-2021-0064725.
Korean Office Action dated Jan. 26, 2022, issued in Korean Patent Application No. 10-2021-0064744.
Russian Office Action with Search Report dated Nov. 26, 2021, issued in Russian Patent Application No. 2021116846.
Chinese Office Action dated Mar. 22, 2022, issued in Chinese Patent Application No. 201980082756.6.
Korean Office Action dated Mar. 15, 2022, issued in Korean Patent Application No. 10-2021-0064744.
Korean Office Action dated Mar. 29, 2022, issued in Korean Patent Application No. 10-2021-0035919.
Extended European Search Report dated May 13, 2022, issued in European Patent Application No. 22152215.4.

* cited by examiner

CLEANING APPARATUS HAVING VACUUM CLEANER AND DOCKING STATION

CROSS-REFERENCE TO RELATED APPLICATION(S)

This application is a continuation application of prior application Ser. No. 17/092,822, filed on Nov. 9, 2020, which is a continuation application, claiming priority under § 365(c), of an International application No. PCT/KR2019/017587, filed on Dec. 12, 2019, which was based on and claimed priority of a Korean patent application number 10-2018-0162375, filed on Dec. 14, 2018, in the Korean Intellectual Property Office, of a Korean patent application number 10-2019-0074217, filed on Jun. 21, 2019, in the Korean Intellectual Property Office, of a Korean patent application number 10-2019-0110291, filed on Sep. 5, 2019, in the Korean Intellectual Property Office, and of a Korean patent application number 10-2019-0158871, filed on Dec. 3, 2019, in the Korean Intellectual Property Office, the disclosure of each of which is incorporated by reference herein in its entirety.

BACKGROUND

1. Field

The disclosure relates to a cleaning apparatus including a vacuum cleaner and a docking station. More particularly, the disclosure relates to a docking station capable of automatically discharging dust inside a vacuum cleaner, and a cleaning apparatus including the same.

2. Description of Related Art

In general, a vacuum cleaner is a device that includes a fan motor configured to generate suction power, and that suctions foreign substances such as dust together with air using the suction power generated by the fan motor, separates the foreign substance contained in the suctioned air from the air, and collects the dust, thereby performing a cleaning operation.

The vacuum cleaner includes a dust collecting chamber for collecting the foreign substance, and the user should periodically separate the dust collecting chamber from the vacuum cleaner and discharge the foreign substance from the dust collecting chamber.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a cleaning apparatus including a docking station of a vacuum cleaner capable of automatically discharging foreign substances from a dust collecting chamber.

Another aspect of the disclosure is to provide a cleaning apparatus including a docking station including an improved structure to effectively remove foreign substances in a dust collecting chamber.

Additional aspects will be set forth in part in the description which follows and, in part, will be apparent from the description, or may be learned by practice of the presented embodiments.

In accordance with an aspect of the disclosure, a cleaning apparatus is provided. The cleaning apparatus includes a vacuum cleaner including a dust collecting chamber in which foreign substances are collected, and a docking station configured to be connected to the dust collecting chamber to remove the foreign substances collected in the dust collecting chamber. The dust collecting chamber is configured to collect foreign substances through centrifugation, and dock to the docking station. The docking station includes a suction device configured to suction the foreign substances and air in the dust collecting chamber docked to the docking station.

The dust collecting chamber may be further configured to be separated from the vacuum cleaner and docked to the docking station.

The docking station may further include a body including a long axis extending in a vertical direction, and a seating portion on which the dust collecting chamber is seated, the seating portion provided to be opened upward in a long axis direction of the docking station.

The dust collecting chamber may include a cylindrical shape including a long axis extending in one direction, and the dust collecting chamber may be inserted into the docking station in a direction in which the long axis of the cylindrical shape extends.

In response to docking of the dust collecting chamber to the seating portion, the long axis of the cylindrical shape may be disposed in a direction corresponding to the long axis of the body.

The docking station may include a collector disposed between the seating portion and the suction device while being disposed in the body, and the collector collects foreign substances, which move from the dust collecting chamber by intake air flow generated by the suction device.

The seating portion, the collector, and the suction device may be sequentially disposed from an upper side to a lower side with respect to the long axis direction of the body.

The collector may include a collecting portion configured to communicate with the seating portion, removably installed in the collector and in which foreign substances introduced from the seating portion are collected.

The body further may include a cover configured to open and close the collector to allow an inside of the collector to be opened to the outside, and in response to opening of the inside of the collector, the collecting portion may be separated from the inside of the collector and taken out of the collector.

The collecting portion may include an additional dust collecting chamber including a cyclone configured to collect foreign substances through centrifugation.

The vacuum cleaner may further include a suction unit configured to suction foreign substances and an extension tube configured to connect the suction unit to the dust collecting chamber, the extension tube including a long axis extending in one direction, and the long axis of the extension tube and the long axis of the dust collecting chamber may extend in a direction substantially corresponding to each other.

The vacuum cleaner may further include a suction unit configured to suction foreign substances and an extension tube configured to connect the suction unit to the dust collecting chamber, the extension tube including a long axis extending in one direction, and in response to docking of the dust collecting chamber to the docking station, the vacuum cleaner may be supported against the docking station to allow the long axis of the extension tube and the long axis of the body to extend in a direction substantially corresponding to each other.

The dust collecting chamber may include a cylindrical shape including a long axis extending in one direction, a dust collecting chamber door arranged at a lower end of the cylindrical shape, and a cyclone configured to allow foreign substances to be separated through the centrifugation in the dust collecting chamber, and in response to opening of the dust collecting chamber door, the dust collecting chamber may allow foreign substances, which are collected in an inside of the cyclone and between the cyclone and the dust collecting chamber, to be separated toward the outside of the dust collecting chamber.

The dust collecting chamber may further include a fixing member configured to removably fix the dust collecting chamber door to the dust collecting chamber, and the dust collecting chamber door may be opened in response to being connected to the docking station, and the docking station may include an opening guide configured to press the fixing member to allow the dust collecting chamber door to be opened in response to connecting of the dust collecting chamber to the docking station.

The docking station may include a flow rate regulator configured to selectively change an amount of intake air flow supplied to the dust collecting chamber to change a flow rate of the inside of the dust collecting chamber in response to driving of the suction device.

In accordance with another aspect of the disclosure, a cleaning apparatus is provided. The cleaning apparatus includes a vacuum cleaner including a dust collecting chamber in which foreign substances are collected, and a docking station configured to be connected to the dust collecting chamber to remove the foreign substances collected in the dust collecting chamber. The dust collecting chamber is configured to be separated from the vacuum cleaner and docked to the docking station, and the docking station includes a suction device configured to suction the foreign substances and air in the dust collecting chamber docked to the docking station.

The clocking station may further include a body including a long axis extending in a vertical direction, and a seating portion on which the dust collecting chamber is seated, the seating portion configured to be opened upward in a long axis direction of the docking station.

The dust collecting chamber may include a long axis extending in one direction, and the dust collecting chamber may be inserted into the docking station in a direction in which the long axis of the dust collecting chamber extends.

In response to docking of the dust collecting chamber to the seating portion, the long axis of the dust collecting chamber may be disposed in a direction corresponding to the long axis of the body.

In accordance with another aspect of the disclosure, a cleaning apparatus is provided. The cleaning apparatus includes a vacuum cleaner including a dust collecting chamber in which foreign substances are collected, and a docking station configured to be docked to the dust collecting chamber to remove the foreign substances collected in the dust collecting chamber. The dust collecting chamber includes a dust collecting chamber door configured to allow the dust collecting chamber to be opened in response to docking of the dust collecting chamber to the docking station, and a fixing member configured to removably fix the dust collecting chamber door to the dust collecting chamber, and the docking station includes a suction device configured to suction foreign substances and air in the dust collecting chamber docked to the docking station, and an opening guide configured to press one side of the fixing member to allow the dust collecting chamber door to be opened in response to docking of the dust collecting chamber to the docking station.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, description of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

The singular forms "a," "an" and "the" are intended to include the plural forms as well, unless the context clearly indicates otherwise. In this disclosure, the terms "including", "having", and the like are used to specify features, numbers, operations, elements, components, or combinations thereof, but do not preclude the presence or addition of one or more of the features, elements, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "upper side", "lower side" and "front-rear direction" may be defined by the drawings, but the shape and the location of the component is not limited by the term.

The disclosure will be described more fully hereinafter with reference to the accompanying drawings.

Figure 1:
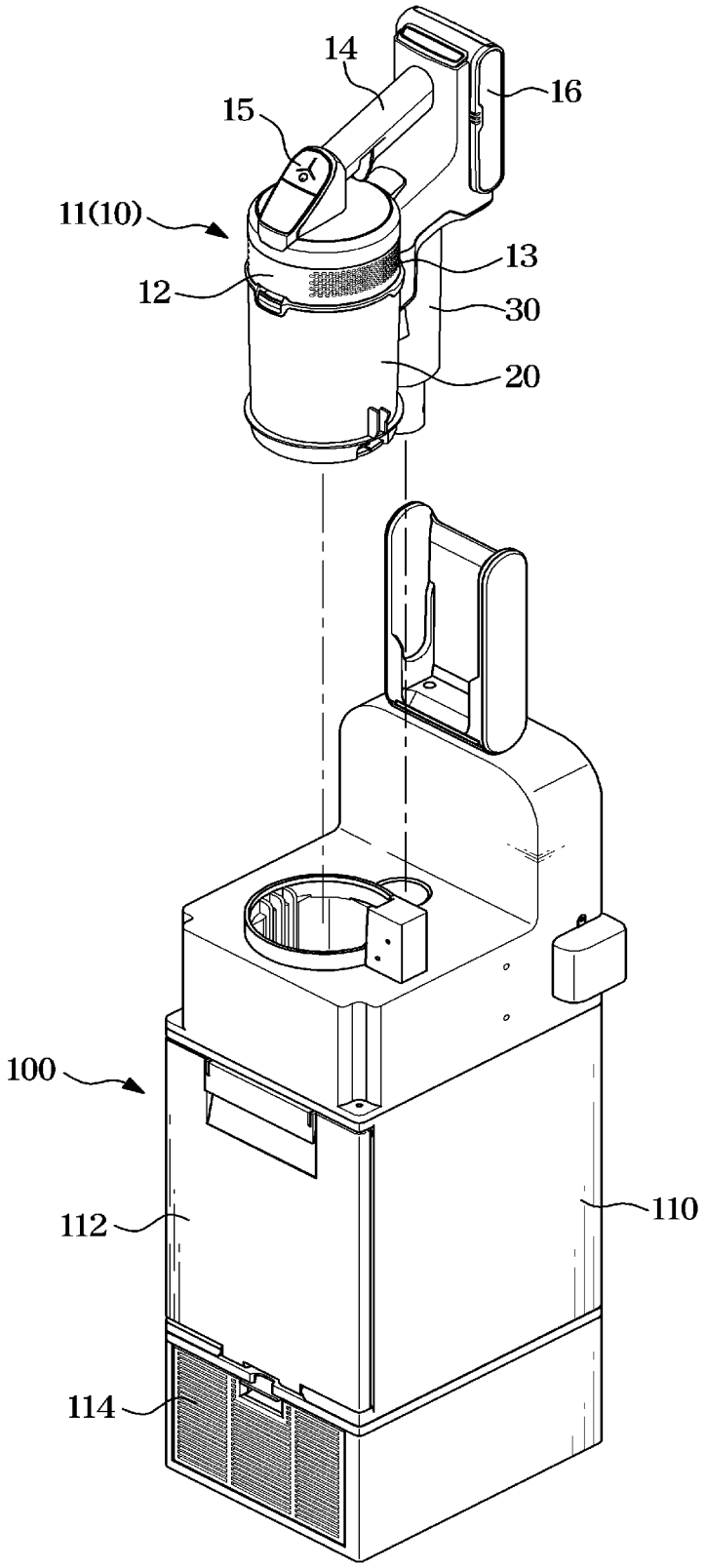
FIG. 1 is a view illustrating a state in which a cleaner is separated from a station according to a first embodiment of the disclosure.
Figure 2:
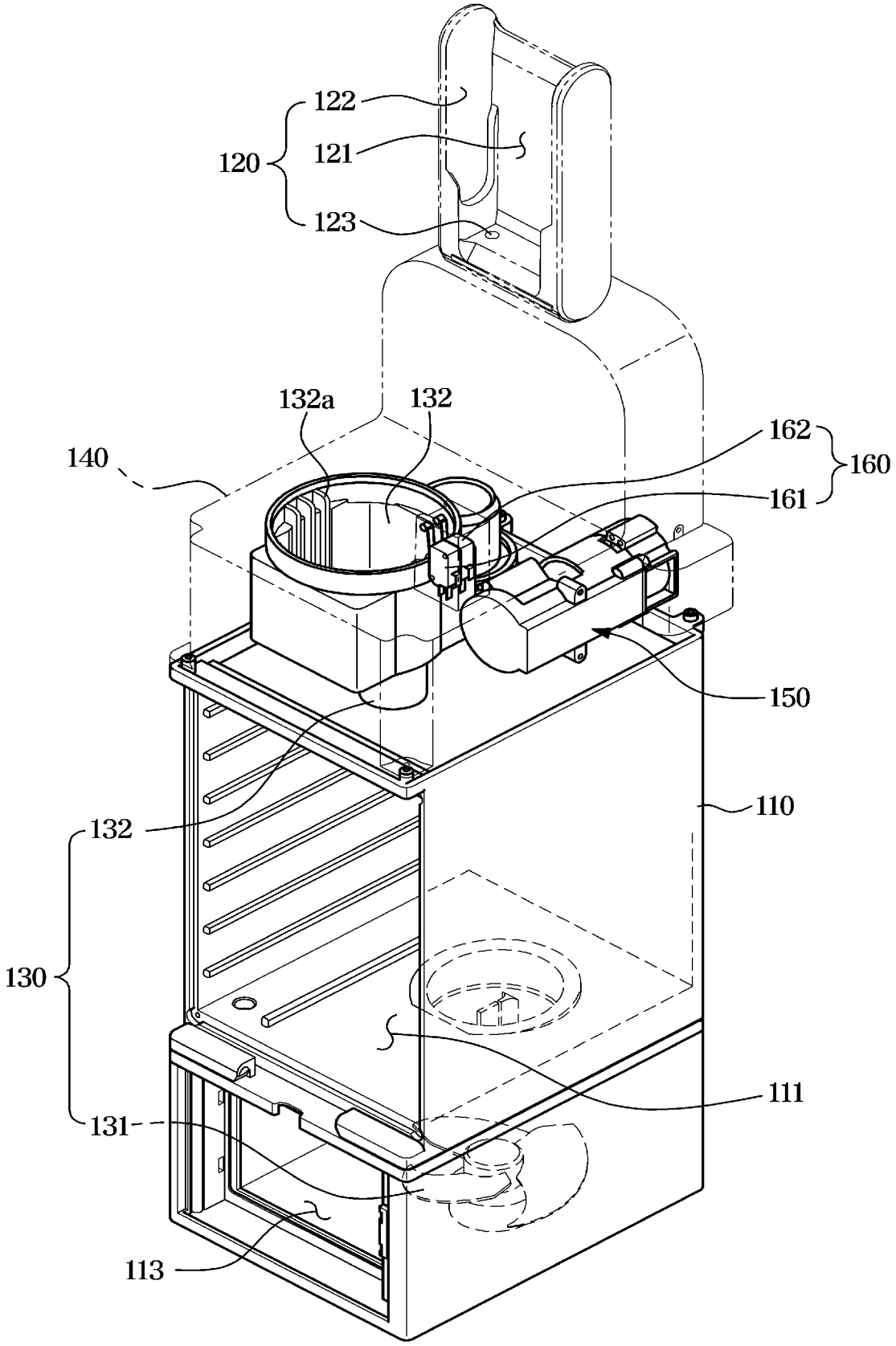
FIG. 2 is a perspective view illustrating a state in which a part of the station is transparent in the station according to the first embodiment of the disclosure.
Figure 3:
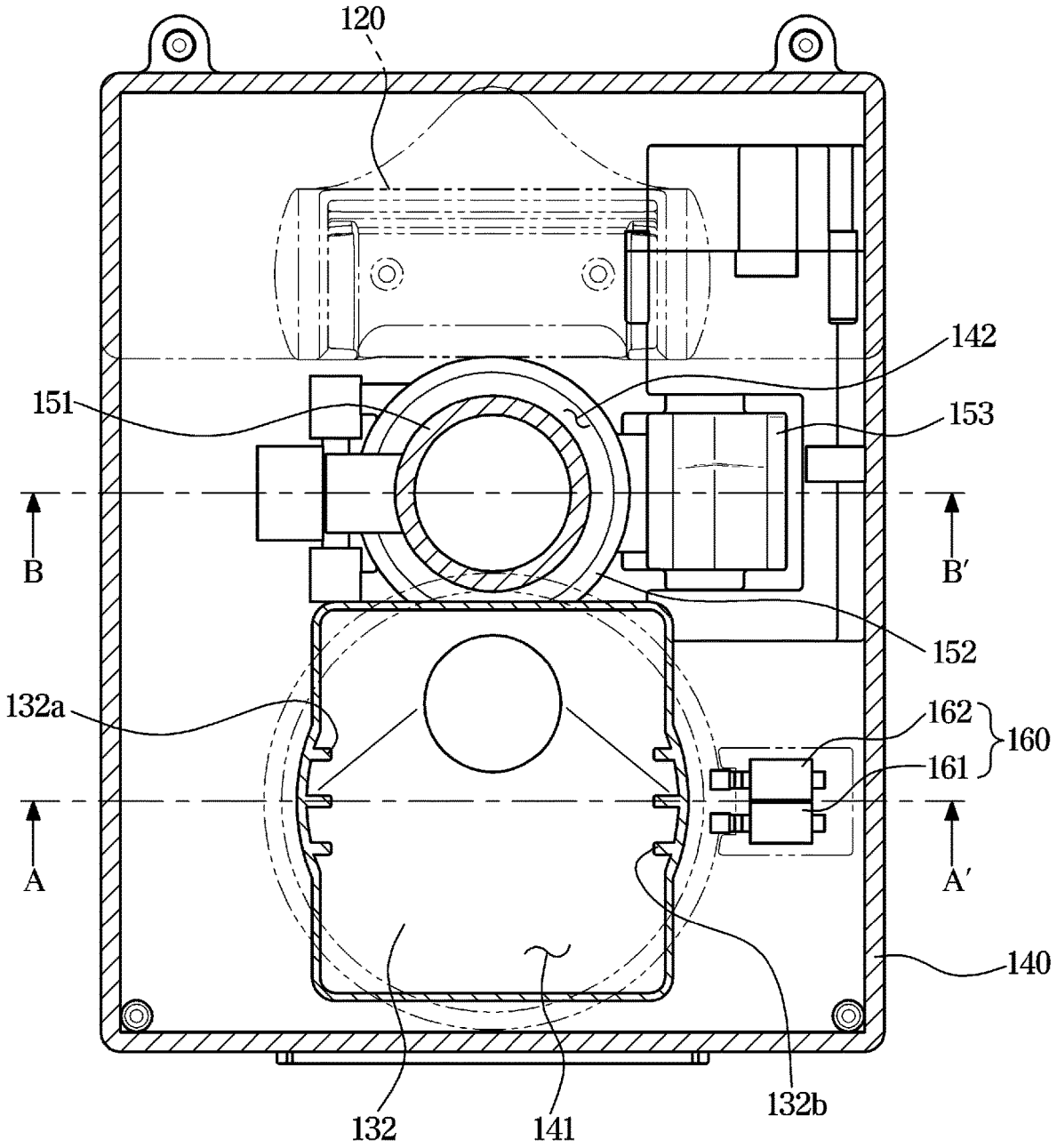
FIG. 3 is a plan view of the station shown in FIG. 2.
Figure 4:
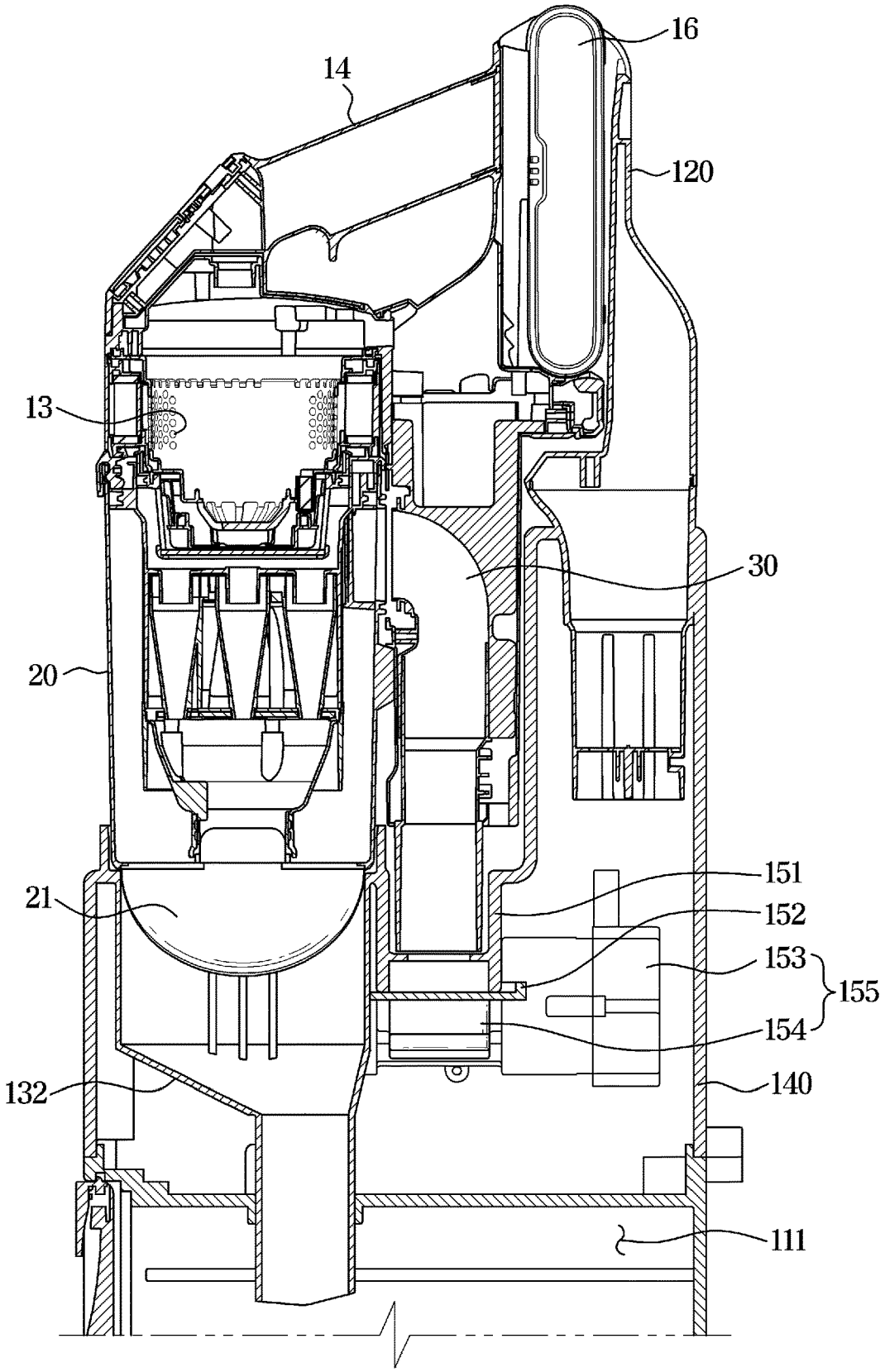
FIG. 4 is a side cross-sectional view illustrating a state in which the cleaner is coupled to the station according to the first embodiment of the disclosure.

FIG. 1 is a view illustrating a state in which a cleaner is separated from a station according to a first embodiment of the disclosure, FIG. 2 is a perspective view illustrating a state in which a part of the station is transparent in the station according to the first embodiment of the disclosure, FIG. 3 is a plan view of the station shown in FIG. 2, and FIG. 4 is a side cross-sectional view illustrating a state in which the cleaner is coupled to the station according to the first embodiment of the disclosure.

Referring to FIGS. 1 to 4, a cleaning apparatus 1 may include a cleaner 10, and a docking station 100.

The cleaner 10 may include a cleaner body 11, an extension tube (not shown) removably coupled to the cleaner body 11, a suction unit (not shown) removably coupled to the extension tube (not shown), and a dust collecting chamber 20 removably coupled to the cleaner body 11.

The cleaner body 11 may include a suction motor (not shown) configured to generate a suction force needed to suction the foreign substance on a surface to be cleaned, and the dust collecting chamber 20 in which the foreign substance suctioned from the surface to be cleaned is accommodated.

The dust collecting chamber 20 may be arranged on the upstream of the air flow rather than the suction motor so as to filter out and collect dust and dirt in the air flowing through the main suction unit (not shown). The dust collecting chamber 20 may be provided removably from the cleaner body 11.

The cleaner 10 may include a filter housing 12. The filter housing 12 may have a substantially donut shape to accommodate a filter (not shown) therein. There is no limitation in the type of filter. For example, a high efficiency particulate air (HEPA) filter may be arranged inside the filter housing 12. The filter may filter out ultrafine dust that is not filtered out of the dust collecting chamber 20. The filter housing 12 may include a discharge port 13 to discharge the air passing through the filter to the outside of the cleaner 10.

The cleaner body 11 may include a handle 14 to allow a user to grip and manipulate the cleaner 10. The user may grip the handle 14 and move the cleaner 10 forward and backward.

The cleaner body 11 may include a manipulator 15. The user may operate a power button provided on the manipulator 15 to turn on/off the cleaner 10 or to adjust the suction strength.

The cleaner body 11 may include a dust collecting guide 30 provided to connect among the dust collecting chamber 20, the extension tube (not shown), and the suction unit (not shown) to guide a foreign substance to the dust collecting chamber 20.

The dust collecting guide 30 may be coupled to the above-mentioned extension tube (not shown) while guiding the foreign substance into the dust collecting chamber 20 as described above. In addition, the dust collecting guide 30 may be provided to be directly coupled to the suction unit (not shown) other than the extension tube (not shown) or to be coupled to other components such as an auxiliary suction unit.

Accordingly, it is possible to increase the convenience of cleaning because a user can combine various components with the dust collecting guide 30 according to cleaning situations.

The cleaner body 11 may include a battery 16 configured to provide a driving force to the cleaner 10. The battery 16 may be removably mounted to the cleaner body 11. In addition, the battery 16 may be electrically connected to a charging terminal 123 provided in the docking station 100 to be described later. The battery 16 may be charged by receiving power from the charging terminal 123 provided in the docking station 100.

The docking station 100 may be configured to store or hold the cleaner 10. The cleaner 10 may be charged in the docking station 100.

The docking station 100 may include a body housing 110 forming an appearance of the docking station 100.

The docking station 100 may include a charger 120 docked to the handle 14 of the cleaner 10 to supply power to the battery 16.

The charger 120 may include a battery seating portion (e.g., the connection flow path 121) on which the battery 16 is seated, a battery guide 122 configured to guide the mounting of the battery 16, and the charging terminal 123 configured to supply power to the battery 16 upon seating of the battery 16.

However, the battery 16 may be arranged to be exposed to the outside according to an embodiment of the disclosure, but is not limited thereto. The battery 16 may be arranged inside the body 11 of the cleaner 10 and not be exposed to the outside. At this time, the charger 120 may be provided in such a way that at least a part of the body 11, in which the battery 16 is arranged, is seated thereon so as to charge the battery 16.

As described above, the conventional docking station may be configured to supply power to the battery when the cleaner is docked to the docking station. The docking station 100 according to an embodiment of the disclosure may additionally increase the convenience of the consumer by automatically discharging dust collected inside the dust collecting chamber 20 upon docking of the cleaner 10 to the docking station 100.

However, the docking station 100 according to an embodiment of the disclosure may perform only a function of automatically discharging dust collected in the dust collecting chamber 20 without charging the cleaner 10.

In the conventional manner, a user has to directly remove foreign substances collected in the dust collecting chamber 20 after the use of the cleaner 10. However, the docking station 100 according to an embodiment of the disclosure may automatically remove dust collected in the dust collecting chamber 20 by being directly docked to the dust collecting chamber 20 upon docking of the cleaner 10.

By including a suction device 130, the docking station 100 may discharge dust collected in the dust collecting chamber 20 from the dust collecting chamber 20.

The suction device 130 may include an intake flow path 132. The intake flow path 132 is directly connected to a suction fan 131 and the dust collecting chamber 20 to allow foreign substances collected in the dust collecting chamber 20 to be discharged to the outside of the dust collecting chamber 20 by the suction fan 131.

The intake flow path 132 may transfer the air flow generated by the suction fan 131 to the dust collecting chamber 20. That is, the intake air flow generated by the suction fan 131 may be transferred into the dust collecting chamber 20 along the intake flow path 132, and the foreign substance inside the dust collecting chamber 20 may be discharged to the outside of the dust collecting chamber 20 according to the intake air flow.

One end of the intake flow path 132 may be connected to the dust collecting chamber 20, and the other end of the intake flow path 132 may be connected to a collector (not shown) configured to collect the suctioned foreign substance.

The collector (not shown) may have an inner space larger than that of the dust collecting chamber 20.

Although not shown in the drawing, the collector (not shown) may be provided in the shape of a collection bag configured to transmit air to allow the intake air flow generated by the suction fan 131 to flow into the intake flow path 132 and configured to prevent dust from being transmitted.

However, the shape of the collector (not shown) is not limited thereto, and thus the collector (not shown) may be provided in the shape of an additional dust collecting chamber communicating with the intake flow path 132 and the suction fan 131. The additional dust collecting chamber may be formed in a multi-cyclone type in the same manner as the dust collecting chamber 20, so as to collect foreign substances introduced from the dust collecting chamber 20.

The collector (not shown) may be arranged in a first inner space 111 formed by the body housing 110. The first inner space 111 may be provided to be opened and closed by a first cover 112 arranged in front of the body housing 110.

When the collector (not shown) is fully filled with the foreign substances, a user may open the first cover 112 and separate the collector (not shown) from the body housing 110 so as to remove the foreign substance collected in the collector (not shown).

The suction fan 131 may be arranged in a second inner space 113 formed by the housing. The second inner space 113 may be provided to be opened and closed by a second cover 114 arranged in front of the body housing 110.

The second cover 114 may be configured to discharge air suctioned by the suction fan 131. An inner side surface of the second cover 114 may be equipped with an additional filter (not shown) configured to additionally filter out foreign substances in the discharged air.

The first inner space 111 and the second inner space 113 may be provided to communicate with each other. Thus, in response to driving the suction fan 131, the intake air flow may be transferred to the intake flow path 132 through the first inner space 111 and the second inner space 113, and the intake air flow may be transferred to the dust collecting chamber 20 through the intake flow path 132.

However, the structure of the first inner space 111 and the second inner space 113 is not limited thereto, and thus the first inner space 111 and the second inner space 113 may be formed as one space without being divided in the body housing 110.

The charger 120 described above may be arranged at the most upper end of the body housing 110.

The body housing 110 may include a docking housing 140, and the docking housing 140 allows the dust collecting chamber 20 and the dust collecting guide 30 to be docked to the inside of the housing upon the docking of the handle 14 to the charger 120.

The intake flow path 132 described above may be arranged in the docking housing 140. Further, a flow rate regulator 150 to be described later may be arranged in the docking housing 140.

The docking housing 140 may correspond to one component of the body housing 110, but the docking housing 140 is not limited to an embodiment of the disclosure. Therefore, the docking housing 140 may be provided as a component integrally formed with the body housing 110.

The docking housing 140 may include a first opening 141 docked to the dust collecting chamber 20 and connected to one end of the intake flow path 132.

The docking housing 140 may include a second opening 142 docked to the dust collecting guide 30 and connected to the flow rate regulator 150.

By using the second opening 142, the flow rate regulator 150 may selectively provide outside air to the dust collecting chamber 20 through the dust collecting guide 30. A description thereof will be described.

A switch unit 160 may be provided on one side of the docking housing 140, and the switch unit 160 is configured to detect the docking of the cleaner 10 to the docking housing 140 and transmit a signal for driving the suction device 130 and the flow rate regulator 150.

The docking station 100 may include a controller (not shown) and may drive the suction device 130 and the flow rate regulator 150 by receiving an electrical signal from the switch unit 160.

The switch unit 160 may include a first switch 161 configured to detect the dust collecting chamber 20 that has passed through the first opening 141 and docked to the suction device 130, and a second switch 162 configured to detect the dust collecting guide 30 that has passed through the second opening 142 and docked to the flow rate regulator 150.

Hereinafter a structure in which the dust collecting chamber 20 is docked to the suction device 130 will be described.

Figure 5:
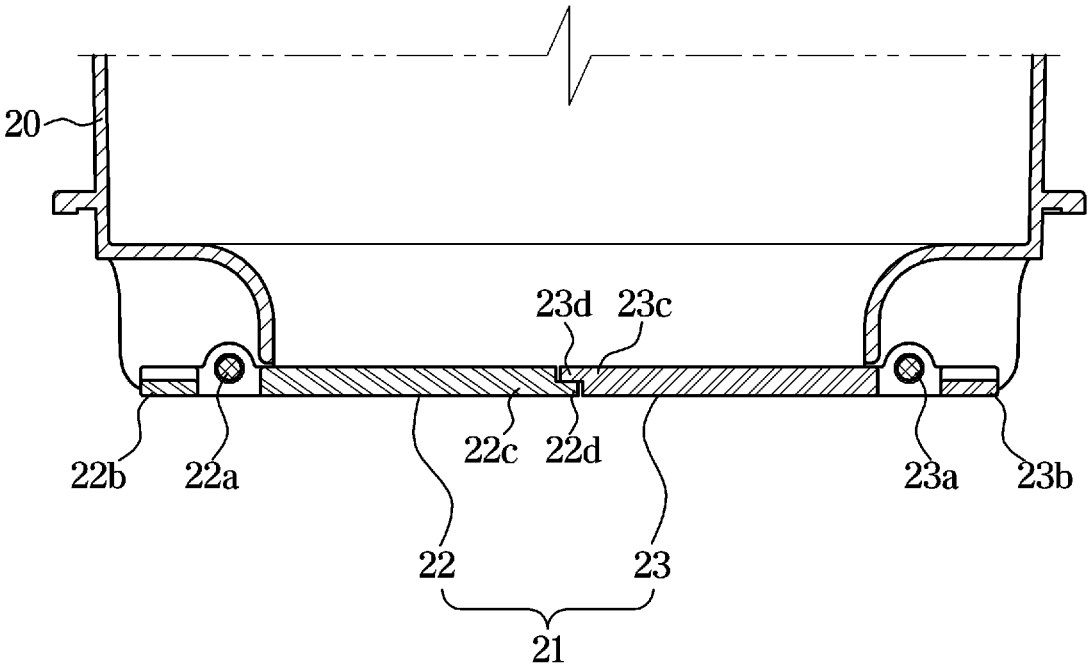
FIG. 5 is a sectional perspective view of a part of a dust collecting chamber of the cleaner according to the first embodiment of the disclosure.
Figure 6:
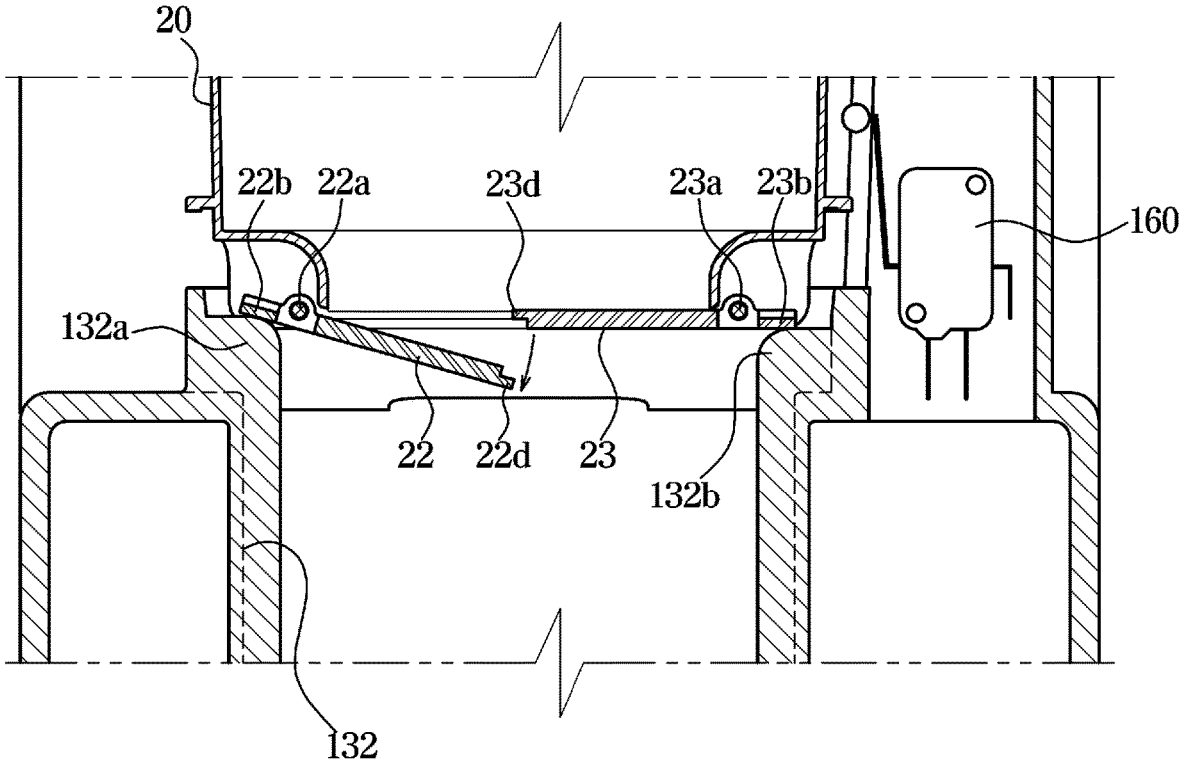
FIG. 6 is a cross-sectional view taken along line AA' of FIG. 3 in a process in which the cleaner is coupled to the station according to the first embodiment of the disclosure.
Figure 7:
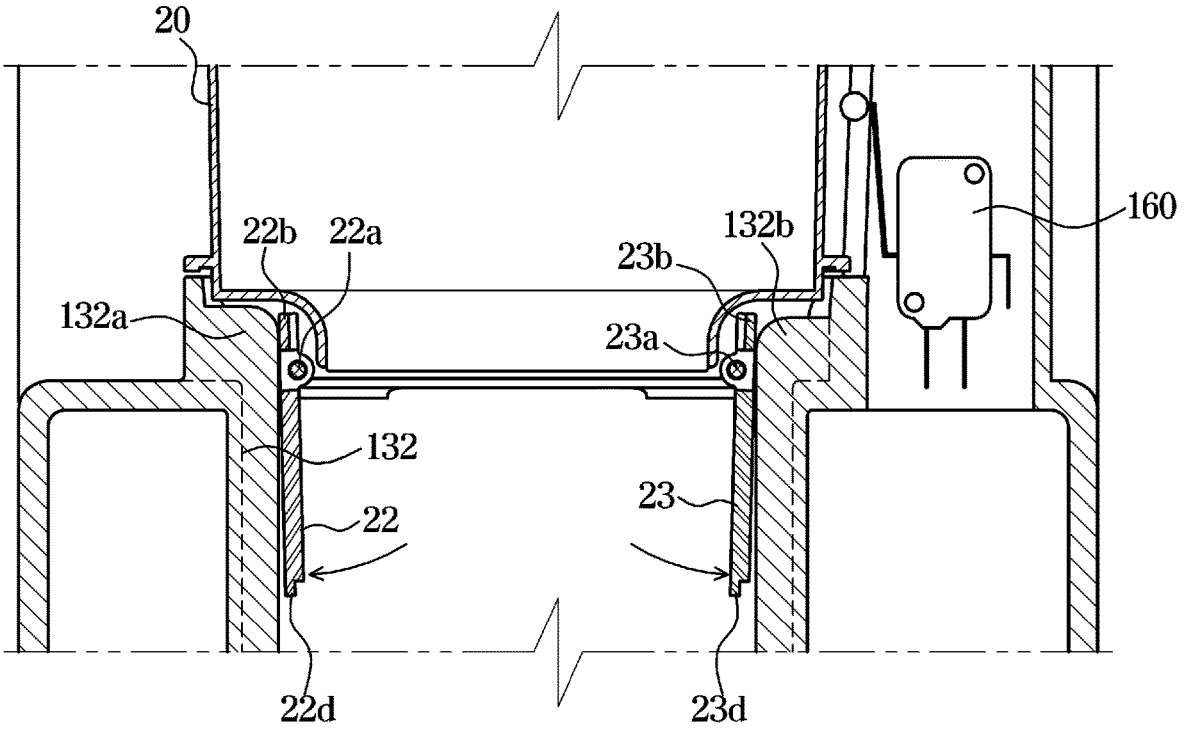
FIG. 7 is a cross-sectional view taken along line AA' of FIG. 3 after the cleaner is coupled to the station according to the first embodiment of the disclosure.

FIG. 5 is a sectional perspective view of a part of a dust collecting chamber of the cleaner according to the first embodiment of the disclosure, FIG. 6 is a cross-sectional view taken along line AA' of FIG. 3 in a process in which the cleaner is coupled to the station according to the first embodiment of the disclosure and FIG. 7 is a cross-sectional view taken along line AA' of FIG. 3 after the cleaner is coupled to the station according to the first embodiment of the disclosure.

Referring to FIGS. 5 to 7, the dust collecting chamber 20 may include a dust collecting chamber door 21 configured to open and close the dust collecting chamber 20 upon being docked to the docking station 100.

The dust collecting chamber door 21 may form a lower portion of the dust collecting chamber 20 and be arranged at a lower end of the dust collecting chamber 20.

The dust collecting chamber 20 may be provided in the shape having a plurality of chambers. That is, the dust collecting chamber 20 may be formed in such a way that the plurality of cyclone chambers is arranged in a stack. At this time, upon opening of the dust collecting chamber door 21, the plurality of chambers forming the dust collecting chamber 20 may be opened to the outside by the dust collecting chamber door 21(refer to FIG. 4).

Although the dust collecting chamber 20 is formed in the shape of multi cyclone type, the dust collecting chamber 20 may discharge foreign substances collected therein upon the opening of the dust collecting chamber door 21.

The dust collecting chamber door 21 may include a first door 22 and a second door 23. The first door 22 and the second door 23 may be configured to be in contact with the center of the dust collecting chamber 20 with respect to the lower center of the dust collecting chamber 20 so as to close the dust collecting chamber 20. The first door 22 and the second door 23 may be configured to rotate from the lower center of the dust collecting chamber 20 toward the lower side through a first rotary shaft 22*a* and a second rotary shaft 23*a*, so as to open the dust collecting chamber 20.

A first contact portion 22*c* of the first door 22 and a second contact portion 23*c* of the second door 23 may be provided at portions where the first door 22 and the second door 23 are in contact with each other.

The first contact portion 22*c* and the second contact portion 23*c* may be in contact with each other so as to overlap each other in the vertical direction.

A first contact protrusion 22*d* protruding from the lower side of the first contact portion 22*c* to the second contact portion 23*c* may be formed in the first contact portion 22*c*, and a second contact protrusion 23*d* protruding from the upper side of the second contact portion 23*c* to the first contact portion 22*c* may be formed in the second contact portion 23*c*.

That is, the second contact protrusion 23*d* and the first contact protrusion 22*d* may sequentially overlap each other in the vertical direction.

Accordingly, in response to the closed state of the first door 22 and the second door 23, the foreign substances may be prevented from leaking between the first door 22 and the second door 23.

The first door 22 may include a first pressed portion 22*b* arranged on a side opposite to the first contact portion 22*c* and configured to rotate the first door 22 about the first rotary shaft 22*a* by being pressed by a first opening rib 132*a* described later. The first door 22 may be provided such that the first contact portion 22*c*, the first rotary shaft 22*a*, and the first pressed portion 22*b* are sequentially arranged outward from the center of the lower end of the dust collecting chamber 20.

The second door 23 may include a second pressed portion 23*b* arranged on a side opposite to the second contact portion 23*c* and configured to rotate the second door 23 about the second rotary shaft 23*a* by being pressed by a second opening rib 132*b* described later. The second door 23 may be provided such that the second contact portion 23*c*, the second rotary shaft 23*a*, and the second pressed portion 23*b* are sequentially arranged outward from the center of the lower end of the dust collecting chamber 20.

The first door 22 and the second door 23 may be provided with a door side elastic member (not shown) configured to elastically support the first door 22 and the second door 23 so as to be elastically coupled to the dust collecting chamber 20.

The door side elastic member (not shown) may limit the rotation of the first door 22 and the second door 23 so as to maintain the first door 22 and the second door 23 in the closed state.

In response to the downward rotation of the first door 22 and the second door 23 by an external pressure, the door side elastic member (not shown) may elastically support the first door 22 and the second door 23 upward. Accordingly, in response to releasing the external pressure, the first door 22 and the second door 23 rotated downward may be rotated upward again and arranged in the closed state.

The intake flow path 132 may include the first opening rib 132*a* and the second opening rib 132*b*, which are arranged inside the intake flow path 132 and configured to push the first pressed portion 22*b* and the second pressed portion 23*b* upward upon the docking of the dust collecting chamber 20 to the intake flow path 132.

The dust collecting chamber 20 may be provided to be inserted into one end of the intake flow path 132 by passing through the first opening 141. The dust collecting chamber 20 is inserted into the intake flow path 132 in the vertical direction, and particularly, while the dust collecting chamber 20 is inserted into the intake flow path 132 in the vertical direction, the first pressed portion 22*b* and the second pressed portion 23*b* may be pressed upward by the first opening rib 132*a* and the second opening rib 132*b* arranged inside the intake flow path 132.

As for the first door 22, the first contact portion 22*c* may be rotated downward about the first rotary shaft 22*a* while the first pressed portion 22*b* is pressed upward.

As for the second door 23, the second contact portion 23*c* may be rotated downward about the second rotary shaft 23*a* while the second pressed portion 23*b* is pressed upward.

The first opening rib 132*a* and the second opening rib 132*b* each may be provided to protrude toward the center of the intake flow path 132 from the inner circumferential surface of the intake flow path 132.

The first opening rib 132*a* and the second opening rib 132*b* may be arranged on opposite sides with respect to the center of the intake flow path 132.

As mentioned above, the first door 22 and second door 23 may be elastically supported upward by the door side elastic member (not shown) upon opening the first door 22 and the second door 23 downward.

Upon docking the dust collecting chamber 20 to the intake flow path 132 in the downward direction, the first opening rib 132*a* and the second opening rib 132*b* may press the first pressed portion 22*b* and the second pressed portion 23*b*, respectively, and then support the first pressed portion 22*b* and the second pressed portion 23*b* while the dust collecting chamber 20 is docked to the intake flow path 132.

Accordingly, the first door 22 and the second door 23 may be maintained in an open state while the dust collecting chamber 20 is docked to the intake flow path 132.

Upon separating the dust collecting chamber 20 from the intake flow path 132, the first pressed portion 22*b* and the second pressed portion 23*b* may be moved upward and separated from the first opening rib 132*a* and the second opening rib 132*b*.

Therefore, the first opening rib 132*a* and the second opening rib 132*b* may not press the first pressed portion 22*b* and the second pressed portion 23*b* and thus the first door 22 and the second door 23 may be rotated upwards by being elastically supported by the door side elastic member (not shown).

Accordingly, the first door 22 and the second door 23 are opened by the first opening rib 132*a* and the second opening rib 132*b* upon docking the dust collecting chamber 20 to the intake flow path 132. Upon separating the dust collecting chamber 20 from the intake flow path 132, the first door 22 and the second door 23 may close the dust collecting chamber 20 again by the door side elastic member (not shown).

The first opening rib 132*a* and the second opening rib 132*b* may be provided to have different heights in the vertical direction. With respect to the vertical direction, an upper end of the first opening rib 132*a* may be provided to extend to a position higher than an upper end of the second opening rib 132*b*.

Upon docking the dust collecting chamber 20 to the intake flow path 132 in a state in which the upper end of the first opening rib 132*a* extends higher than the upper end of the second opening rib 132*b*, the first pressed portion 22*b* may be pressed before the second pressed portion 23*b* and thus the first door 22 may be first opened.

Sequentially, the second pressed portion 23*b* may be pressed by the upper end of the second opening rib 132*b* and then the second door 23 may be opened after the first door 22 is opened.

That is, the first door 22 and the second door 23 may be sequentially opened because the heights of the upper ends of the first opening rib 132*a* and the upper ends of the second opening rib 132*b* are different from each other. On the contrary, upon separating the dust collecting chamber 20 from the intake flow path 132, the second pressed portion 23*b* may move upward, and the contact with the second opening rib 132*b* may be terminated before the contact between the first pressed portion 22*b* and the first opening rib 132*a* is terminated. Therefore, the second door 23 may be closed before the first door 22.

By opening and closing the first door 22 and the second door 23 sequentially, it is possible to prevent the first door 22 and the second door 23 from being opened at the same time. Accordingly, it is possible to prevent the dust collected in the dust collecting chamber 20 from scattering instantaneously. In addition, it is possible to prevent a case in which while the first door 22 and the second door 23 are rotated, the first contact portion 22*c* and the second contact portion 23*c* do not reach the closed position and thus before the first door 22 and the second door 23 are rotated to the closed position, the end portion of the first contact portion 22*c* and the end portion of the second contact portion 23*c* are in contact with each other and jammed with each other.

In addition, as described above, because the second contact protrusion 23*d* and the first contact protrusion 22*d* sequentially overlap each other in the vertical direction, the first door 22 may be opened before the second door 23 is opened, and the second door 23 may be closed before the first door 22 is closed.

Because the second contact protrusion 23*d* is arranged above the first contact protrusion 22*d*, upon opening the second door 23 before the first door 22, the second contact protrusion 23*d* may be rotated downward and at this time, the first contact protrusion 22*d* may limit the rotation of the second contact protrusion 23*d*.

As described above, the second contact protrusion 23*d* and the first contact protrusion 22*d* may prevent the foreign substance from escaping from the dust collecting chamber 20 through between the first door 22 and the second door 23 while the second contact protrusion 23*d* and the first contact protrusion 22*d* allows the first door 22 and the second door 23 to be sequentially opened or closed.

In this way, due to the arrangement of the first opening rib 132*a* and the second opening rib 132*b* and the arrangement of the second contact protrusion 23*d* and the first contact protrusion 22*d*, the first door 22 may be opened before the second door 23 and the second door 23 may be closed before the first door 22.

Hereinafter a configuration of a dust collecting chamber door 21 according to a second embodiment of the disclosure will be described. A configuration other than the dust collecting chamber door 21 described below is the same as that of the cleaning apparatus 1 according to the first embodiment of the disclosure, and thus a description thereof will be omitted.

Figure 8:
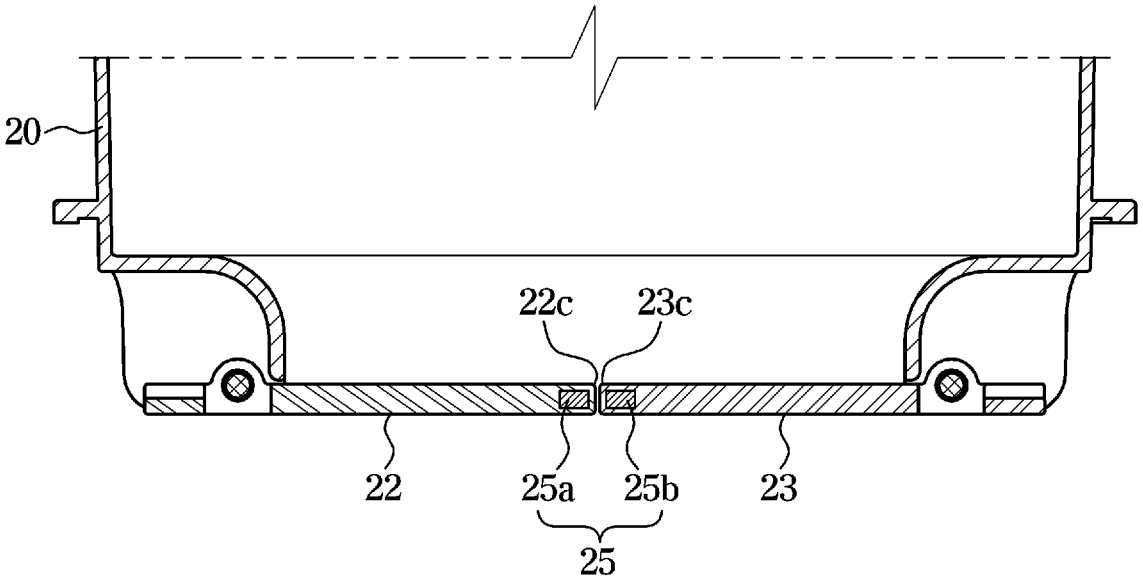
FIG. 8 is a sectional perspective view of a part of a dust collecting chamber of a cleaner according to a second embodiment of the disclosure.

FIG. 8 is a sectional perspective view of a part of a dust collecting chamber of a cleaner according to a second embodiment of the disclosure.

Referring to FIG. 8, a first door 22 and a second door 23 of a dust collecting chamber door 21 according to another embodiment of the disclosure may include a magnet 25, respectively.

According to the first embodiment of the disclosure described above, the first door 22 and the second door 23 include the first contact protrusion 22*d* and the second contact protrusion 23*d*, respectively. However, the first door 22 and the second door 23 according to the second embodiment of the disclosure do not include contact protrusions.

Therefore, the first contact portion 22*c* and the second contact portion 23*c* may be provided in a planar shape.

The first door 22 includes a first magnet 25*a* arranged adjacent to the first contact portion 22*c* and arranged inside the first door 22.

The second door 23 includes a second magnet 25*b* arranged adjacent to the second contact portion 23*c* and arranged inside the second door 23.

In response to the closed state of the first door 22 and the second door 23 by the first magnet 25*a* and the second magnet 25*b*, it is possible to tightly maintain the first contact portion 22*c* and the second contact portion 23*c* at the contact state.

Accordingly, the foreign substance inside the dust collecting chamber 20 may be prevented from leaking out through between the first door 22 and the second door 23.

Hereinafter the flow rate regulator 150 will be described.

Figure 9:
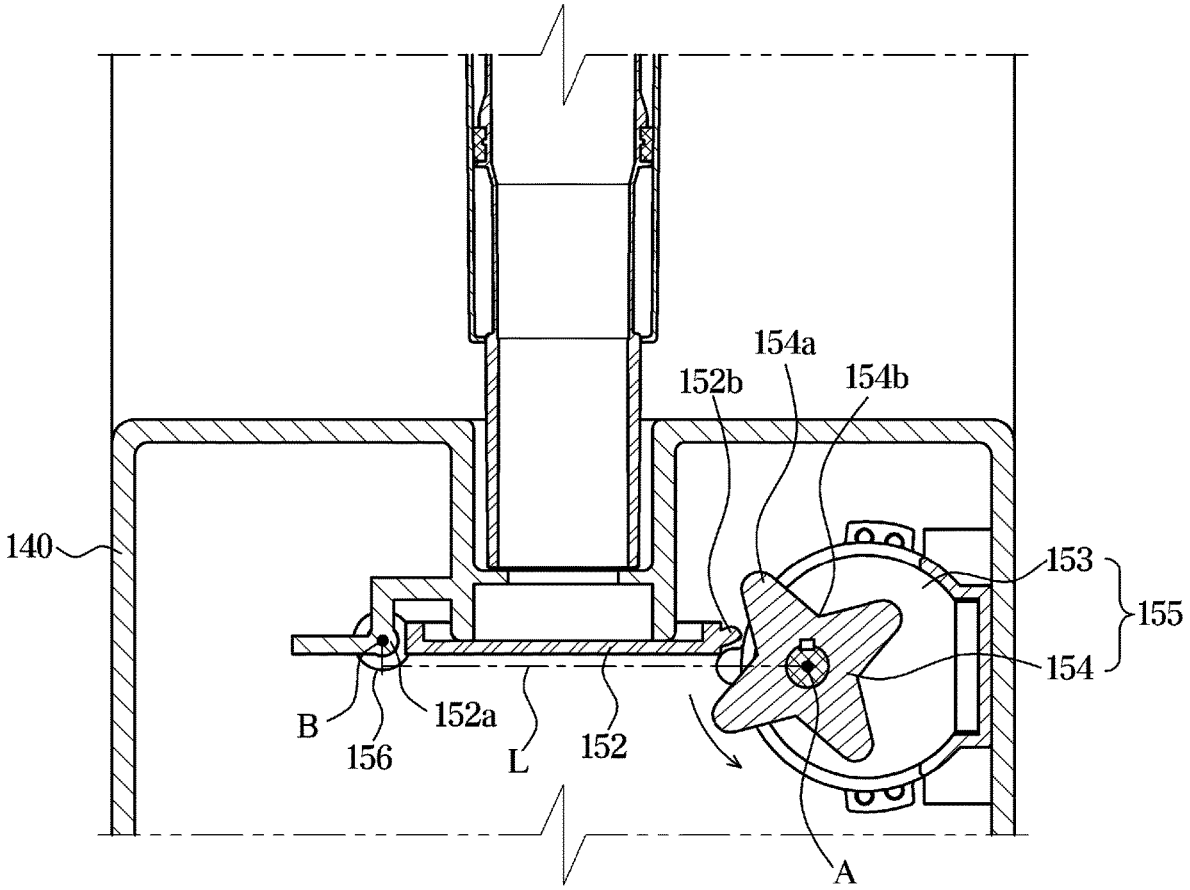
FIG. 9 is a cross-sectional view taken along line BB' of FIG. 3 when a flow path cover is closed in a state in which the cleaner is coupled to the station according to the first embodiment of the disclosure.
Figure 10:
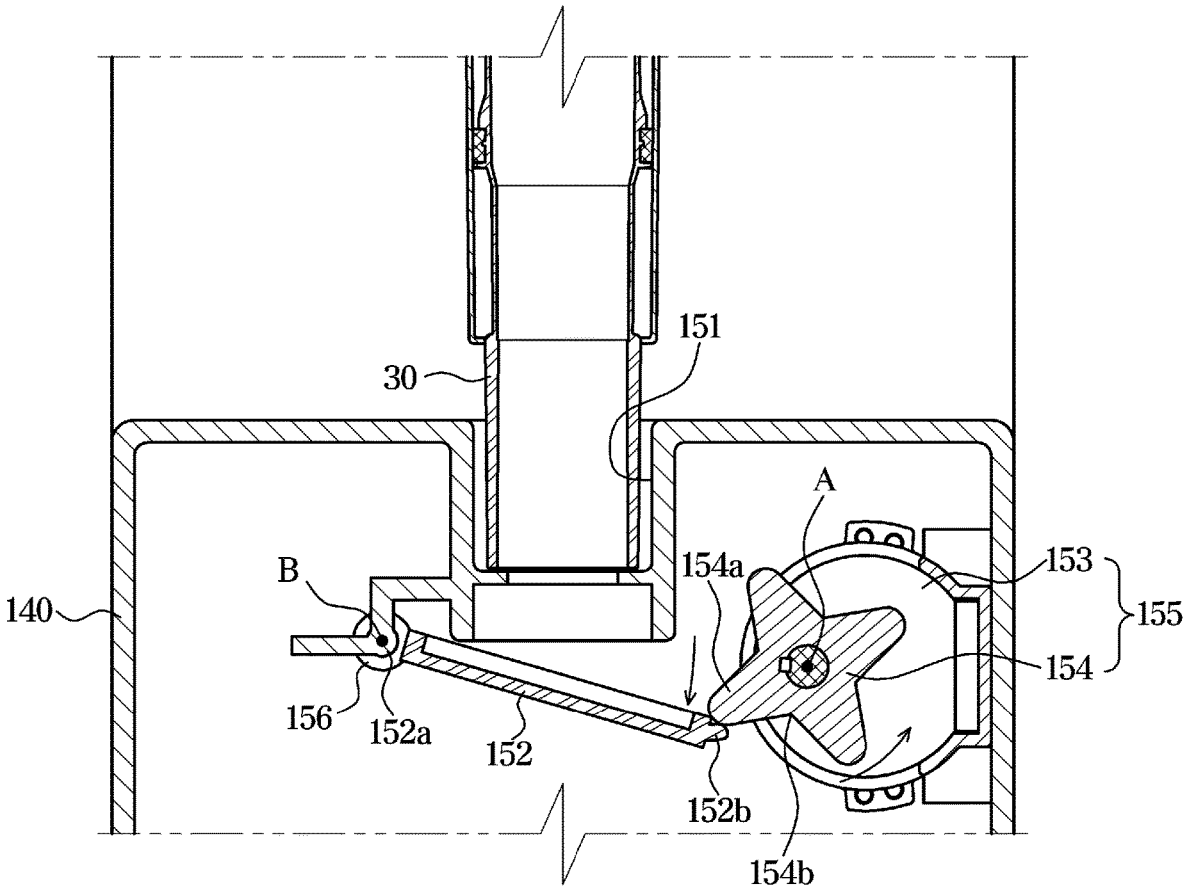
FIG. 10 is a cross-sectional view taken along line BB' of FIG. 3 when the flow path cover is opened in a state in which the cleaner is coupled to the station according to the first embodiment of the disclosure.

FIG. 9 is a cross-sectional view taken along line BB' of FIG. 3 when a flow path cover is closed in a state in which the cleaner is coupled to the station according to the first embodiment of the disclosure and FIG. 10 is a cross-sectional view taken along line BB' of FIG. 3 when the flow path cover is opened in a state in which the cleaner is coupled to the station according to the first embodiment of the disclosure.

As described above, the foreign substance collected in the dust collecting chamber 20 may be discharged to the outside through the suction device 130 and collected by a collector (not shown) of the suction device 130.

Air and foreign substances in the dust collecting chamber 20 may be discharged to the outside through the dust collecting chamber door 21 of the dust collecting chamber 20 and the intake flow path 132, but some of the foreign substances may be not discharged to the outside by being caught by the inner structure of the dust collecting chamber 20.

For example, because foreign substances such as hair are caught by the internal structure of the dust collecting chamber 20 and are not discharged to the outside, the foreign substance may be left in the dust collecting chamber 20 due to the intake air flow that is generated to the lower side of the dust collecting chamber door 21.

The intake air flow delivered to the dust collecting chamber 20 may be formed to be directed to only the downward direction of the dust collecting chamber 20. Accordingly, some foreign substance may have a resistance to the direction in which the intake air flow is formed, and thus the foreign substances may be not discharged to the outside of the dust collecting chamber 20 due to the intake air flow.

Accordingly, a difficulty may occur in that the foreign substance inside the dust collecting chamber 20 is not effectively removed.

In order to ease the difficulty, the docking station 100 according to an embodiment of the disclosure may include the flow rate regulator 150 configured to selectively provide additional outside air to the dust collecting chamber 20 in addition to the intake air flow.

While the intake air flow is supplied to the dust collecting chamber 20 and the internal air of the dust collecting chamber 20 is suctioned by the suction device 130, the flow rate regulator 150 may variously change the internal air flow of the dust collecting chamber 20 by changing the flow rate of the inside of the dust collecting chamber 20.

As described above, in the dust collecting chamber 20, the air flow is directed to the lower side by the suction fan 131. Particularly, because the internal air of the dust collecting chamber 20 is continuously discharged to the outside by the suction fan 131, the negative pressure may be generated in the dust collecting chamber 20, in comparison with the atmospheric pressure.

At this time, upon additionally supplying the outside air to the dust collecting chamber 20 by the flow rate regulator 150, the air pressure inside the dust collecting chamber 20 may be instantly raised. As the air pressure is raised, the flow of air inside the dust collecting chamber 20 may be changed, and the flow of air that has been directed to only downward may be changed in all directions.

As the flow rate inside the dust collecting chamber 20 is changed, air may be spread in all directions in the internal space of the dust collecting chamber 20, and thus the air flow, which has been directed to only the lower side, may be changed in various directions.

As the direction of the air flow is changed instantaneously, some foreign substance having a resistance to the downward direction may lose resistance by the air flowing in the other direction and some foreign substance may be separated out of the dust collecting chamber 20 together with the air flow.

The flow rate regulator 150 is configured to provide air to the dust collecting chamber 20 for a predetermined period of time and stop supplying air for a predetermined period of time. The flow rate regulator 150 may periodically change the air flow inside the dust collecting chamber 20 by repeatedly supplying the outside air to the dust collecting chamber 20 or stopping supplying air.

Referring to FIGS. 9 and 10, the flow rate regulator 150 may include a connecting flow path 151 connected to the dust collecting guide 30.

One end of the connecting flow path 151 may be connected to the dust collecting guide 30, and the other end of the connecting flow path 151 may be provided to allow outside air to flow therein.

The connecting flow path 151 may be arranged in the docking housing 140 and connected to the second opening 142. One end of the connecting flow path 151 may communicate with the second opening 142, and the other end of the connecting flow path 151 may be arranged in the docking housing 140 to allow air of the docking housing 140 to flow therein.

Because the dust collecting guide 30 is provided to communicate with the dust collecting chamber 20 as described above, the outside air may flow into the dust collecting chamber 20 through the dust collecting guide 30 upon opening the dust collecting guide 30 toward the outside (refer to FIG. 4).

The flow rate regulator 150 includes a flow path cover 152 configured to cover the other end of the connecting flow path 151.

The flow path cover 152 may include a hinge 152*a* arranged on one side of the flow path cover 152 and configured to allow the flow path cover 152 to be rotatably coupled to the connecting flow path 151.

The flow path cover 152 may be rotatable with respect to the connecting flow path 151 using the hinge 152*a* as a rotation axis. In order to close the connecting flow path 151, the flow path cover 152 may be rotated downward about the hinge 152*a* at a position covering the other end of the connecting flow path 151.

The flow rate regulator 150 may include a cover elastic member 156 configured to elastically support the flow path cover 152.

The cover elastic member 156 may be configured to allow the flow path cover 152 to be elastically supported upward.

The flow path cover 152 may be pressed upward by the cover elastic member 156. Accordingly, the cover elastic member 156 may elastically support the flow path cover 152 to allow the flow path cover 152 to be rotated to the other end direction of the connecting flow path 151 with respect to the hinge 152*a*.

Therefore, in response to no external pressure, the flow path cover 152 may close the connecting flow path 151 by the cover elastic member 156. However, when the flow path cover 152 is pressed downward by an external pressure, the flow path cover 152 may be rotated downward about the hinge 152*a*, thereby being opened to the outside of the connecting flow path 151.

The flow rate regulator 150 may include an opening and closing unit 155 configured to selectively open and close the connecting flow path 151 through the flow path cover 152.

When the opening and closing unit 155 separates the flow path cover 152 from the connecting flow path 151 and the other end of the connecting flow path 151 is opened to the outside, the outside air may be introduced into the connecting flow path 151 and the introduced outside air may flow into the inside of the dust collecting chamber 20 through the connecting flow path 151 and the dust collecting guide 30.

The opening and closing unit 155 may include a drive motor 153 configured to generate a rotational force and an opening and closing member 154 configured to be rotatable by being connected to the drive motor 153 so as to press the flow path cover 152 toward one direction through the rotation thereof.

The flow path cover 152 may include a pressed portion 152*b* arranged on one side of the flow path cover 152 and pressed by the opening and closing member 154.

The pressed portion 152*b* may be arranged on the opposite side of the hinge 152*a*. Accordingly, when the pressed portion 152*b* is pressed by the opening and closing member 154, the pressed portion 152*b* may be rotated about the hinge 152*a* toward the direction in which the pressed portion 152*b* is pressed by the opening and closing member 154.

The opening and closing member 154 may press the pressed portion 152*b* downward. Accordingly, the flow path cover 152 may be pressed downward with respect to the hinge 152*a* and then the flow path cover 152 may be arranged in an open position.

Therefore, when the opening and closing member 154 presses the pressed portion 152*b*, the flow path cover 152 may be opened and the connecting flow path 151 may be opened to the outside.

When the pressing of the opening and closing member 154 is terminated, the pressed portion 152*b* may be rotated upward by the cover elastic member 156, thereby closing the flow path cover 152.

Particularly, a rotation axis A of the shaft of the drive motor 153 and a rotation axis B of the hinge 152*a* may extend in parallel to each other. The opening and closing member 154 and the flow path cover 152 connected to the drive motor 153 may include the rotation shafts A and B having the same direction.

It is appropriate that the rotation axis A of the shaft of the drive motor 153 and the rotation axis B of the hinge 152*a* may be arranged at the same height in the vertical direction.

When the opening and closing member 154 is rotated in one direction in association with the driving of the drive motor 153, the pressed portion 152*b* may be pressed downward by the opening and closing member 154 and thus the flow path cover 152 may be rotated to a direction opposite to the opening and closing member 154.

The opening and closing member 154 may include a pressing protrusion 154*a* protruding in a radial direction of the rotation axis of the opening and closing member 154 and provided to press the pressed portion 152*b*. The pressing protrusion 154*a* may be provided in plural and the plurality of the pressing protrusions 154*a* may be radially arranged about the rotation axis of the opening and closing member 154. It is appropriate that four pressing protrusions 154*a* may be formed.

A non-pressing portion 154*b* configured to not press the pressed portion 152*b* upon the rotation of the opening and closing member 154 may be provided among the plurality of pressing protrusions 154*a*.

Referring to FIG. 9, when any one of the plurality of pressing protrusions 154*a* presses the pressed portion 152*b* while the opening and closing member 154 rotates, the flow path cover 152 may be rotated to a direction, which is opposite to the rotation direction of the opening and closing member 154, by the opening and closing member 154, and then opened.

That is, it is assumed that an imaginary line between the rotation axis A of the shaft of the drive motor 153 and the rotation axis B of the hinge 152*a* is a line L, and when any one of the plurality of pressing protrusions 154*a* passes through the line L, any one of the plurality of pressing protrusions 154*a* may press the pressed portion 152*b*, thereby opening the flow path cover 152.

As the opening and closing member 154 continues to rotate, any one of the plurality of pressing protrusions 154*a* may continue to rotate downward and rotate in a direction away from the pressed portion 152*b* due to the radial distance of the opening and closing member 154.

That is, due to the continuous rotation of the opening and closing member 154, any one of the plurality of pressing protrusions 154*a* may pass through the line L, and thus the pressing of any one of the plurality of pressing protrusions 154*a* against the pressing portion 152*b* may be terminated.

The flow path cover 152 may be rotated in the same rotational direction as the opening and closing member 154 so as to close the connecting flow path 151 again.

Referring to FIG. 10, the opening and closing member 154 may continue to rotate while the flow path cover 152 closes the connecting flow path 151. At this time, the non-pressing portion 154*b* may pass through the line L.

The non-pressing portion 154*b* is configured to not press the pressed portion 152*b* upon the rotation of the opening and closing member 154, as mentioned above. As for the non-pressing portion 154*b*, a length that extends in the radial direction of the rotation axis A of the opening and closing member 154 may be relatively less than the pressing protrusion 154*a*.

As for the non-pressing portion 154*b*, the length extending in the radial direction of the rotation axis A of the opening and closing member 154 may be set to prevent the non-pressing portion 154*b* from being in contact with the pressed portion 152*b* when the non-pressing portion 154*b* passes through the line L.

Accordingly, an external force is not applied to the pressed portion 152*b* while the non-pressing portion 154*b* passes through the line L, and thus the flow path cover 152 may maintain the closed state of the connecting flow path 151.

Sequentially, another one of the plurality of pressing protrusions 154*a* continues to rotate downward in accordance with the continuous rotation of the opening and closing member 154, and then the another one of the plurality of pressing protrusions 154*a* passes through the line L. Therefore, the opening and closing member 154 may press the pressed portion 152*b* again, thereby opening the flow path cover 152.

As described above, the opening and closing member 154 may alternately open and close the flow path cover 152 as the plurality of pressing protrusions 154*a* and the non-pressing portion 154*b* alternately pass through the line L.

The connecting flow path 151 may be periodically opened to and closed from the outside, the outside air may flow into the dust collecting guide 30 for a predetermined period of time, flowing of the air to the dust collecting guide 30 may be blocked for a predetermined period of time, and the air may flow into the dust collecting guide 30 for a predetermined period of time, again.

As such a mechanism is repeated, the flow rate of the outside air, which is additionally introduced into the dust collecting chamber 20, may be repeatedly changed, and thus the flow of air inside the dust collecting chamber 20 may be variously changed.

The direction of air flow may vary according to the change in the flow rate of the internal air of the dust collecting chamber 20, and thus the foreign substances left in the dust collecting chamber 20 may be discharged to the outside with the air flow that is generated in the various directions.

Hereinafter the driving sequence of the docking station 100 will be described.

Figure 11:
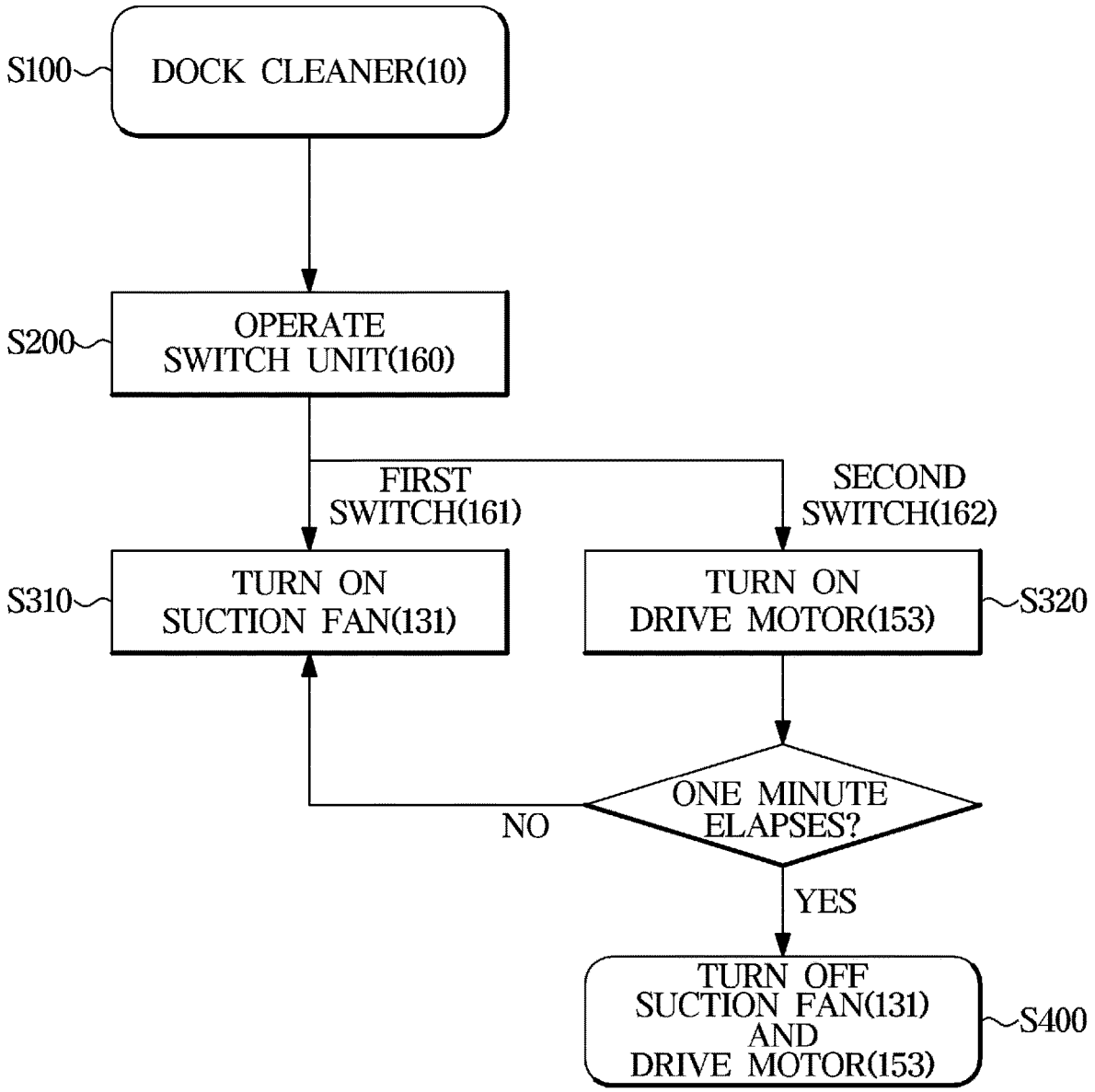
FIG. 11 is a flow chart illustrating driving of the station shown in FIG. 1.

FIG. 11 is a flow chart illustrating driving of the station shown in FIG. 1 according to an embodiment of the disclosure.

Referring to FIG. 11, in response to docking the cleaner 10 to the docking station 100 as mentioned above at operation S100, the switch unit 160 may detect the docking of the cleaner 10.

Accordingly, the switch unit 160 may transmit an electrical signal to the controller (not shown) or may be directly connected to the suction device 130 and the flow rate regulator 150 to transmit the electrical signal at operation S200.

The first switch 161 may provide an electrical signal for driving the suction fan 131, to the suction device 130. The first switch 161 may provide a signal to the suction device 130 to drive the suction fan 131 for about one minute at operation S310.

The second switch 162 may provide an electric signal for driving the drive motor 153 to the flow rate regulator 150. The second switch 162 may provide a signal to the flow rate regulator 150 to drive the drive motor 153 for about one minute at operation S320.

The first switch 161 and the second switch 162 may simultaneously drive the suction device 130 and the flow rate regulator 150 for about one minute.

In response to elapsed time that is less than one minute, the first switch 161 and the second switch 162 may continuously transmit a signal to drive the suction device 130 and the flow rate regulator 150.

However, the predetermine period of time is not limited thereto, and the first switch 161 and the second switch 162 may provide a signal to drive the suction device 130 and the flow rate regulator 150 for one minute or less or for one minute or more. Alternatively, any one of the suction device 130 and the flow rate regulator 150 may be first driven at a predetermined interval without being driven simultaneously.

In response to elapsed time that is one minute, the first switch 161 and second switch 162 may stop driving of the suction device 130 and the flow rate regulator 150, and transmit a signal to the suction device 130 and the flow rate regulator 150 at operation S400.

As mentioned above, because the flow rate regulator 150 is driven while the suction device 130 is driven, the outside air may be additionally supplied to the inside of the dust collecting chamber 20 while the intake air flow is generated inside of the dust collecting chamber 20. Therefore, it is possible to change the flow rate of the dust collecting chamber 20, thereby changing the air flow.

Hereinbefore a case in which the switch unit 160 directly transmits an electrical signal to the suction device 130 and the flow rate regulator 150 has been described. However, the disclosure is not limited thereto, and thus the switch unit 160 may transmit an electrical signal to the controller (not shown) and then the controller (not shown) may transmit the electrical signal to the suction device 130 and the flow rate regulator 150.

Hereinafter an opening and closing member 154' according to a third embodiment of the disclosure will be described. A configuration other than the opening and closing member 154' according to the third embodiment of the disclosure is the same as the configuration according to the first embodiment of the disclosure, and thus a description thereof will be omitted.

Figure 12:
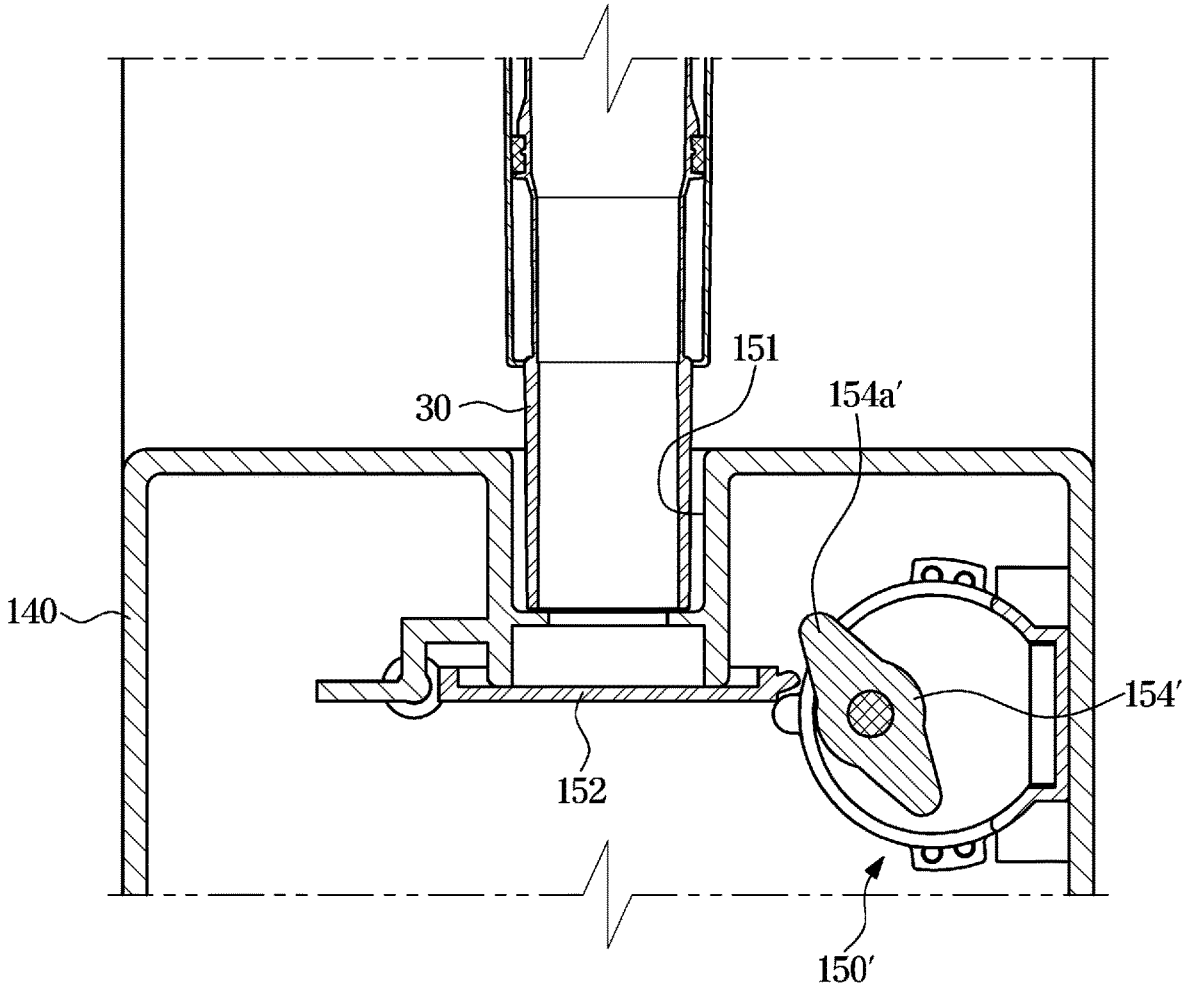
FIG. 12 is a cross-sectional view taken along line BB' of FIG. 3 when a flow path cover is closed in a state in which a cleaner is coupled to a station according to a third embodiment of the disclosure.

FIG. 12 is a cross-sectional view taken along line BB' of FIG. 3 when a flow path cover is closed in a state in which a cleaner is coupled to a station according to a third embodiment of the disclosure.

Referring to FIG. 12, four pressing protrusions 154*a* of the opening and closing member 154 may be provided according to the first embodiment of the disclosure. However, the number of the pressing protrusion is not limited thereto, and thus four or less or more of pressing protrusions 154*a* may be provided.

The opening and closing member 154' according to the third embodiment of the disclosure may include two pressing protrusions 154*a'*.

As the number of the pressing protrusions 154*a'* decreases, a range occupied by a non-pressing portion 154*b'* may increase. Accordingly, a time for opening the flow path cover 152 upon driving the opening and closing member 154' according to the third embodiment of the disclosure may become shorter than a time for opening the flow path cover 152 upon driving the opening and closing member 154 according to the first embodiment of the disclosure.

In response of the one rotation of the opening and closing member 154' according to the third embodiment of the disclosure, the opening and closing member 154' may open the flow path cover 152 twice, but in response of the one rotation of the opening and closing member 154 according to the first embodiment of the disclosure, the opening and closing member 154 may open the flow path cover 152 four times.

Therefore, the flow rate regulator 150' according to the third embodiment of the disclosure may provide a smaller amount of outside air to the dust collecting chamber 20 than that of the flow rate regulator 150 according to the first embodiment of the disclosure.

On the contrary, although not shown in the drawing, when more than four pressing protrusions 154*a'* of the opening and closing member 154' are formed, the opening and closing member 154' may open the flow path cover 152 by a large number of times than the opening and closing member 154 according to the first embodiment of the disclosure.

Therefore, the flow rate regulator 150' according to the third embodiment of the disclosure may provide a larger amount of outside air to the dust collecting chamber 20 than that of the flow rate regulator 150 according to the first embodiment of the disclosure.

As mentioned above, the amount of outside air provided to the dust collecting chamber 20 may be variously adjusted by changing the number of pressing protrusions 154*a'* of the opening and closing member 154'. Therefore, the optimal supply of outside air may be analyzed based on the shape of the inside of the dust collecting chamber 20, and accordingly, the various shapes of the opening and closing member 154' may be provided to supply the outside air into the inside of the dust collecting chamber 20 according to the optimal supply of outside air.

Hereinafter a flow rate regulator 170 according to a fourth embodiment of the disclosure will be described. A configuration other than the flow rate regulator 170 according to the fourth embodiment of the disclosure is the same as the configuration according to the first embodiment of the disclosure, and thus a description thereof will be omitted.

Figure 13:
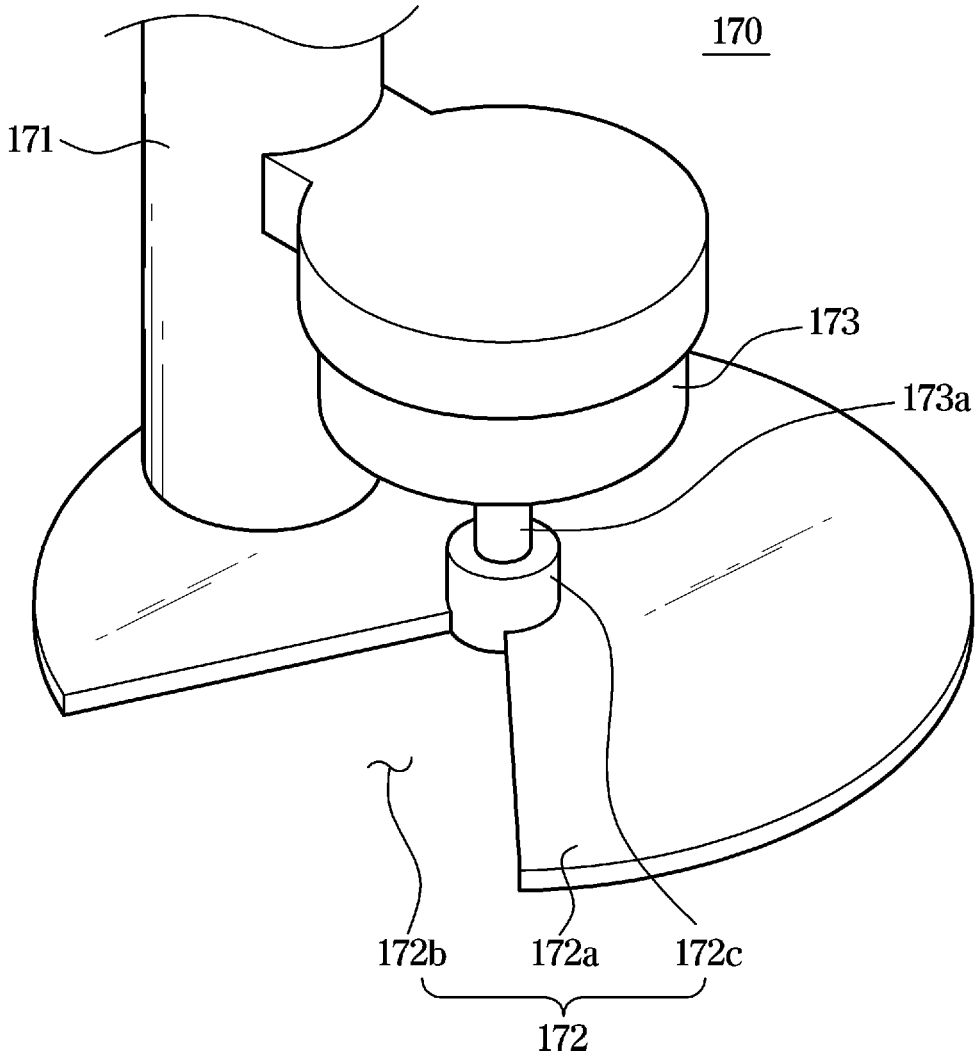
FIG. 13 is a perspective view of a flow rate regulator of a station according to a fourth embodiment of the disclosure.
Figure 14:
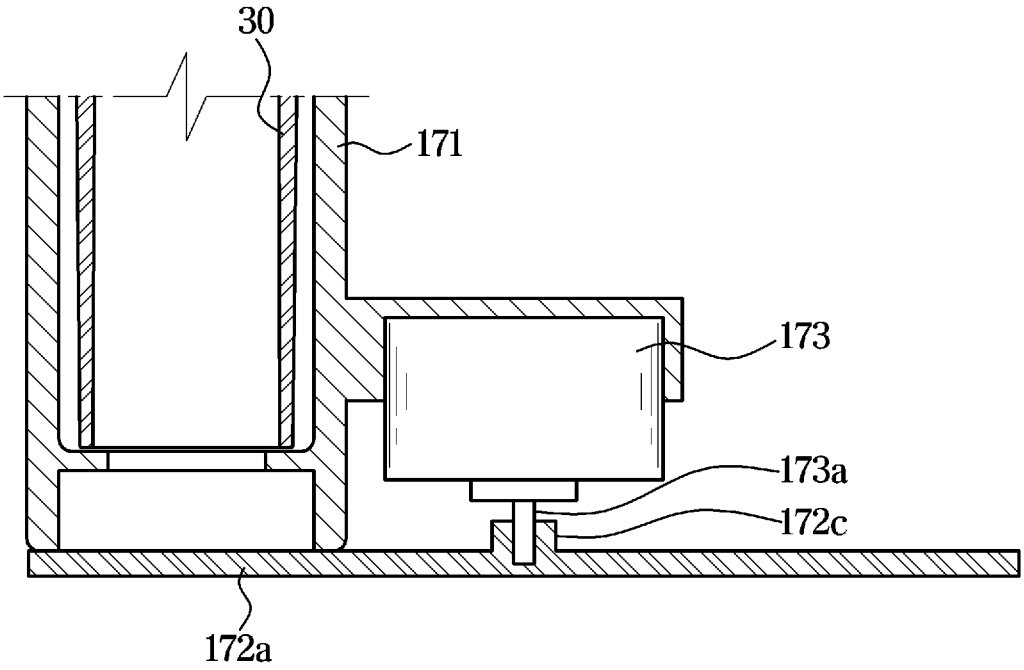
FIG. 14 is a schematic sectional side view illustrating a state in which the flow rate regulator of FIG. 13 closes a connecting flow path.
Figure 15:
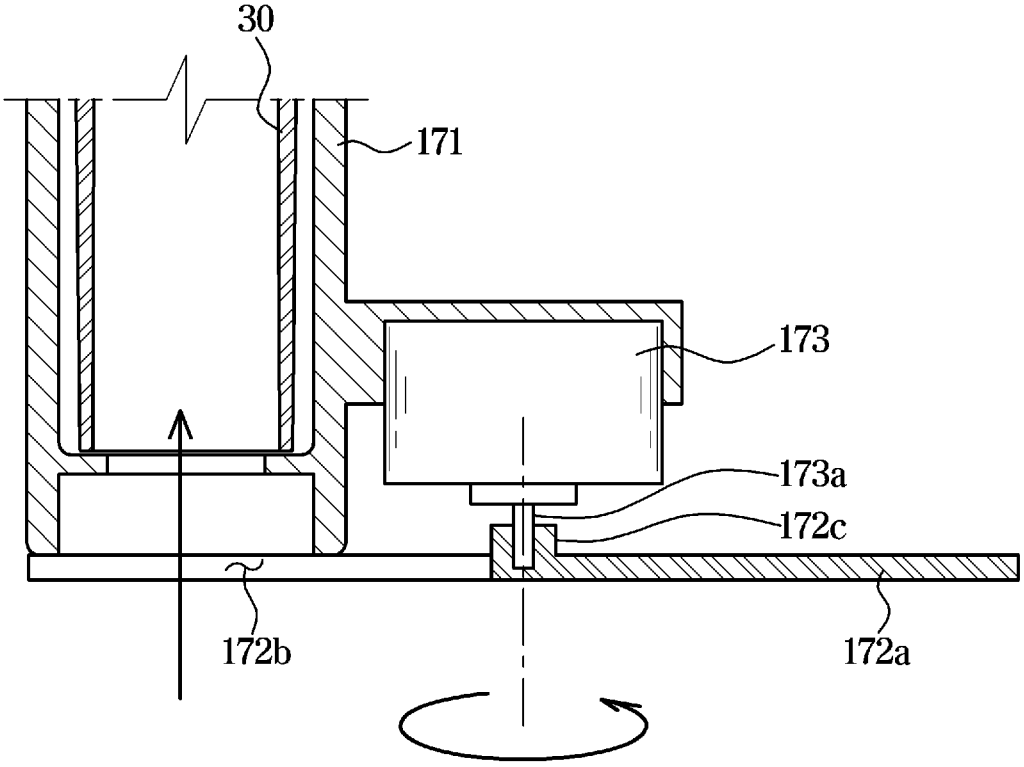
FIG. 15 is a schematic sectional side view illustrating a state in which the flow rate regulator of FIG. 13 opens the connecting flow path.

FIG. 13 is a perspective view of a flow rate regulator of a station according to a fourth embodiment of the disclosure, FIG. 14 is a schematic sectional side view illustrating a state in which the flow rate regulator of FIG. 13 closes a connecting flow path, and FIG. 15 is a schematic sectional side view illustrating a state in which the flow rate regulator of FIG. 13 opens the connecting flow path.

Referring to FIGS. 13 to 15, the flow rate regulator 170 may include a connecting flow path 171 connected to the dust collecting guide 30, and a flow path cover 172 configured to selectively cover the connecting flow path 171.

The flow rate regulator 170 may include an opening and closing unit 173 configured to selectively open and close the connecting flow path 171 through the flow path cover 172.

The opening and closing unit 173 may include a motor. A motor shaft 173*a* may be connected to the flow path cover 172 to rotate the flow path cover 172.

The flow path cover 172 may open and close the connecting flow path 171 through a rotation thereof.

The connecting flow path 171 may extend in the vertical direction, and the motor shaft 173*a* may extend in a direction corresponding to the extending direction of the connecting flow path 171.

The flow path cover 172 may extend to be perpendicular to the extending direction of the connecting flow path 171 or the motor shaft 173*a*.

The flow path cover 172 may be formed of a circular plate. However, the shape of the flow path cover 172 is not limited thereto, and the flow path cover 172 may have various shapes.

A coupler 172*c* engaged with the motor shaft 173*a* may be provided at the center of the flow path cover 172. Accordingly, the flow path cover 172 may be rotated about the center of the flow path cover 172.

However, the disclosure is not limited thereto, and the coupler 172*c* may be arranged on the outside of the center of the flow path cover 172.

The flow path cover 172 may include a body 172*a* and a cutout portion 172*b* in which some shapes are cut out in the body 172*a*.

The flow path cover 172 may be provided to be in contact with a lower end of the connecting flow path 171. Particularly, the body 172*a* of the flow path cover 172 may be provided to be in contact with the lower end of the connecting flow path 171.

In response to the arrangement of the connecting flow path 171 and the body 172*a* overlapping each other in the vertical direction by the rotation of the flow path cover 172, the flow path cover 172 may cover the connecting flow path 171, and then the connecting flow path 171 may be closed from the outside by the flow path cover 172. Accordingly, outside air may not be supplied to the dust collecting chamber 20 through the connecting flow path 171.

In response to the arrangement the connecting flow path 171 and the cutout portion 172*b* overlapping each other in the vertical direction by the rotation of the flow path cover 172, the connecting flow path 171 may be opened to the outside through the cutout portion 172*b*. Accordingly, outside air may be supplied to the dust collecting chamber 20 through the connecting flow path 171.

As the opening and closing unit 173 continues to rotate the flow path cover 172 by the motor, the connecting flow path 171 may alternately overlap with the body 172*a* and the cutout portion 172*b* in the vertical direction.

The cutout portion 172*b* may be formed larger than the body 172*a* as needed. The optimal supply of outside air may be analyzed based on the shape of the inside of the dust collecting chamber 20, and accordingly, the body 172*a* may have various areas to supply the outside air into the inside of the dust collecting chamber 20 according to the optimal supply of outside air.

Hereinafter a flow rate regulator 180 according to a fifth embodiment of the disclosure will be described. A configuration other than the flow rate regulator 180 according to the fifth embodiment of the disclosure is the same as the configuration according to the first embodiment of the disclosure, and thus a description thereof will be omitted.

Figure 16:
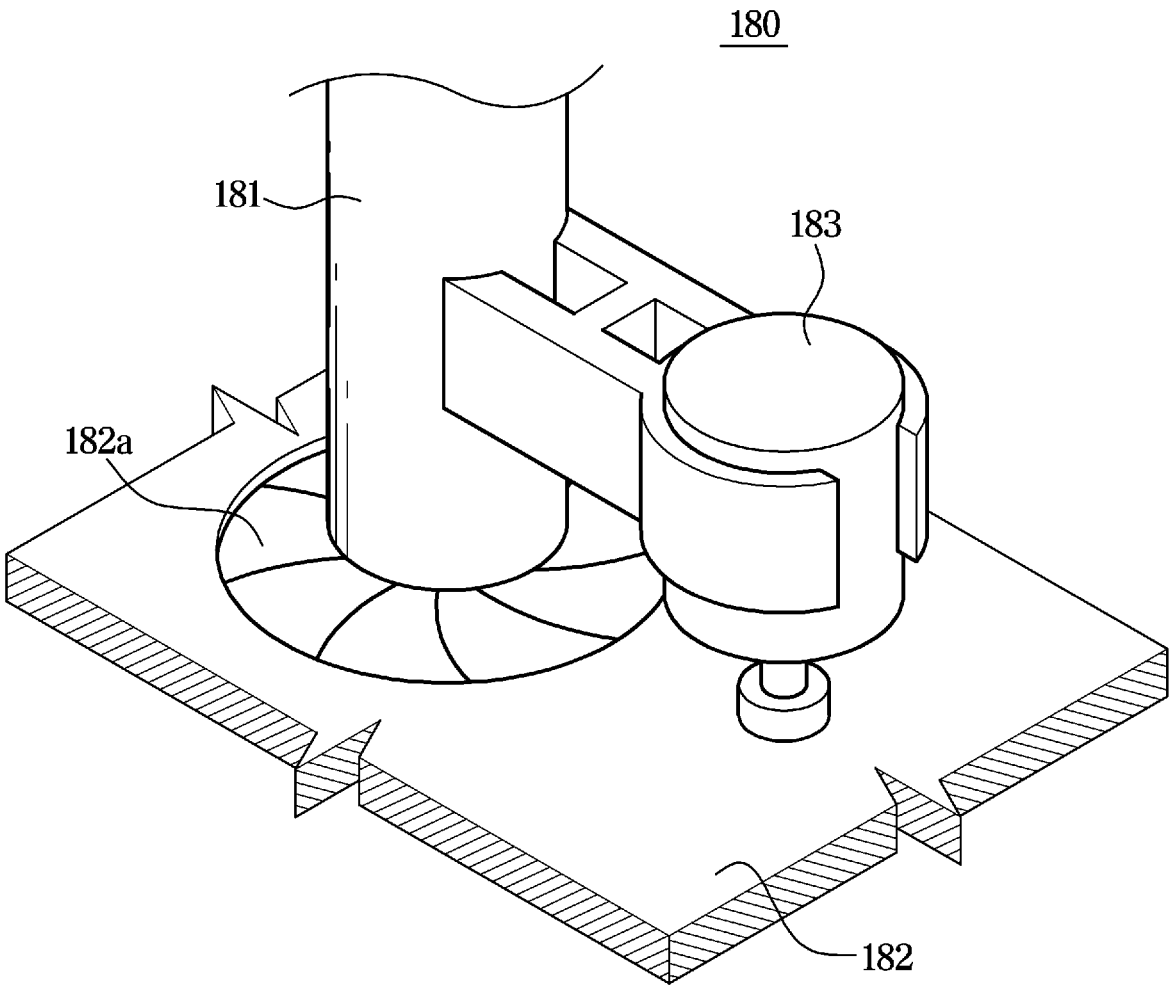
FIG. 16 is a perspective view of a flow rate regulator of a station according to a fifth embodiment of the disclosure.
Figure 17:
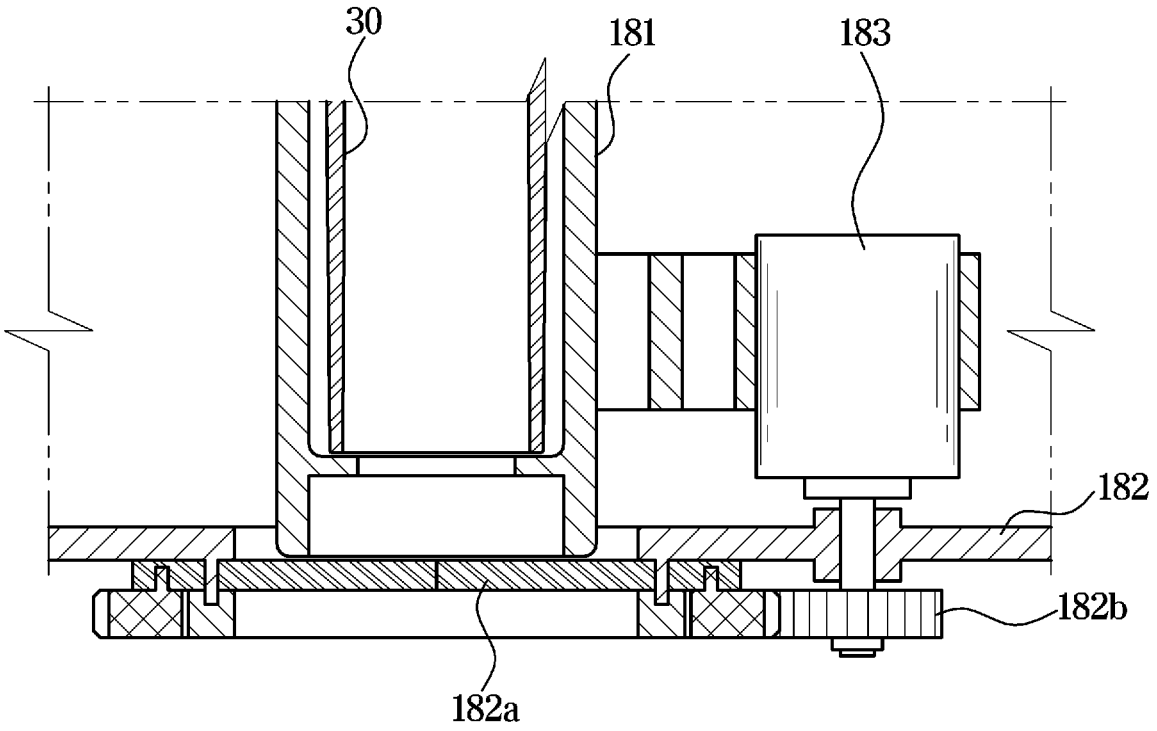
FIG. 17 is a schematic sectional side view illustrating a state in which the flow rate regulator of FIG. 16 closes a connecting flow path.
Figure 18:
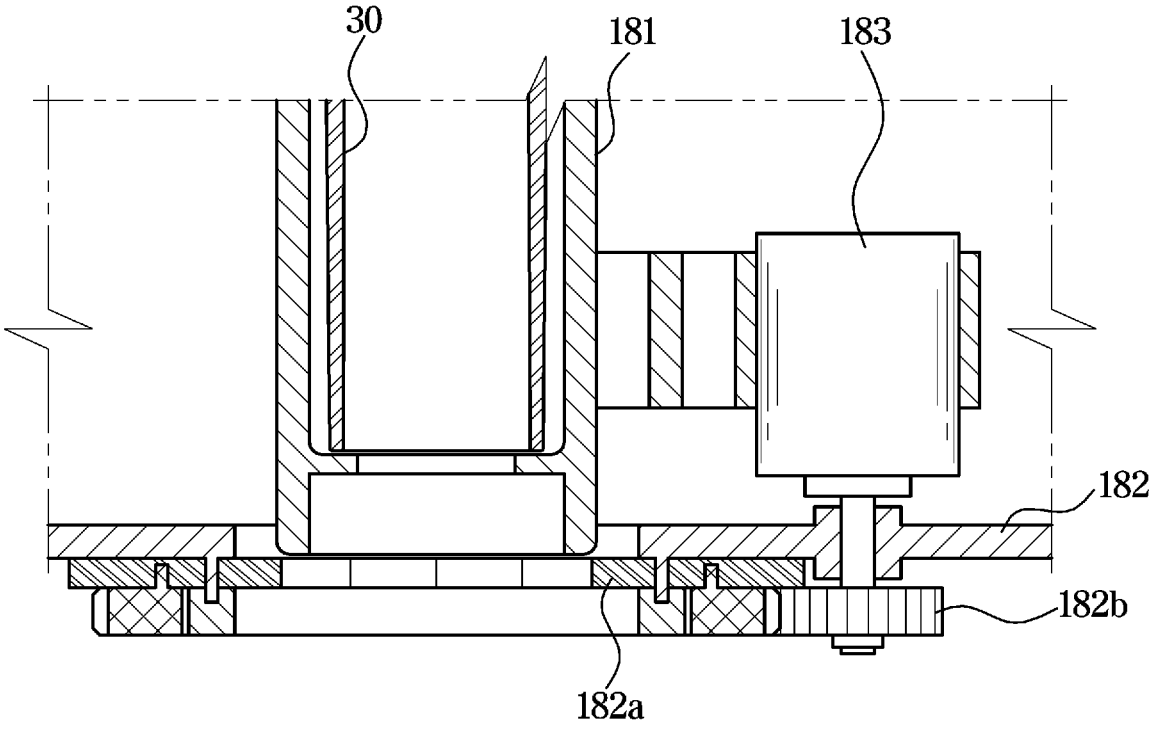
FIG. 18 is a schematic sectional side view illustrating a state in which the flow rate regulator of FIG. 16 opens the connecting flow path.

FIG. 16 is a perspective view of a flow rate regulator of a station according to a fifth embodiment of the disclosure, FIG. 17 is a schematic sectional side view illustrating a state in which the flow rate regulator of FIG. 16 closes a connecting flow path and FIG. 18 is a schematic sectional side view illustrating a state in which the flow rate regulator of FIG. 16 opens the connecting flow path.

Referring to FIGS. 16 to 18, the flow rate regulator 180 may include a connecting flow path 181 connected to the dust collecting guide 30, and a flow path cover 182 configured to selectively cover the connecting flow path 181.

The flow rate regulator 180 may include a drive motor 183 configured to transmit a driving force to selectively open and close the connecting flow path 181 through the flow path cover 182.

A motor shaft 183*a* may be connected to the flow path cover 182 to drive a shutter portion 182*a* of the flow path cover 182 by the drive motor 183.

The flow path cover 182 may include the shutter portion 182*a* provided at a position corresponding to the connecting flow path 181 in the vertical direction and provided with a shutter, and a driver 182*b* connected to the motor shaft 183*a* to drive the shutter portion 182*a*.

The driver 182*b* may receive a driving force from the opening and closing unit 183 to drive the shutter portion 182*a* so as to open and close the shutter portion 182*a*.

The flow path cover 182 may be provided to be in contact with a lower end of the connecting flow path 181. Particularly, the shutter portion 182*a* of the flow path cover 182 may be provided to be in contact with the lower end of the connecting flow path 181.

In response to a closes state of the shutter portion 182*a*, the shutter portion 182*a* may cover the connecting flow path 181. Accordingly, the connecting flow path 181 may be closed from the outside by the shutter portion 182*a*.

In response to an open state of the shutter portion 182*a*, the connecting flow path 181 may be opened to the outside and thus outside air may flow into the connecting flow path 181 through the shutter portion 182*a*.

The drive motor 183 may transmit a driving force to allow the shutter portion 182*a* to be repeatedly opened and closed. As the shutter portion 182*a* is maintained in the open state and the closed state alternately, outside air may flow into the connecting flow path 181 at predetermined intervals.

The drive motor 183 may transmit a driving force to repeatedly open and close the shutter portion 182*a* at a predetermined speed. The optimal supply of outside air may be analyzed based on the shape of the inside of the dust collecting chamber 20, and accordingly, the speed of opening and closing of the shutter portion 182*a* may be variously adjusted to supply the outside air into the inside of the dust collecting chamber 20 according to the optimal supply of outside air.

Hereinafter a flow rate regulator 190 according to a sixth embodiment of the disclosure will be described. A configuration other than the flow rate regulator 190 according to the sixth embodiment of the disclosure is the same as the configuration according to the first embodiment of the disclosure, and thus a description thereof will be omitted.

Figure 19:
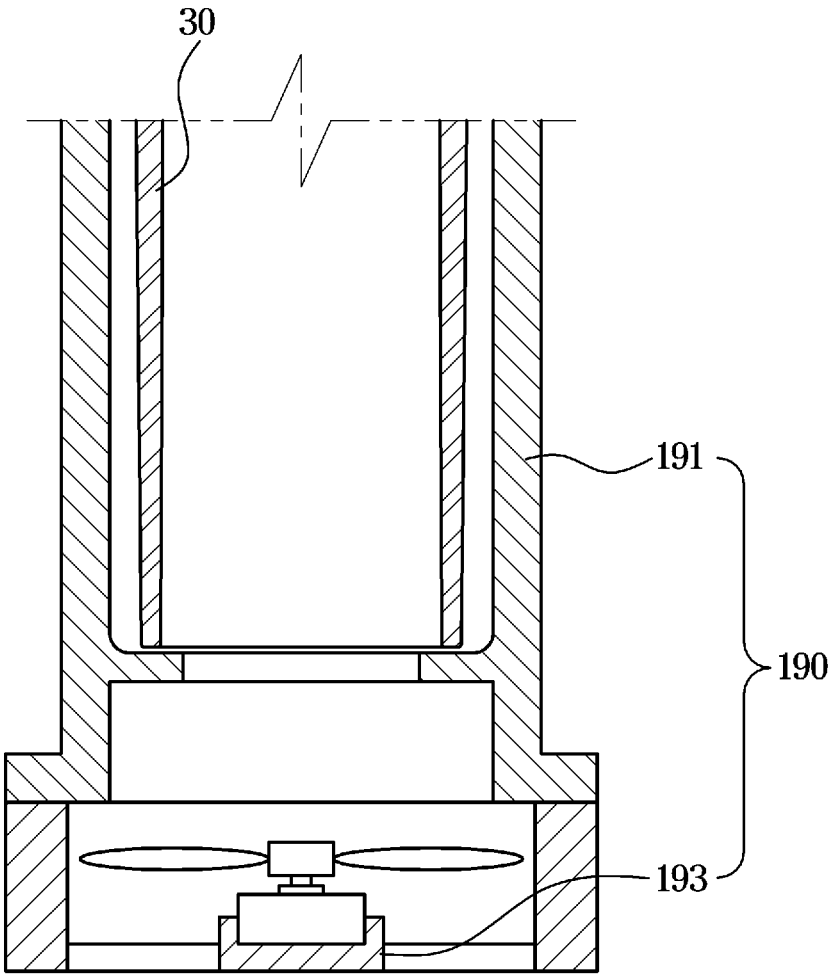
FIG. 19 is a schematic view of a flow rate regulator of a station according to a sixth embodiment of the disclosure.

FIG. 19 is a schematic view of a flow rate regulator of a station according to a sixth embodiment of the disclosure.

Referring to FIG. 19, the flow rate regulator 190 may include a connecting flow path 191 connected to the dust collecting guide 30 and a blower 193 configured to blow outside air to the connecting flow path 191.

The blower 193 may include a blowing fan. The blower 193 may be driven to blow outside air into the connecting flow path 191, and thus a large amount of outside air may flow along the connecting flow path 191 to the dust collecting guide 30 and the dust collecting chamber 20.

The blower 193 may be periodically turned on or turned off. Accordingly, the outside air may be blown to the connecting flow path 191 at a predetermined interval.

According to the blowing amount of the blower 193, the flow rate regulator 190 according to the sixth embodiment of the disclosure may generate a larger difference in the flow rate than the flow rate regulator 150 according to the first embodiment of the disclosure.

Therefore, it is possible to generate a large change in the flow rate of the inside air of the dust collecting chamber 20, thereby effectively removing the foreign substances in the dust collecting chamber 20.

Hereinafter a flow rate regulator 200 according to a seventh embodiment of the disclosure will be described. A configuration other than the flow rate regulator 200 according to the seventh embodiment of the disclosure is the same as the configuration according to the first embodiment of the disclosure, and thus a description thereof will be omitted.

Figure 20:
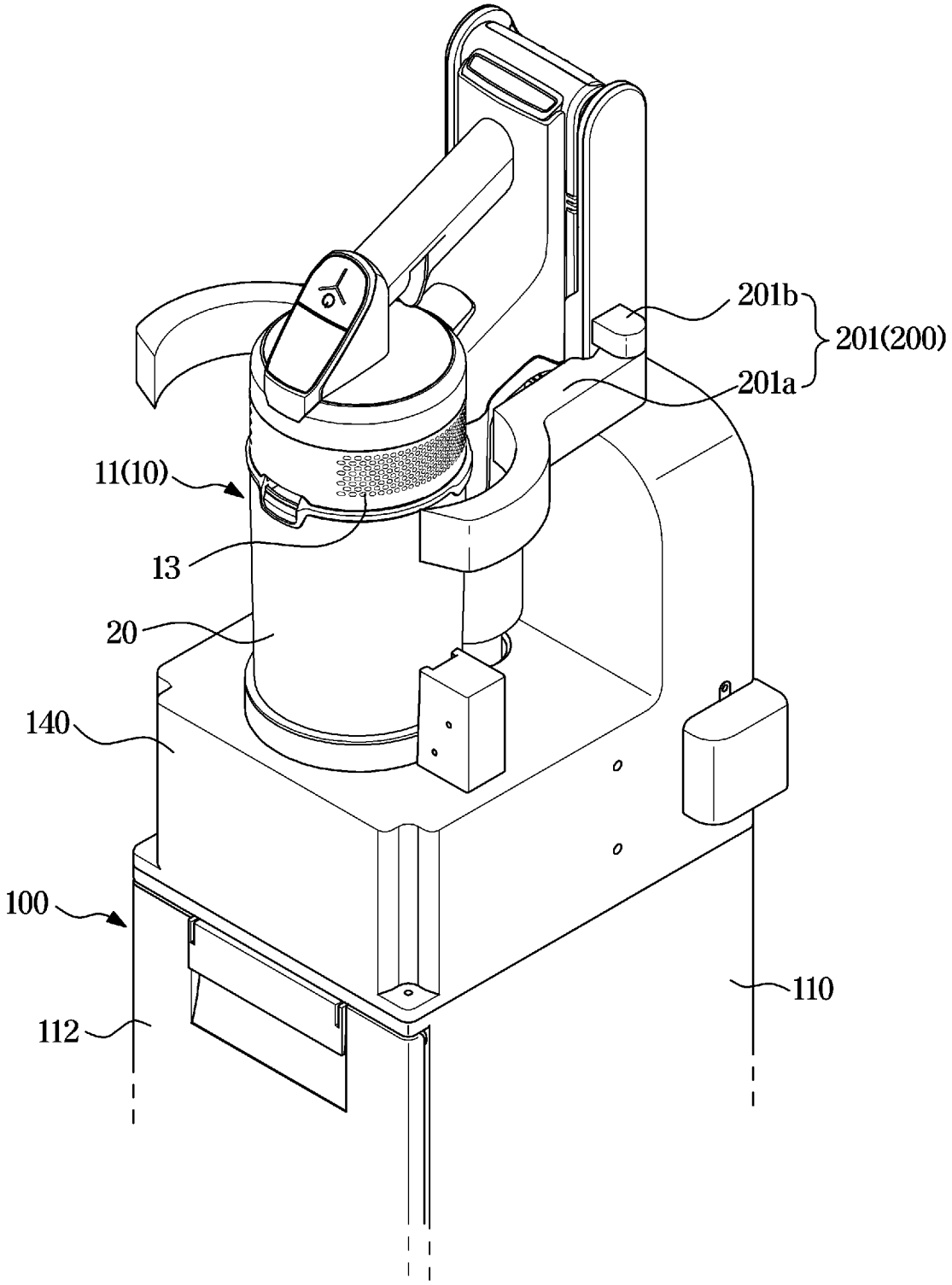
FIG. 20 is a view illustrating a state in which a flow rate regulator of a station opens a discharge port of a dust collecting chamber according to a seventh embodiment of the disclosure.
Figure 21:
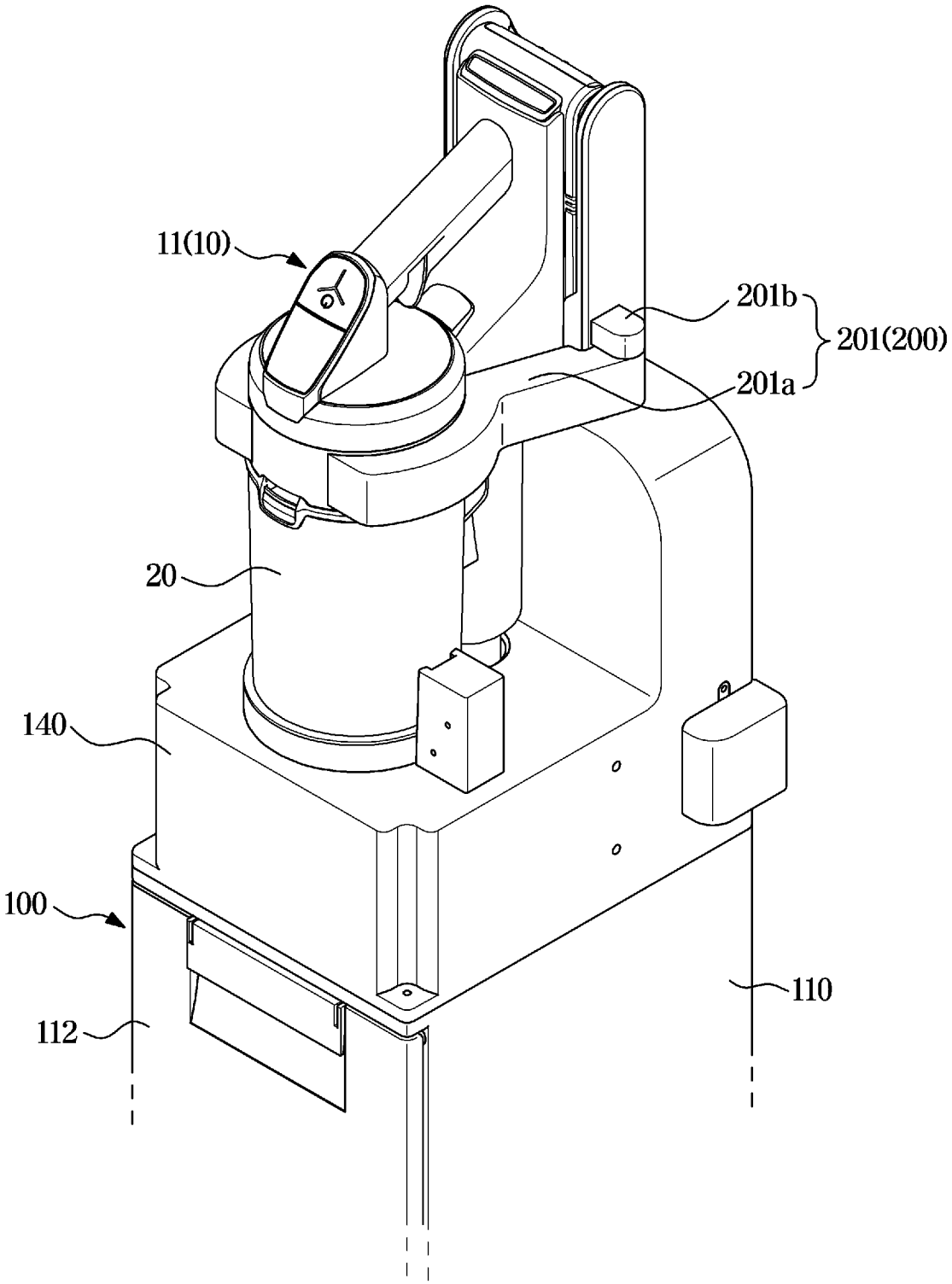
FIG. 21 is a view illustrating a state in which the flow rate regulator of the station closes the discharge port of the dust collecting chamber according to the seventh embodiment of the disclosure.

FIG. 20 is a view illustrating a state in which a flow rate regulator of a station opens a discharge port of a dust collecting chamber according to a seventh embodiment of the disclosure, and FIG. 21 is a view illustrating a state in which the flow rate regulator of the station closes the discharge port of the dust collecting chamber according to the seventh embodiment of the disclosure.

Referring to FIGS. 20 and 21, the flow rate regulator 200 may include a discharge port opening and closing unit 201 configured to open and close the discharge port 13 of the cleaner.

The discharge port opening and closing unit 201 may be configured to cover the discharge port 13 upon the docking of the cleaner 10 to the docking station 100.

The discharge port opening and closing unit 201 may include a discharge port cover 201*a* provided in a cut annular shape.

The discharge port cover 201*a* may close the discharge port 13 from the outside in such a way that the annular discharge port cover 201*a* surrounds the discharge port 13. It is appropriate that the discharge port cover 201*a* is formed with two pieces so as to cover the discharge port 13.

However, the shape of the discharge port cover 201*a* is not limited thereto, and the discharge port cover 201*a* may be provided in a shape corresponding to the shape in which the discharge port 13 is arranged in the cleaner 10, and the number of the discharge port cover 201*a* may vary according to the arrangement of the discharge port 13.

The discharge port opening and closing unit 201 may include a driver (not shown) configured to drive the discharge port cover 201*a*. The driver (not shown) may drive the discharge port cover 201*a* to allow the discharge port cover 201*a* to periodically open and close the discharge port 13 while the suction device 130 is driven.

Particularly, the discharge port cover 201*a* may include a hinge 201*b* provided to be rotatably coupled to the body housing 110. The driver (not shown) may rotate the discharge port cover 201*a* about the hinge 201*b*.

In response to the rotation of the discharge port cover 201*a* being toward the cleaner 10 about the hinge 201*b*, the discharge port cover 201*a* may cover the discharge port 13 and close the discharge port 13.

By the suction device 130, a negative pressure is generated inside the dust collecting chamber 20. Upon covering the discharge port 13 by the discharge port cover 201*a*, the discharge port cover 201*a* may receive a suction force through the discharge port 13, thereby more tightly covering the discharge port 13.

In response to the rotation of the discharge port cover 201*a* being toward the opposite side of the cleaner 10 about the hinge 201*b*, the discharge port cover 201*a* may open the discharge port 13.

The driver (not shown) may drive the discharge port cover 201*a* to alternately change the rotation direction of the discharge port cover 201*a* to allow the discharge port 13 to be periodically opened and closed.

The flow rate regulators 150, 170, 180 and 190 according to the first to sixth embodiments may transfer the outside air to the dust collecting chamber 20 through the dust collecting guide 30 connected to the dust collecting chamber 20, but the flow rate regulator 200 according to the seventh embodiment as illustrated in FIGS. 20 and 21 may regulate the amount of the outside air flowing into the inside of the dust collecting chamber 20 by opening or closing the discharge port 13 communicating with the dust collecting chamber 20.

Accordingly, the amount of air flowing into the dust collecting chamber 20 may be changed at a predetermined interval and thus the flow rate of the air inside the dust collecting chamber 20 may be changed.

Further, although not shown in the drawings, unlike the first to sixth embodiments of the disclosure, it is not required to dock the dust collecting guide 30 to the docking station 100.

The flow rate regulator 200 according to the seventh embodiment of the disclosure changes the air pressure of the inside of the dust collecting chamber 20 by opening and closing the discharge port 13 without supplying the outside air to the dust collecting chamber 20 through the dust collecting guide 30 as described above. Therefore, it is not required that the dust collecting guide 30 is docked to the docking station 100 to be connected to the flow rate regulator.

Therefore, a user may dock only the dust collecting chamber 20 to the docking station 100 without separating an extension tube (not shown) or the suction unit (not shown) of the cleaner 10 from the dust collecting guide 30.

Hereinafter a cleaning apparatus 1' according to an eighth embodiment of the disclosure will be described. A configuration other than the cleaning apparatus 1' according to the eighth embodiment of the disclosure is the same as the configuration according to the first embodiment of the disclosure, and thus a description thereof will be omitted.

Figure 22:
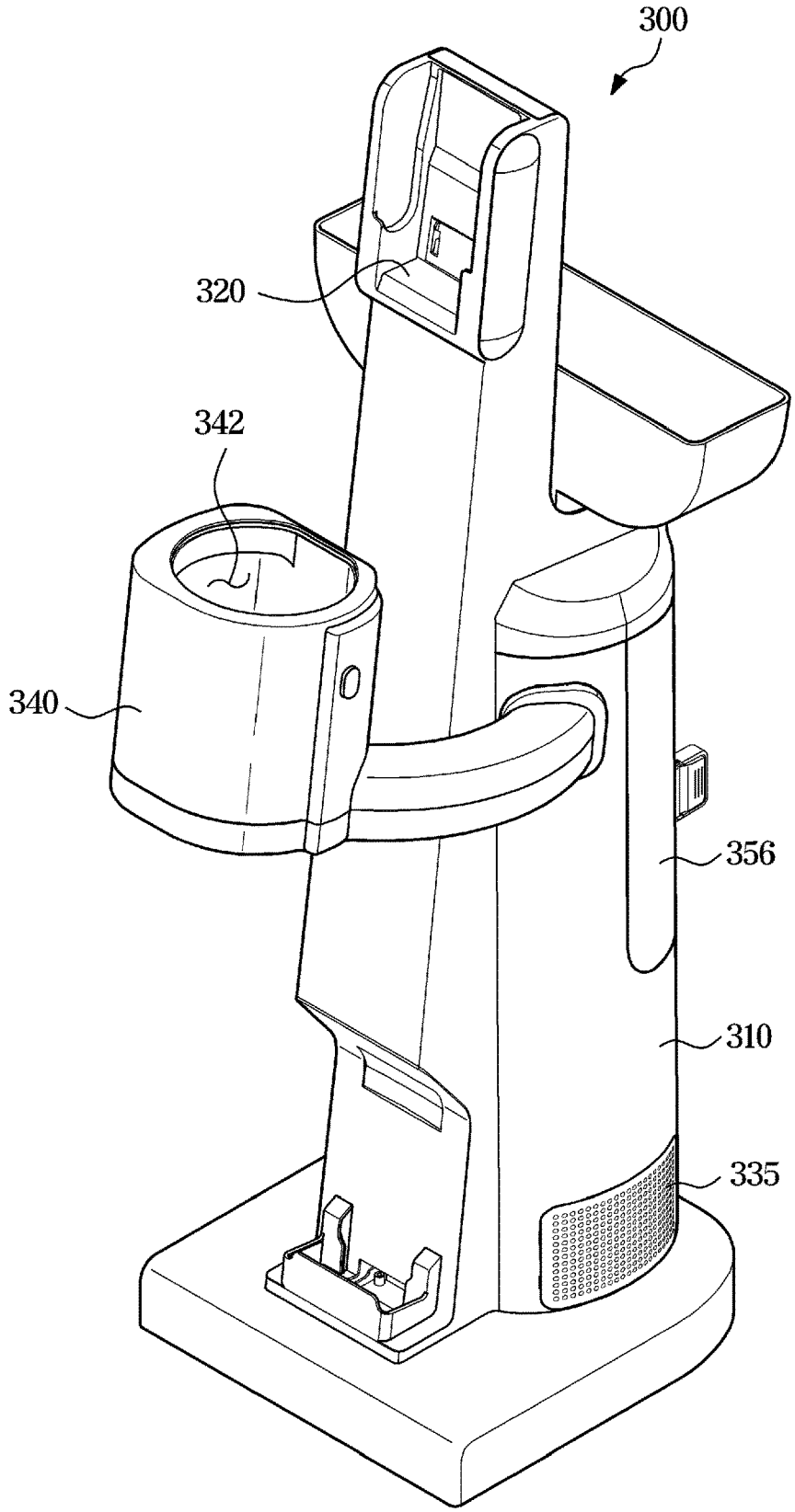
FIG. 22 is a perspective view of a station according to an eighth embodiment of the disclosure.
Figure 23:
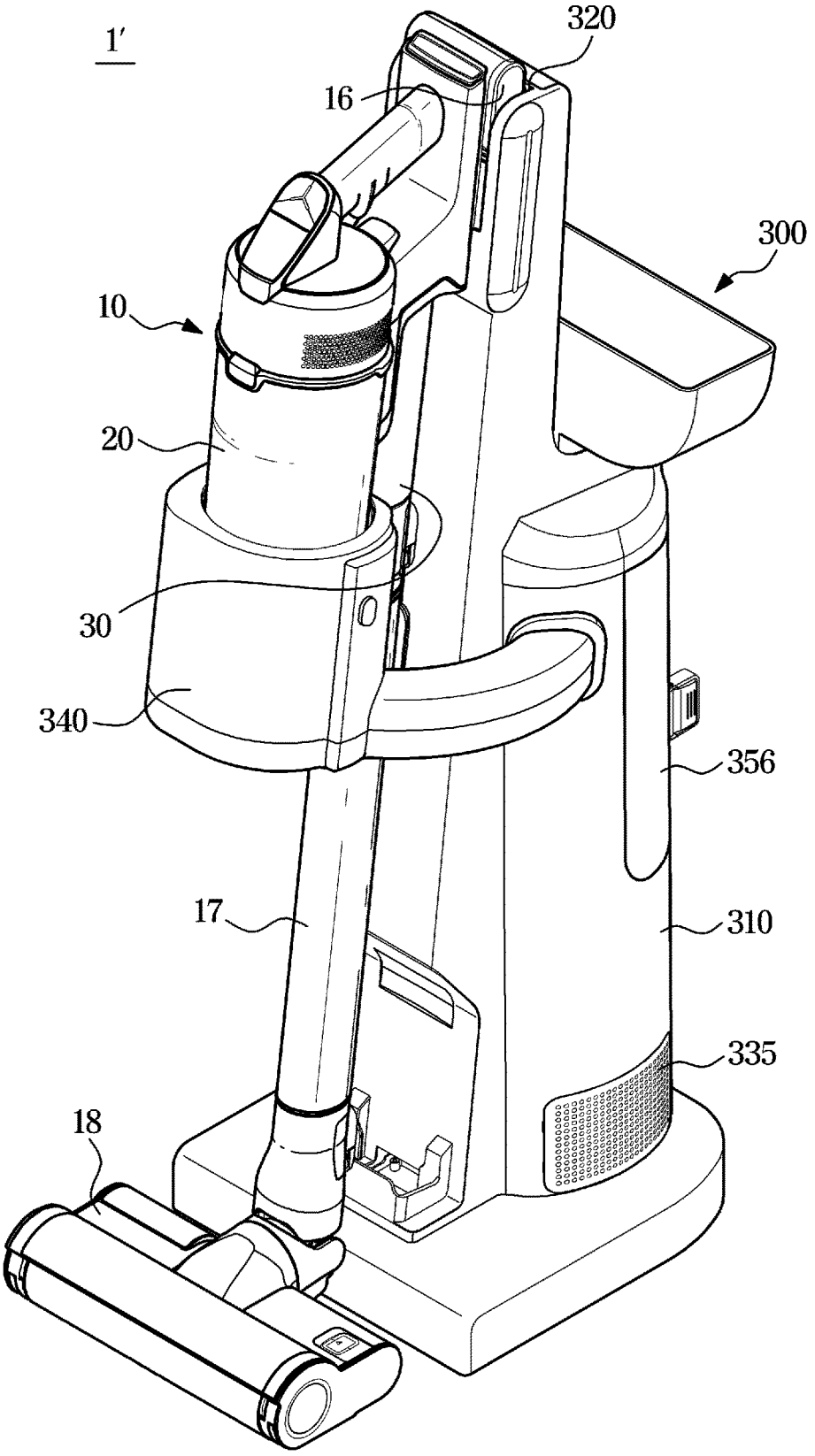
FIG. 23 is a perspective view of a cleaning apparatus according to the eighth embodiment of the disclosure.
Figure 24:
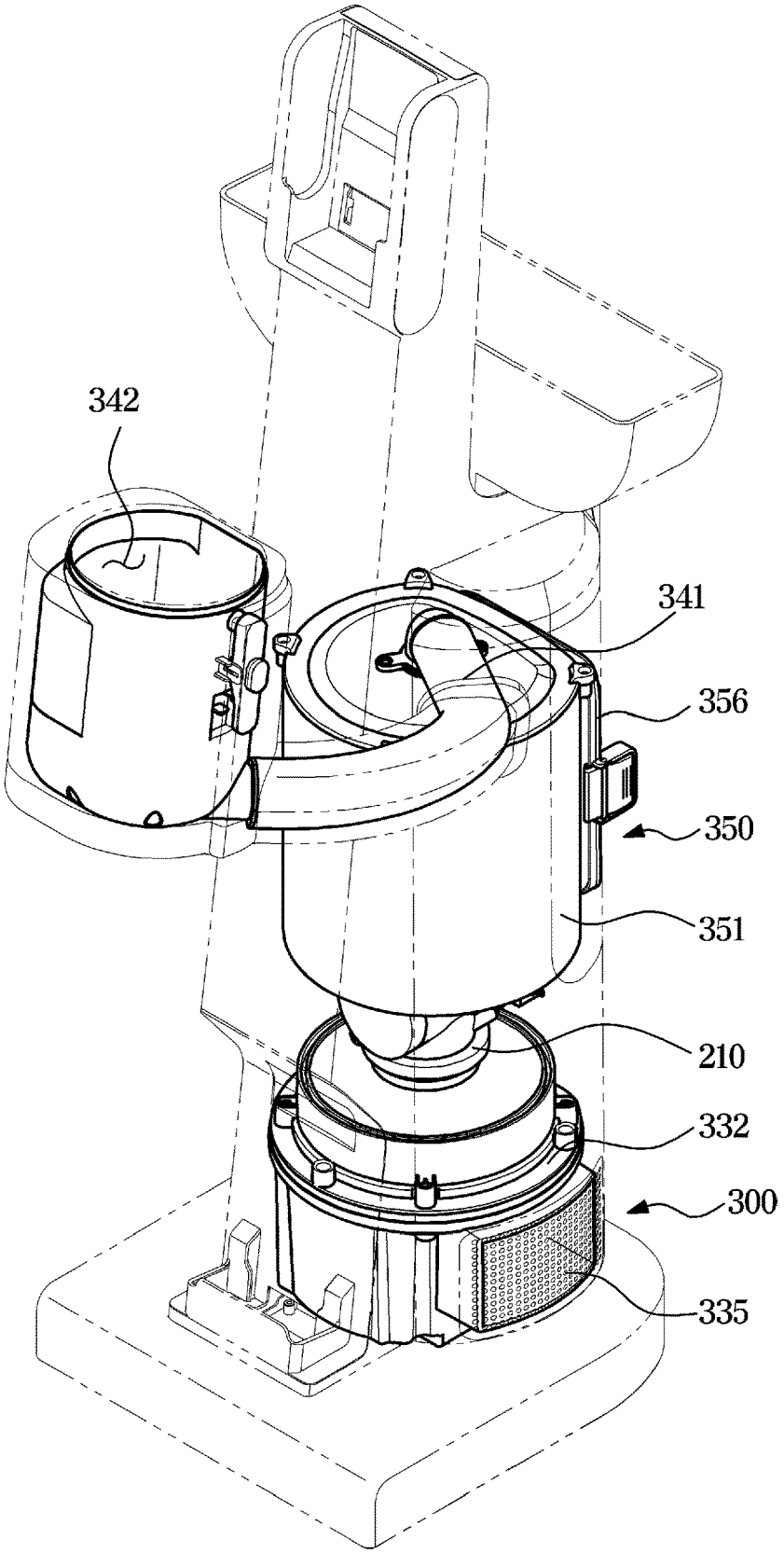
FIG. 24 is a view illustrating some components of the station according to the eighth embodiment of the disclosure.
Figure 25:
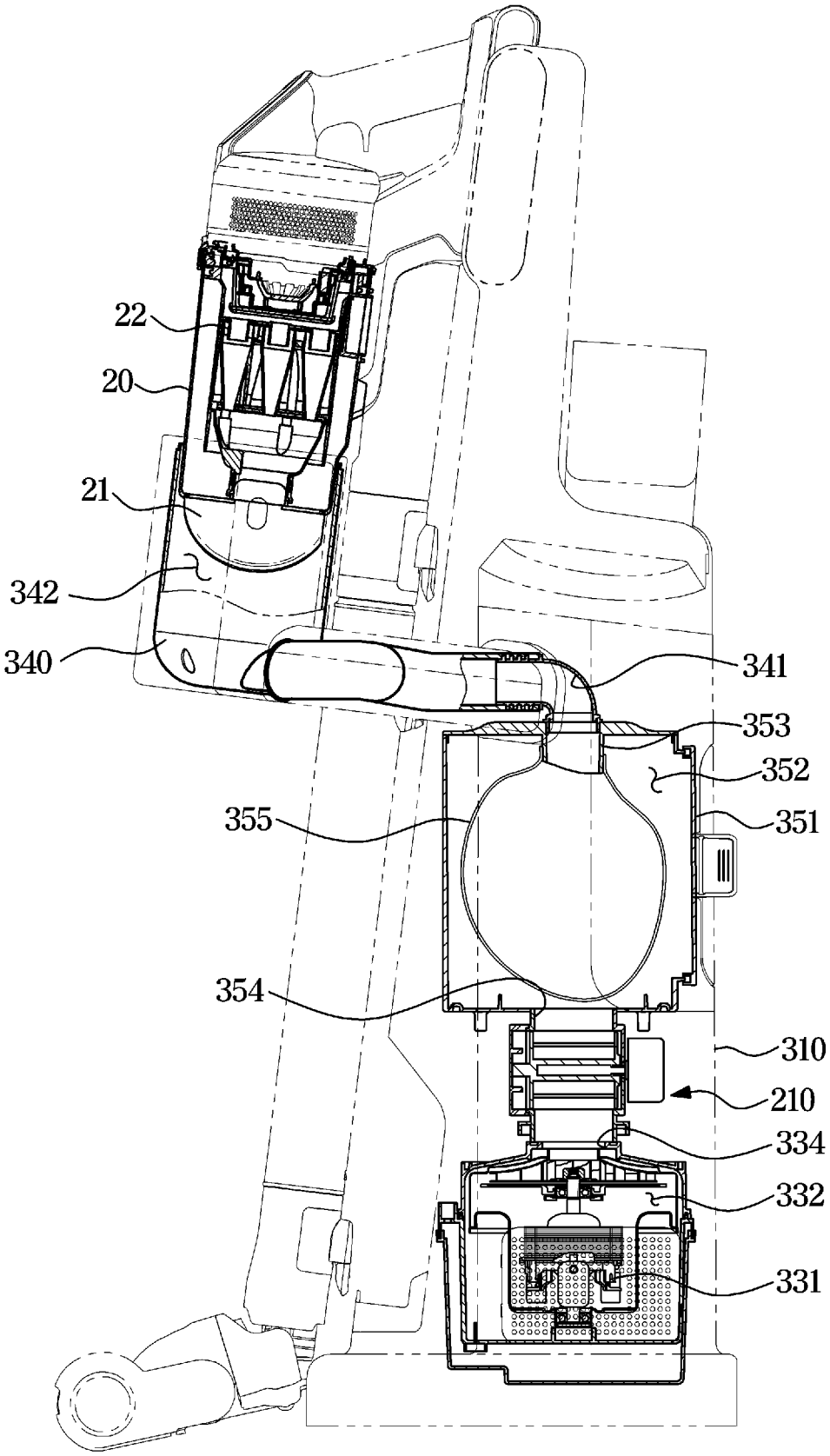
FIG. 25 is a side sectional view of some components of the cleaning apparatus according to the eighth embodiment of the disclosure.

FIG. 22 is a perspective view of a station according to an eighth embodiment of the disclosure, FIG. 23 is a perspective view of a cleaning apparatus according to the eighth embodiment of the disclosure, FIG. 24 is a view illustrating some components of the station according to the eighth embodiment of the disclosure, and FIG. 25 is a side sectional view of some components of the cleaning apparatus according to the eighth embodiment of the disclosure.

As for the cleaning apparatus 1 according to the first to sixth embodiments, in order to increase the efficiency of automatic discharge at the automatic discharge operation of the docking station 100, the flow rate regulators 150, 170, 180 and 190 may change the air pressure of the inside of the dust collecting chamber 20 by using a method of supplying the outside air to the dust collecting chamber 20 through the dust collecting guide 30 connected to the dust collecting chamber 20.

Accordingly, the dust collecting guide 30 communicating with the dust collecting chamber 20 is also docked to the docking station 100 together with the dust collecting chamber 20, and the docking station 100 may be configured to allow the outside air to selectively flow into the dust collecting guide 30 by the flow rate regulators 150, 170, 180 and 190 upon the docking of the dust collecting guide 30 to the docking station 100.

According to the first to sixth embodiments of the disclosure, in order to automatically discharge the foreign substances collected in the dust collecting chamber 20 by docking the cleaner 10 to the docking station 100, a user may separate the extension tube or the suction unit, which may be coupled to the dust collecting guide 30, and dock the dust collecting guide 30 to the docking station 100.

At this time, it may be inconvenient for a user to separate the extension tube or the suction unit, which may be coupled to the dust collecting guide 30, and it may lead to reduction in usability. However, the cleaning apparatus 1' according to the eighth embodiment of the disclosure may dock the cleaner 10 to the docking station 100 and allow the collected foreign substances of the dust collecting chamber 20 to be automatically discharged even when an extension tube 17 or a suction unit 18 is coupled to the dust collection guide 30 of the cleaner 10.

That is, as for the cleaning apparatus 1 according to the first embodiment, the automatic discharge of the docking station 100 may be effectively performed only when both of the dust collecting chamber 20 and the dust collecting guide 30 of the cleaner 10 are docked to the docking station 100. However, as for the cleaning apparatus 1' according to the eighth embodiment, the automatic discharge of a docking station 300 may be effectively performed as long as the dust collecting chamber 20 of the cleaner 10 is docked to the docking station 300.

Accordingly, referring to FIGS. 22 to 25, the docking station 300 may include a docking housing 340 to which the dust collecting chamber 20 is docked, without a component to which the dust collecting guide 30 is docked. Therefore, in response to docking of the cleaner 10 to the docking station 300, the extension tube 17 and the suction unit 18 may be mounted on the docking station 300 in a state of being coupled to the dust collecting guide 30.

The extension tube 17 of the cleaner 10 may be provided to have a long axis extending in one direction.

The dust collecting chamber 20 may include a cylindrical shape including the long axis extending in one direction. Although it will be described later, the dust collecting chamber 20 may be configured to separate foreign substances introduced into the dust collecting chamber 20 through centrifugation. Accordingly, the dust collecting chamber 20 may be provided in an approximately cylindrical shape.

The dust collecting chamber 20 and the extension tube 17 may be coupled to the cleaner 10 in such a way that the long axis of the cylindrical shape of the dust collecting chamber 20 and the long axis of the extension tube 17 extend in approximately corresponding directions.

The docking station 300 may include a body housing 310 and the docking housing 340 described above. A charger 320 configured to charge a battery 16 of the cleaner 10 upon the docking of the cleaner 10 to the docking station 300 may be provided above the body housing 310.

By including a suction device 330, the docking station 300 may discharge dust collected in the dust collecting chamber 20 from the dust collecting chamber 20. The suction device 330 may be arranged inside the body housing 310.

The body housing 310 may be provided to have a long axis extending in one direction. It is appropriate that the long axis of the body housing 310 extends in the vertical direction.

The docking station 300 may include a collector 350 in which foreign substances discharged from the dust collecting chamber 20 are collected. The collector 350 may be arranged in the body housing 310. The collector 350 may be arranged above the suction device 330.

The docking station 300 may include an intake flow path 341 configured to connect the docking housing 340 to the collector 350 and configured to allow foreign substances, which are discharged from the dust collecting chamber 20, to be suctioned to the collector 350 through the docking housing 340.

The docking housing 340 may include a seating portion 342 configured to communicate with the intake flow path 341 and on which the dust collecting chamber 20 is mounted.

The seating portion 342 may be provided to be opened toward an upper side with respect to the long axis of the body housing 310.

The seating portion 342 may correspond to a space opened to the outside from the docking housing 340 and the seating portion 342 may be provided to allow the dust collecting chamber 20 to be inserted thereto in the vertical direction and to be seated thereon.

Upon seating the dust collecting chamber 20 on the seating portion 342, docking of the cleaner 10 to the docking station 300 may be completed.

The dust collecting chamber 20 may be docked to the seating portion 342 in a direction in which the long axis of the body housing 310 extends.

The dust collecting chamber 20 may be docked to the seating portion 342 in a direction in which the long axis of the cylindrical shape of the dust collecting chamber 20 extends.

Accordingly, upon the docking of the dust collecting chamber 20 to the docking station 300, the long axis of the body housing 310 and the long axis of the extension tube 17 may be provided so as to face substantially in a corresponding direction. This is because, as described above, the dust collecting chamber 20 and the extension tube 17 may be coupled to the cleaner 10 in such a way that the long axis of the cylindrical shape of the dust collecting chamber 20 and the long axis of the extension tube 17 extend in approximately corresponding directions.

Although not shown in the drawings, the switch unit, and the pressing protrusion described in the first embodiment of the disclosure may be arranged inside the seating portion 342.

Therefore, upon seating the dust collecting chamber 20 on the seating portion 342, the dust collecting chamber door 21 may be opened, and the controller (not shown) may confirm a state in which the dust collecting chamber 20 is docked to the docking station 300, through the switch unit.

A multi-cyclone (e.g., a multi-cyclone 52) may be arranged inside the dust collecting chamber 20. The dust collecting chamber 20 may be provided to allow the foreign substances to be collected in the lower side of the multi-cyclone. Accordingly, upon opening of the dust collecting chamber door 21, the foreign substance collected in the dust collecting chamber 20 may be easily discharged to the seating portion 342.

The intake flow path 341 may be connected to the collector 350 from the docking housing 340 by penetrating through the body housing 310. However, the disclosure is not limited thereto, and the docking housing 340 and the body housing 310 may be integrally formed with each other. In this case, the intake flow path 341 may be arranged in the body housing 310 and thus the inside of the seating portion 342 and the collector 350 may communicate with each other.

The intake flow path 341 may transfer the air flow generated by the suction device 330 to the dust collecting chamber 20. That is, the intake air flow generated by the suction device 33 is transferred into the dust collecting chamber 20 along the intake flow path 341 and the seating portion 342 through the collector 350. The foreign substance in the dust collecting chamber 20 may be discharged from the dust collecting chamber 20 to the seating portion 342 according to the air flow by the intake air flow, and then collected in the collector 350 through the intake flow path 341.

The collector 350 may include a collector housing 351. The collector housing 351 may form a first inner space 352 therein. The first inner space 352 may be opened to the outside by a first cover (not shown).

The first cover (not shown) may open and close the collector housing 351 to allow the first inner space 352 to be opened to the outside by passing through the body housing 310.

The collector 350 may include a first connector 353 arranged at an upper side of the collector 350 and connected to the first inner space 352 and the intake flow path 341.

The collector 350 may include a second connector 354 connected to the suction device 330 through the flow rate regulator 210, which is described later, and arranged below the collector 350.

A collection bag 355 may be arranged in the first inner space 352 to collect foreign substances introduced through the first connector 353 along the intake flow path 341.

The collection bag 355 may be formed of a material through which air is transmitted and foreign substances are not, and thus the collection bag 355 may collect foreign substances introduced into the collector 350 from the dust collecting chamber 20.

An upper end of the first connector 353 may be connected to the intake flow path 341 and a lower end of the first connector 353 may be connected to the collection bag 355. The collection bag 355 may be removably coupled to the lower end of the first connector 353.

The intake air flow generated by the suction device 330 may flow into the first inner space 352 through the first connector 353 and the collection bag 355 and then may be discharged to the outside of the collector 350 through the second connector 354.

The suction device 330 may include a suction fan 331 and a suction device housing 332 forming a second inner space 333 in which the suction fan 331 is arranged.

The second inner space 333 may be provided to be opened and closed by a second cover 335 arranged in the body housing 310. The second cover 335 may be configured to discharge air suctioned by the suction fan 331.

A third connector 334 configured to supply the intake air flow generated by the suction fan 331 to the dust collecting chamber 20 may be provided on an upper side of the suction device 330.

The intake air flow generated by the suction fan 331 may be supplied to the dust collecting chamber 20 from the second inner space 333 by moving along the collector 350 and the intake flow path 341 through the third connector 334.

The docking station 300 may include a flow rate regulator 210 configured to selectively change an amount of intake air flow supplied to the dust collecting chamber 20.

The flow rate regulator 210 may be arranged inside the body housing 310. The flow rate regulator 210 may be arranged between the collector 350 and the suction device 330. Particularly, the flow rate regulator 210 may be connected to the second connector 354 and the third connector 334.

The flow rate regulators 150, 170, 180, 190, and 200 according to the first to seventh embodiments may change the air pressure inside the dust collecting chamber 20 by additionally supplying the outside air or stopping supplying the outside air, while maintaining the intake air flow supplied from the suction device at a predetermined state.

However, the flow rate regulator 210 according to the eighth embodiment may change the air pressure inside the dust collecting chamber 20 by changing the amount of intake air flow supplied to the dust collecting chamber 20.

That is, the flow rate regulator 210 may selectively open and close the connecting flow path 212 communicating with the suction device 330 and the dust collecting chamber 20, which will be described later, so as to supply or block the intake air flow generated by the suction device 330, thereby changing the air pressure inside the dust collecting chamber 20.

Accordingly, the loss of the air flow amount supplied to the dust collecting chamber 20 is reduced in comparison with the flow rate regulator 150, 170, 180, 190, and 200 according to the first to seventh embodiments, and thus automatic discharge may be performed more efficiently.

That is, the flow rate regulators 150, 170, 180, 190, and 200 of the first to seventh embodiments may be configured to periodically supply the outside air to the dust collecting chamber 20 and thus the amount of intake air flow may be lost as much as the outside air being supplied to the dust collecting chamber 20.

However, the flow rate regulator 210 of the eighth embodiment may not additionally supply the outside air to the dust collecting chamber 20, and thus there is no intake air flow lost inside the dust collecting chamber 20 caused by the supply of the outside air. Therefore, the flow rate regulator 210 of the eighth embodiment may change the air pressure inside the dust collecting chamber 20 more efficiently than the flow rate regulators 150, 170, 180, 190, and 200 of the first to seventh embodiments.

As mentioned above, the flow rate regulator 210 may be arranged between the collector 350 and the suction device 330. However, the disclosure is not limited thereto, and the flow rate regulator 210 may be arranged between the collector 350 and the intake flow path 341.

However, in response to the arrangement of the flow rate regulator 210 being placed between the collector 350 and the intake flow path 341, the intake air flow generated by the suction device 330 may flow into the flow rate regulator 210 through the collector 350 and thus some of the intake air flow supplied to the dust collecting chamber 20 may be lost.

In addition, in response to the arrangement the flow rate regulator 210 being placed between the collector 350 and the intake flow path 341, air containing foreign substance discharged from the dust collecting chamber 20 may pass through the flow rate regulator 210, and thus it may cause the difficulty in the sanitation.

Therefore, it is appropriate that the flow rate regulator 210 is arranged between the suction device 330 and the collector 350.

That is, the intake air flow generated by the suction device 330 may be supplied to the dust collecting chamber 20 by passing through the flow rate regulator 210, the collector 350, the intake flow path 341, and the seating portion 342 sequentially.

Together with the foreign substance collected in the dust collecting chamber 20, the intake air flow supplied to the dust collecting chamber 20 may move by sequentially passing through the seating portion 342, the intake flow path 341 and the collector 350.

In the collector 350, the foreign substance discharged from the dust collecting chamber 20 may be collected, and the air separated from the foreign substance may be discharged to the outside of the body housing 310 through the flow rate regulator 210 and the suction device 330. The flow rate regulator 210 will be described later in detail.

Hereinafter a collector according to a ninth embodiment of the disclosure will be described. A configuration other than the collector 350 according to the ninth embodiment of the disclosure is the same as the configuration according to the eighth embodiment of the disclosure, and thus a description thereof will be omitted.

The collection bag 355 may be arranged in the collector 350 according to the eighth embodiment, and thus the foreign substances discharged from the dust collecting chamber 20 may be collected in the collection bag 355.

When the collection bag 355 is fully filled with the foreign substance, a user may separate the collection bag 355 from the first connector 353, discharge the foreign substance collected in the collection bag 355, and then couple the collection bag 355 to the first connector 353.

The disclosure is not limited thereto, and the collector 350 according to the ninth embodiment may include an additional dust collecting chamber 356 arranged in the first inner space 352. The inner space of the additional dust collecting chamber 356 may be provided to be larger than the inner space of the dust collecting chamber 20.

The additional dust collecting chamber 356 may include a multi-cyclone 357. Accordingly, air containing the foreign substance introduced into the collector 350 through the first connector 353 may flow into the additional dust collecting chamber 356 and the foreign substance may be removed through the multi-cyclone 357 and then the air, from which the foreign substance is removed, may flow into the flow rate regulator 210 through the second connector 354.

An upper side of the additional dust collecting chamber 356 may communicate with the first connector 353 and a lower side of the additional dust collecting chamber 356 may communicate with the second connector 354. The additional dust collecting chamber 356 may be removably coupled to the first connector 353 and the second connector 354.

Therefore, the air introduced through the first connector 353 may be discharged to the second connector 354 by passing through the multi-cyclone 357. While the air passes through the multi-cyclone 357, the foreign substances discharged from the dust collecting chamber 20 may be collected in the additional dust collecting chamber 356.

Hereinafter the flow rate regulator 210 according to the eighth embodiment of the disclosure will be described in detail.

Figure 26:
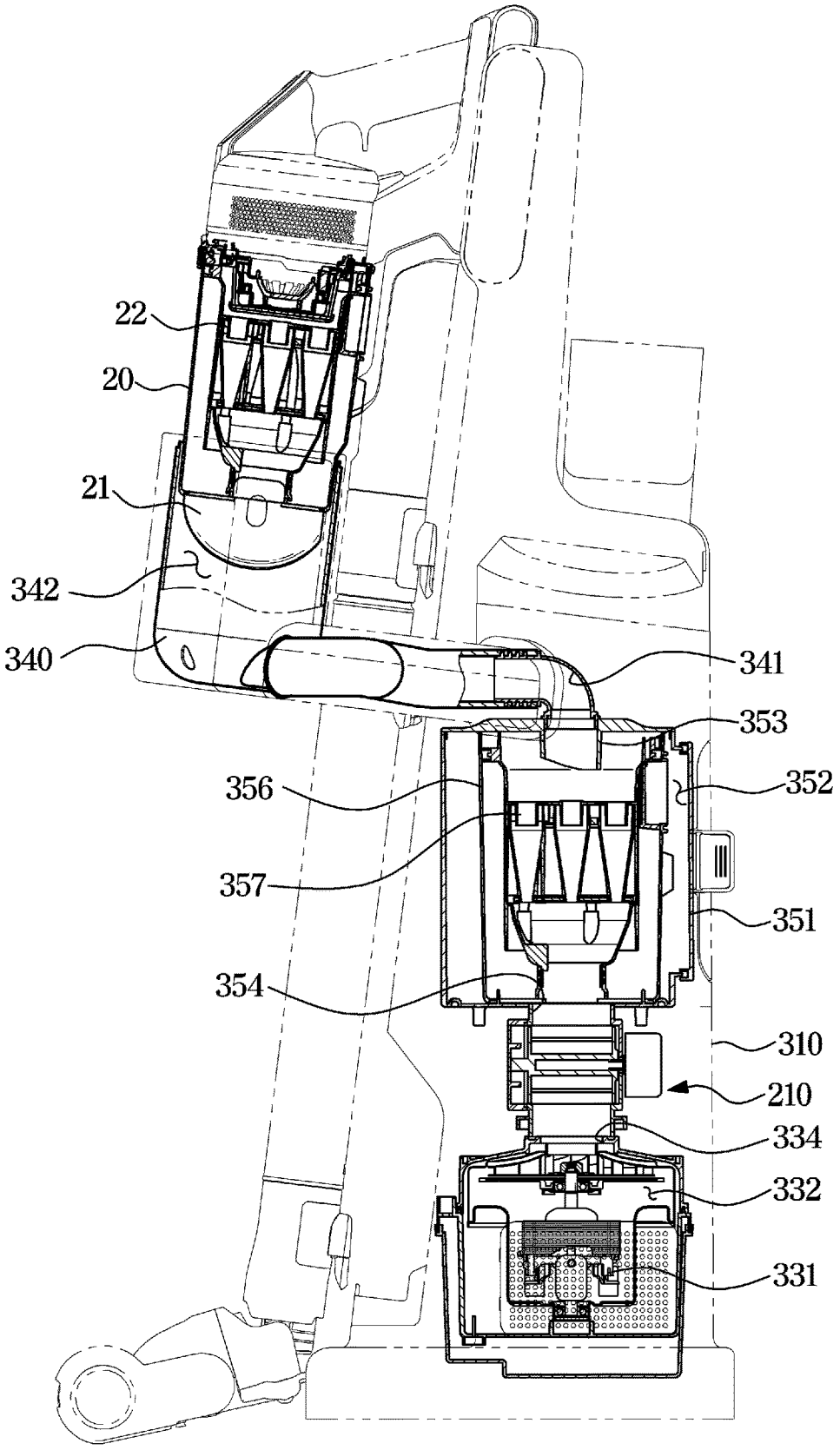
FIG. 26 is a side sectional view of some components of a cleaning apparatus according to a ninth embodiment of the disclosure.

FIG. 26 is a side sectional view of some components of a cleaning apparatus according to an embodiment of the disclosure.

Figure 27:
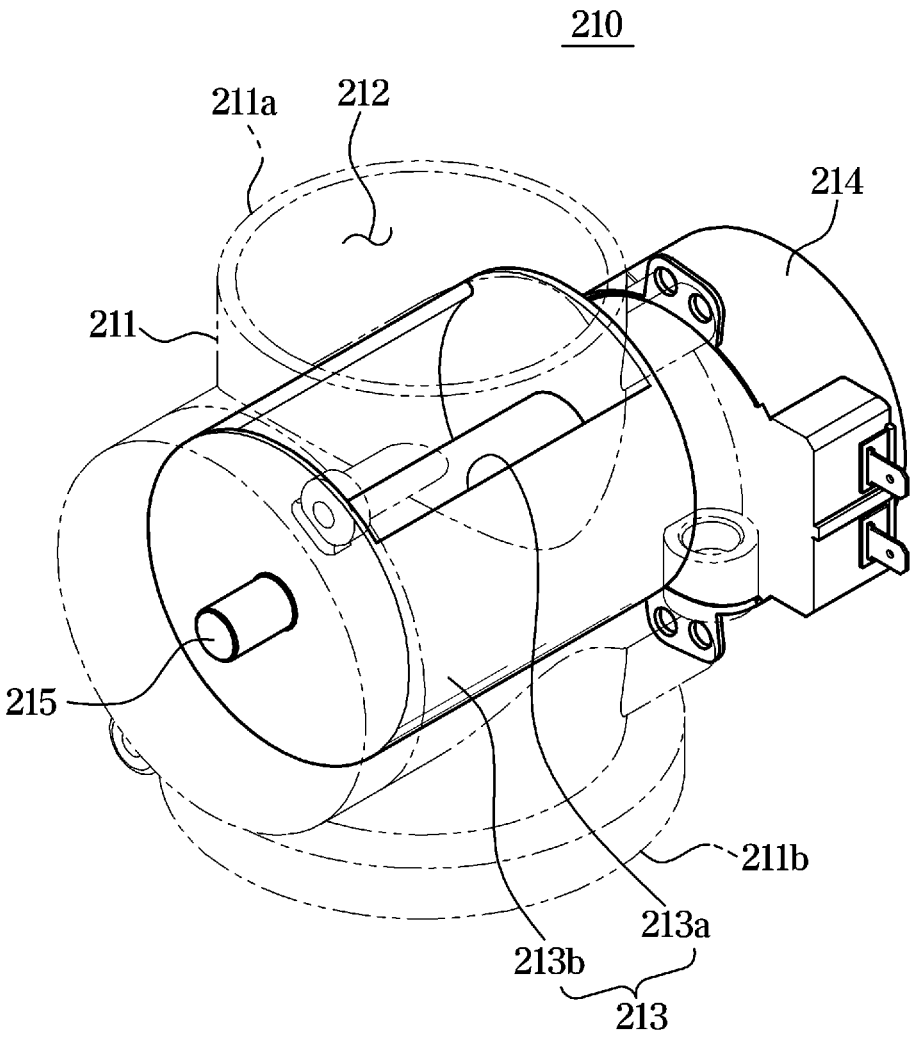
FIG. 27 is a perspective view of a flow rate regulator of the station according to the eighth embodiment of the disclosure.
Figure 28:
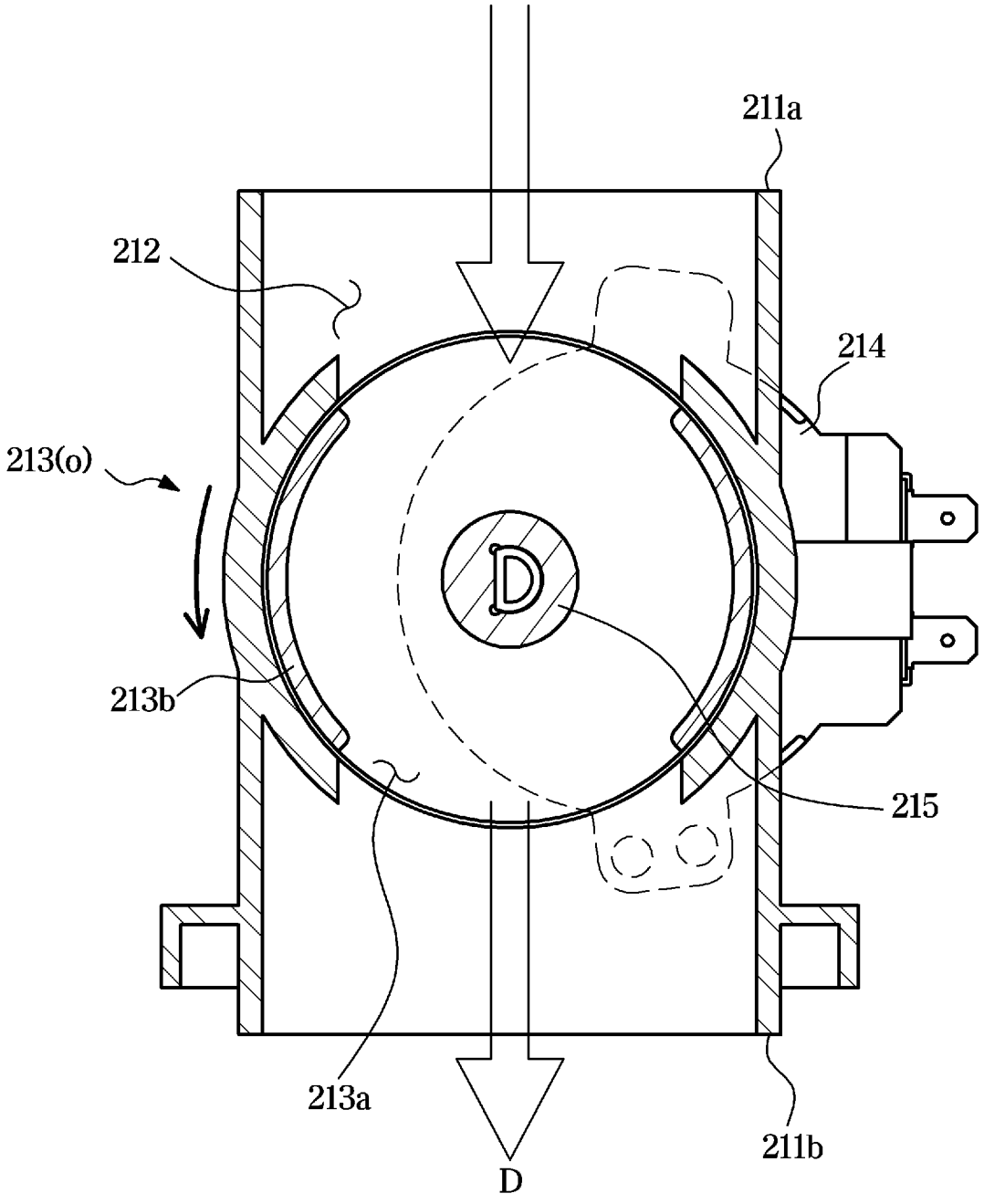
FIG. 28 is a view illustrating a state in which the flow rate regulator of the station opens a connecting flow path according to the eighth embodiment of the disclosure.
Figure 29:
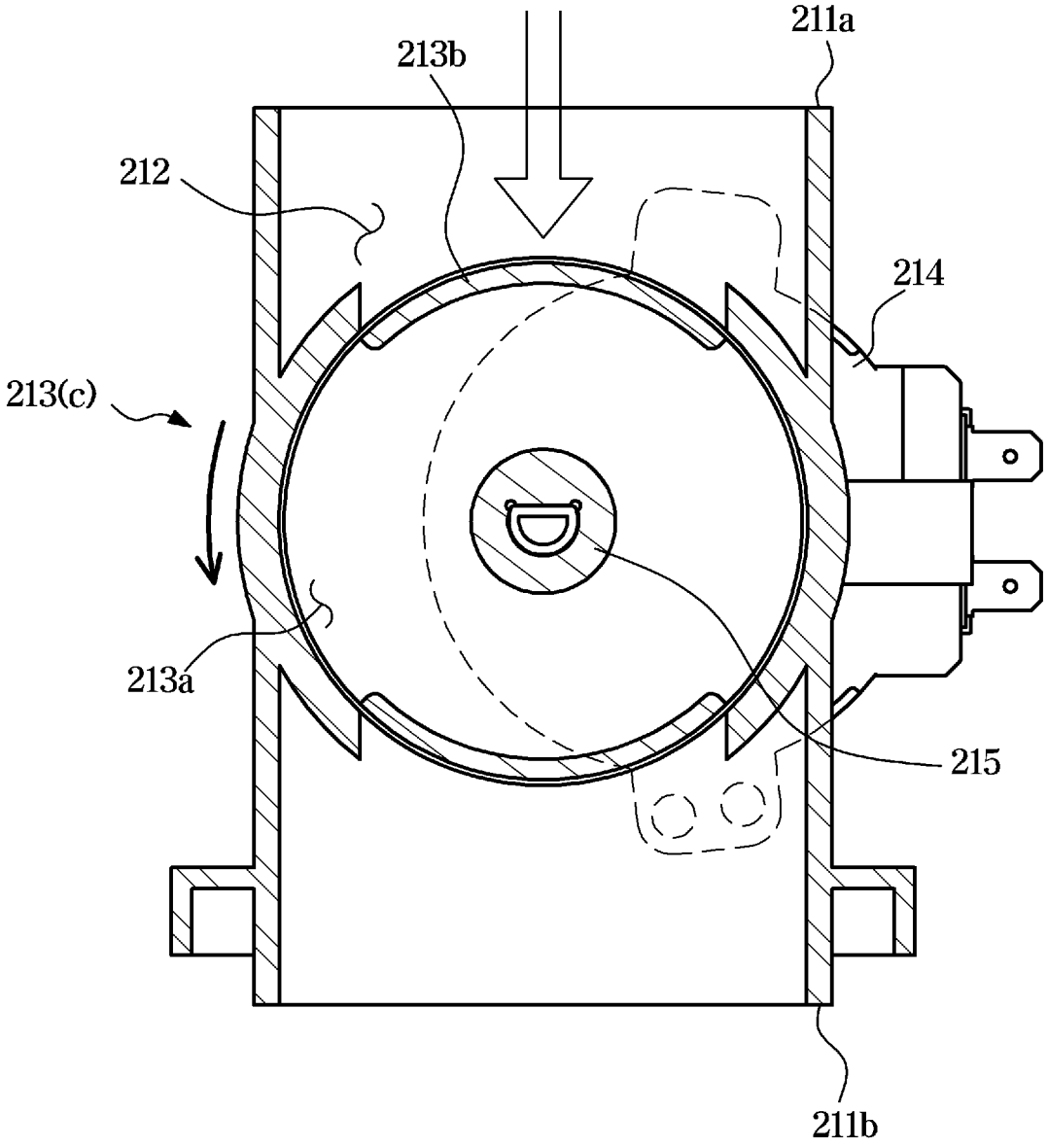
FIG. 29 is a view illustrating a state in which the flow rate regulator of the station closes the connecting flow path according to the eighth embodiment of the disclosure.

FIG. 27 is a perspective view of a flow rate regulator of the station according to the eighth embodiment of the disclosure, FIG. 28 is a view illustrating a state in which the flow rate regulator of the station opens a connecting flow path according to the eighth embodiment of the disclosure, and FIG. 29 is a view illustrating a state in which the flow rate regulator of the station closes the connecting flow path according to the eighth embodiment of the disclosure.

Referring to FIG. 27, the flow rate regulator 210 may include a flow path housing 211 forming a connecting flow path 212 connecting the suction device 330 to the collector 350.

Particularly, the connecting flow path 212 may be configured to connect the second connector 354 to the third connector 334. Accordingly, the suction device 330 and the collector 350 may communicate with each other through the connecting flow path 212, and the intake air flow generated by the suction device 330 may move to the collector 350 through the connecting flow path 212.

An upper end 211*a* of the flow path housing 211 may be connected to the second connector 354 and a lower end 211*b* of the flow path housing 211 may be connected to the third connector 334.

The connecting flow path 151 disclosed in the first to sixth embodiments may be connected to the dust collecting guide 30 and configured to flow the outside air to the dust collecting guide 30, but the connecting flow path 212 of the eighth embodiment may connect the suction device 330 to the collector 350.

The flow rate regulator 210 may include a flow path valve 213 arranged on the connecting flow path 212 and configured to open and close the connecting flow path 212 to regulate the intake air flow in the connecting flow path 212.

The flow rate regulator 210 may include a drive motor 214 configured to drive the flow path valve 213.

A rotary shaft 215 may be arranged on the rotation axis of the drive motor 214. The flow path valve 213 may be coupled to the rotary shaft 215 to be rotated in one direction or the opposite direction.

The flow path valve 213 may be configured to open or close the connecting flow path 212 while rotating on the connecting flow path 212.

Particularly, the flow path valve 213 may have a cylindrical shape including the cutout portion 213*a* and the body 213*b*. A central axis of the cylindrical shape may be provided in a direction corresponding to the extending direction of the rotary shaft 215.

The cutout portion 213*a* may be provided to be cut at a predetermined distance in the circumferential direction of the cylindrical shape and to extend in the extending direction of the cylindrical shape.

The cutout portion 213*a* may be provided in a pair symmetrical about a central axis of a cylindrical shape.

As mentioned above, the flow path valve 213 may be configured to rotate on the connecting flow path 212. The flow path valve 213 may be rotated to one direction due to the drive of the drive motor 214. In the rotation of the flow path valve 213 in one direction, when the flow path valve 213 is positioned to allow a direction D, in which the intake air flow moves, to face the pair of cutout portion 213*a* on the connecting flow path 121, the intake air flow may move inside the connecting flow path 212 by passing through the cutout portion 213*a*.

That is, referring to FIG. 28, it is assumed that a position of the flow path valve 213, in which the pair of cutout portions 213*a* faces the flow direction D of the intake air flow during the rotation of the flow path valve 213, is an open position 213 (o). In response to the open position 213 (*o*) of the flow path valve 213 during the rotation, the intake air flow may be supplied to the dust collecting chamber 20.

In the rotation of the flow path valve 213 in one direction, when the flow path valve 213 is positioned to allow the direction D, in which the intake air flow moves, to face the body 213*b* on the connecting flow path 121, the movement of the intake air flow may be blocked by the body 213*b*. The intake air flow may not move from the suction device 330 to the collector 350 by being blocked by the body 213*b* and thus the intake air flow may be not supplied to the dust collecting chamber 20.

That is, referring to FIG. 29, it is assumed that a position of the flow path valve 213, in which the body 213*b* faces the flow direction D of the intake air flow during the rotation of the flow path valve 213, is a closed position 213 (*c*). In response to the closed position 213 (*c*) of the flow path valve 213 during the rotation, the intake air flow may not be supplied to the dust collecting chamber 20.

The cutout portion 213*a* and the body 213*b* may be sequentially arranged in the direction D in which the intake air flow flows as the drive motor 214 is rotated in one direction. Accordingly, the flow path valve 213 may sequentially open and close the connecting flow path 212.

According to the opening and closing of the flow path valve 213, the intake air flow may be supplied to the dust collecting chamber 20 or the supply of the intake air flow may be stopped. Accordingly, the air pressure inside the dust collecting chamber 20 may be changed.

Upon opening of the flow path valve 213, the intake air flow may be supplied to the dust collecting chamber 20 and thus the air pressure inside the dust collecting chamber 20 may decrease. Upon closing of the flow path valve 213, the supply of the intake air flow may be stopped and thus the air pressure inside the dust collecting chamber 20 may increase.

As mentioned, the flow path valve 213 may periodically open and close the connecting flow path 212 and thus the air pressure inside the dust collecting chamber 20 may decrease and increase. Accordingly, the flow direction of the air inside the dust collecting chamber 20 may be variously generated.

Upon seating of the dust collecting chamber 20 on the seating portion 342, the docking of the cleaner 10 may be detected by a switch unit (not shown), and thus the flow rate regulator 210 may be driven.

The controller (not shown) may control the drive motor 214 to allow the flow path valve 213 to be arranged at the open position 213 (*o*) for a predetermined period of time. After the predetermined period of time elapses, the controller (not shown) may control the drive motor 214 to allow the flow path valve 213 to be arranged in the closed position 213 (*c*) for another predetermined period of time.

That is, the controller (not shown) may control the drive motor 214 to allow the flow path valve 213 to be sequentially arranged at the open position 213 (*o*) and the closed position 213 (*c*) at a predetermined interval.

It is appropriate that the controller (not shown) may control the drive motor (not shown) to allow a period of time in which the flow path valve 213 is in the open position 213 (*o*) to be longer than a period of time in which the flow path valve 213 is arranged in the closed position 213 (*c*). This is to increase the amount of intake air flow supplied to the dust collecting chamber 20.

As mentioned above, the flow rate regulator 210 may selectively change the amount of intake air flow supplied to the dust collecting chamber 20. As the intake air flow amount supplied to the dust collecting chamber 20 is changed, the air pressure inside the dust collecting chamber 20 may be changed according to the intake air flow amount, and accordingly, the flow of air in the dust collecting chamber 20 may be variously generated. The suction efficiency can be increased.

However, the disclosure is not limited thereto, and the controller (not shown) may control the air flow amount by changing the size of a region facing the flow direction D of the intake air flow in the cutout portion 213*a* of the flow path valve 213.

Because the flow path valve 213 is configured to be arranged at any middle position between the open position 213 (*o*) and the closed position 213 (*c*) using the rotation of the drive motor 214, it is possible to change the intake air flow amount, which is supplied to the dust collecting chamber 20, to be less than that when the flow path valve 213 is in the open position 213 (*o*) and it is possible to change the intake air flow amount, which is supplied to the dust collecting chamber 20, to be greater than that when the flow path valve 213 is in the closed position 213 (*c*).

That is, the flow rate regulator 210 may vary the intake air flow amount supplied to the dust collecting chamber 20 by the rotation of the flow path valve 213, and accordingly, the air pressure inside the dust collecting chamber 20 may be variously changed.

In addition, the above-mentioned description is not limited to the eighth embodiment, and thus it is possible to regulate the intake air flow amount by using components of the flow path covers 152, 172, and 182 according to the first to fifth embodiments. That is, by arranging the flow rate regulators 150, 170, and 180 according to the first to fifth embodiments in the collector 350 and the suction device 330, and by arranging the flow path covers 152, 172, and 182 on the connecting flow path 212, it is possible to regulate the amount of intake air flow supplied to the dust collecting chamber 20.

Hereinafter a cleaning apparatus 1" according to a tenth embodiment of the disclosure will be described. A configuration other than the cleaning apparatus 1" according to the tenth embodiment of the disclosure is the same as the configuration of the cleaning apparatus 1' according to the eighth embodiment of the disclosure, and thus a description thereof will be omitted.

Figure 30:
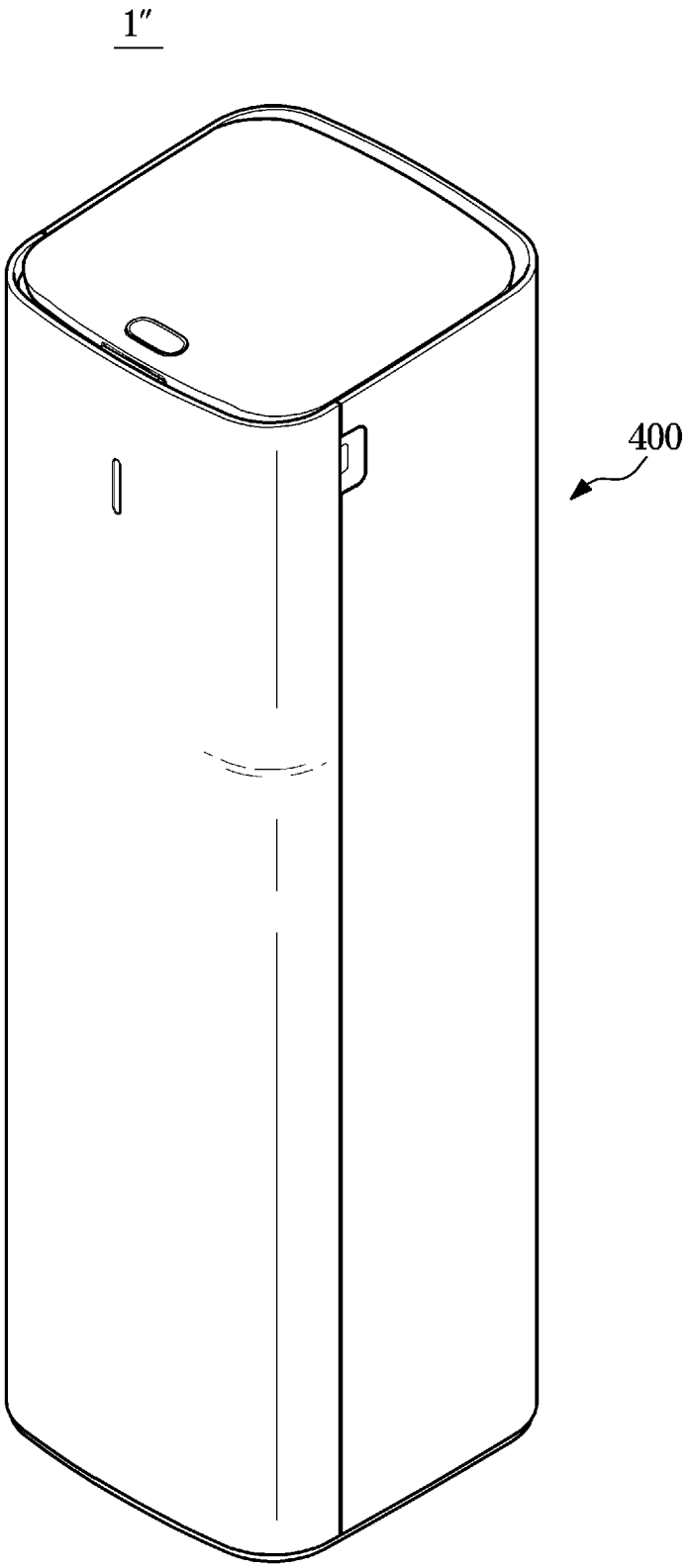
FIG. 30 is a perspective view of a docking station according to a tenth embodiment of the disclosure.
Figure 31:
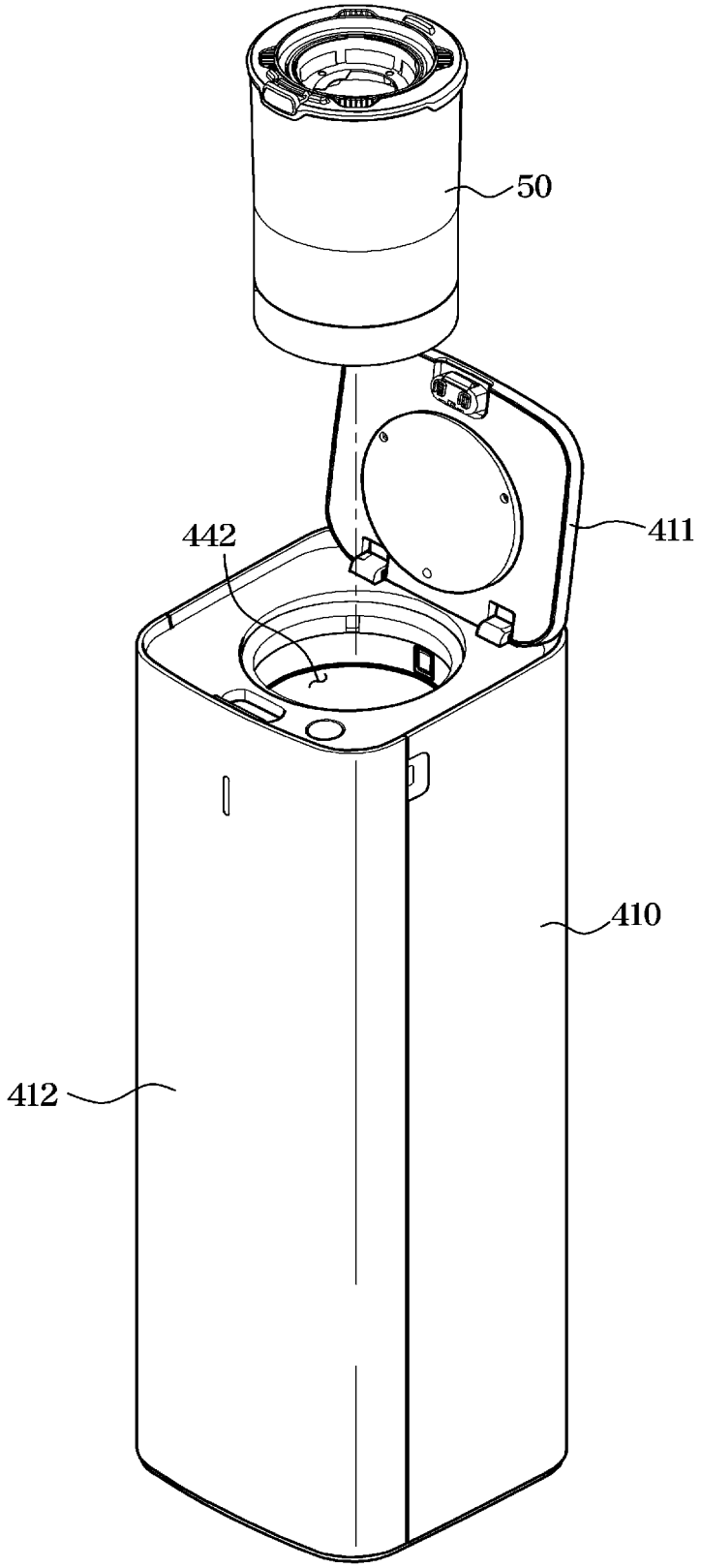
FIG. 31 is a view illustrating a state in which a dust collecting chamber of a cleaner is docked to the docking station according to the tenth embodiment of the disclosure.
Figure 32:
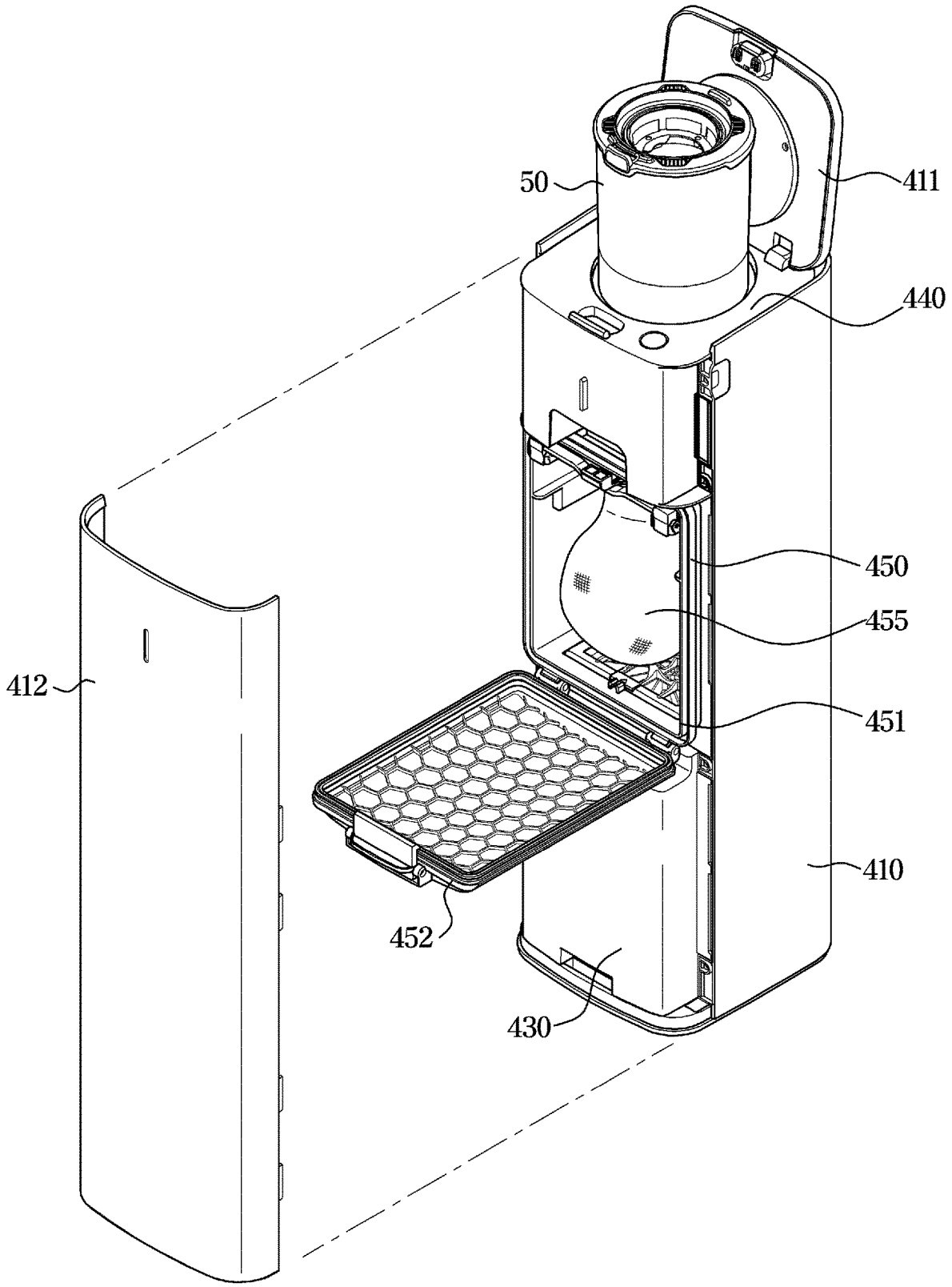
FIG. 32 is an exploded perspective view of the docking station according to the tenth embodiment of the disclosure.
Figure 33:
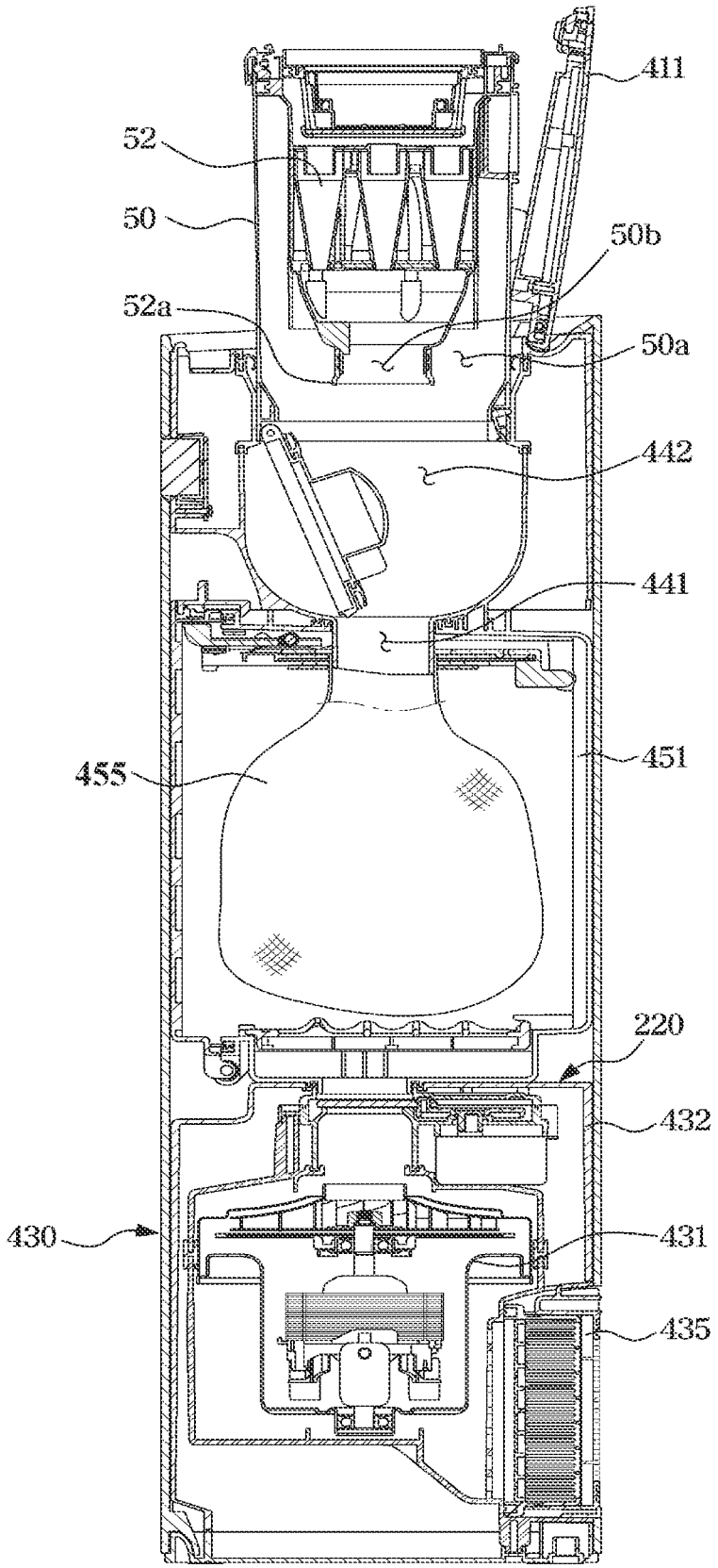
FIG. 33 is a side cross-sectional view of the docking station according to the tenth embodiment of the disclosure.

FIG. 30 is a perspective view of the docking station 1" according to a tenth embodiment of the disclosure, FIG. 31 is a view illustrating a state in which a dust collecting chamber of a cleaner is docked to a docking station according to the tenth embodiment of the disclosure, FIG. 32 is an exploded perspective view of the docking station according to the tenth embodiment of the disclosure and FIG. 33 is a side cross-sectional view of the docking station according to the tenth embodiment of the disclosure.

In the same manner as the cleaning apparatus 1' according to the eighth embodiment, a cleaning apparatus 1" according to the tenth embodiment of the disclosure may automatically discharge the collected substances by changing the intake air flow supplied to a dust collecting chamber 20 of a cleaner 10.

That is, as for the cleaning apparatus 1 according to the first embodiment, the automatic discharge of the docking station 100 may be effectively performed only when both of the dust collecting chamber 20 and the dust collecting guide 30 of the cleaner 10 are docked to the docking station 100. However, as for the cleaning apparatus 1' according to the eighth embodiment, the automatic discharge of the docking station 300 may be effectively performed as long as the dust collecting chamber 20 of the cleaner 10 is docked to the docking station 300.

Further, the cleaning apparatus 1" according to the tenth embodiment of the disclosure separates a dust collecting chamber 50 from the cleaner 10 and then dock only the dust collecting chamber 50 to the docking station 400, thereby automatically discharging the dust inside the dust collecting chamber 50.

Therefore, a user may separate only the dust collecting chamber 50 from the cleaner 10 and dock the dust collecting chamber 50 to the docking station 400 without docking the entire cleaner 10 to the docking station 400. Accordingly, it is possible to make the size of the docking station 400 miniaturized, and it is possible to automatically discharge the dust of the dust collecting chamber 50 by simply separating the dust collecting chamber 50.

Referring to FIGS. 30 to 33, the docking station 400 may include a body housing 410 and a docking housing 440 configured to allow the dust collecting chamber 50 to be docked thereto without a component configured to allow the dust collecting guide 30 to be docked thereto.

The docking station 400 may include the body housing 410 and the docking housing 440 described above. The body housing 410 may include a cover 411 arranged in the upper side of the body housing 410 and configured to open and close the docking housing 440.

The body housing 410 may be provided to include a long axis extending in one direction. It is appropriate that the long axis of the body housing 410 extends in the vertical direction. Accordingly, the docking station 400 may be provided in a box shape extending substantially in the vertical direction.

The body housing 410 may include a panel 412 arranged on the front of the body housing 410 and configured to be removable from the body housing 410. Alternatively, the panel 412 may be arranged on a side surface or a rear surface of the body housing 410 as well as the front surface of the body housing 410, and configured to be removable from the body housing 410.

As the panel 412 is separated from the body housing 410, a user can open the collector 450, which is described later, and easily replace a dust bag 455 arranged in the collector 450.

By including a suction device 430, the docking station 400 may discharge dust collected in the dust collecting chamber 50 from the dust collecting chamber 50. The suction device 430 may be arranged inside the body housing 410.

The docking station 400 may include the collector 450 in which foreign substances discharged from the dust collecting chamber 50 are collected. The collector 450 may be arranged inside the body housing 410. The collector 450 may be arranged above the suction device 430.

The docking station 400 may include an intake flow path 441 configured to connect the docking housing 440 to the collector 450, and configured to allow foreign substances, which are discharged from the dust collecting chamber 50, to be suctioned into the collector 450 through the docking housing 440.

The docking housing 440 may include a seating portion 442 configured to communicate with the intake flow path 441 and on which the dust collecting chamber 50 is mounted.

The seating portion 442 may be provided to be opened toward an upper side with respect to the long axis of the body housing 410.

The seating portion 442 may correspond to a space opened to the outside from the docking housing 440, and the seating portion 442 may be provided to allow the dust collecting chamber 50 to be inserted thereto in the vertical direction and to be seated thereon.

Upon seating the dust collecting chamber 50 on the seating portion 442, docking of the cleaner 10 to the docking station 400 may be completed.

The dust collecting chamber 50 may be docked to the seating portion 442 in a direction in which the long axis of the body housing 410 extends.

The dust collecting chamber 50 may be docked to the seating portion 442 in a direction in which the long axis of the cylindrical shape of the dust collecting chamber 50 extends.

Accordingly, upon the docking of the dust collecting chamber 50 to the docking station 400, the long axis of the body housing 410 and the long axis of the dust collecting chamber 50 may be provided so as to face in a substantially corresponding direction.

Although not shown in the drawings, the switch unit described in the first embodiment of the disclosure may be arranged inside the seating portion 442.

Therefore, upon seating the dust collecting chamber 50 on the seating portion 442, the controller (not shown) may confirm a state in which the dust collecting chamber 50 is docked to the docking station 400, through the switch unit.

Multi-cyclone 52 may be arranged inside the dust collecting chamber 50. The dust collecting chamber 50 may be provided to allow the foreign substances to be collected in a lower side 52*a* of the multi-cyclone 52. The dust collecting chamber 50 may include a first dust collector 50*a* configured to collect foreign substances which are primarily collected and have a relatively large size, and a second dust collector 50*b* configured to collect foreign substance, which are collected by the multi-cyclone 52 and have a relatively small size.

The first dust collector 50*a* and the second dust collector 50*b* may be opened to the outside upon the opening of a dust collecting chamber door 51.

Accordingly, upon opening of the dust collecting chamber door 51 arranged in the lower side of the dust collecting chamber 50, the foreign substance collected in the dust collecting chamber 50 may be easily discharged to the seating portion 442.

The intake flow path 441 may be connected to the collector 450 from the docking housing 440 by penetrating through the body housing 410. However, the disclosure is not limited thereto, and the docking housing 440 and the body housing 410 may be integrally formed with each other.

The intake flow path 441 may transfer the air flow generated by the suction device 430 to the dust collecting chamber 50. That is, the intake air flow generated by the suction device 430 is transferred into the dust collecting chamber 50 along the intake flow path 441 and the seating portion 442 through the collector 450. The foreign substance in the dust collecting chamber 50 may be discharged from the dust collecting chamber 50 to the seating portion 442 according to the air flow by the intake air flow, and then collected in the collector 450 through the intake flow path 441.

The collector 450 may include a collector housing 451. The collector housing 451 may form an inner space.

The collector 450 may include a collector cover 452. The collector cover 452 may be arranged on the front surface of the collector housing 451. The collector cover 452 may open and close the collector housing 451 to allow the inside of the collector 450 to be opened to the outside in a state in which the panel 412 is separated.

The collector 450 may include a dust bag 455 arranged in the inner space of the collector 450 and configured to collect foreign substances introduced through the intake flow path 441.

The dust bag 455 may be formed of a material through which air is transmitted and foreign substances are not, and thus the dust bag 455 may collect foreign substances introduced into the collector 450 from the dust collecting chamber 50.

The dust bag 455 may be directly connected to the intake flow path 441, and the dust bag 455 may be separable from the collector 450.

When the docking station 400 is driven to collect foreign substance in the dust bag 455, a user can separate the panel 412 and open the collector cover 452 to separate the dust bag 455 from the collector 450, thereby discharging the foreign substances collected in the docking station 400.

Although not shown in the drawings, the collector 450 may include an additional dust collecting chamber (not shown) in addition to the dust bag 455 as in the ninth embodiment. An inner space of the additional dust collecting chamber (not shown) is provided to be larger than an inner space of the dust collecting chamber 50, and the additional dust collecting chamber (not shown) may collect fine foreign substance by including a multi-cyclone in the same manner as the dust collecting chamber 50.

The suction device 430 may include a suction fan 431 and a suction device housing 432 forming the inner space in which the suction fan 431 is arranged.

The suction device housing 432 may include a suction device cover 435 arranged in the body housing 410 and configured to open and close the inside of the suction device housing 432. The suction device cover 435 may be configured to allow air suctioned by the suction fan 431 to be discharged.

The intake air flow generated by the suction fan 431 may be supplied to the dust collecting chamber 50 from the inner space of the suction device housing 432 through the collector 450 and the intake flow path 441.

The docking station 400 may include a flow rate regulator 220 configured to selectively change an amount of intake air flow supplied to the dust collecting chamber 50.

The flow rate regulator 220 may be arranged inside the body housing 410. The flow rate regulator 220 may be arranged between the collector 450 and the suction device 430. Particularly, the flow rate regulator 220 may be connected to a flow path to which the collector 450 and the suction device 430 are connected.

However, the disclosure is not limited thereto, and the flow rate regulator 220 may be arranged between the collector 450 and the suction flow path 441.

Hereinafter the flow rate regulator 220 according to the tenth embodiment of the disclosure will be described in detail.

Figure 34:
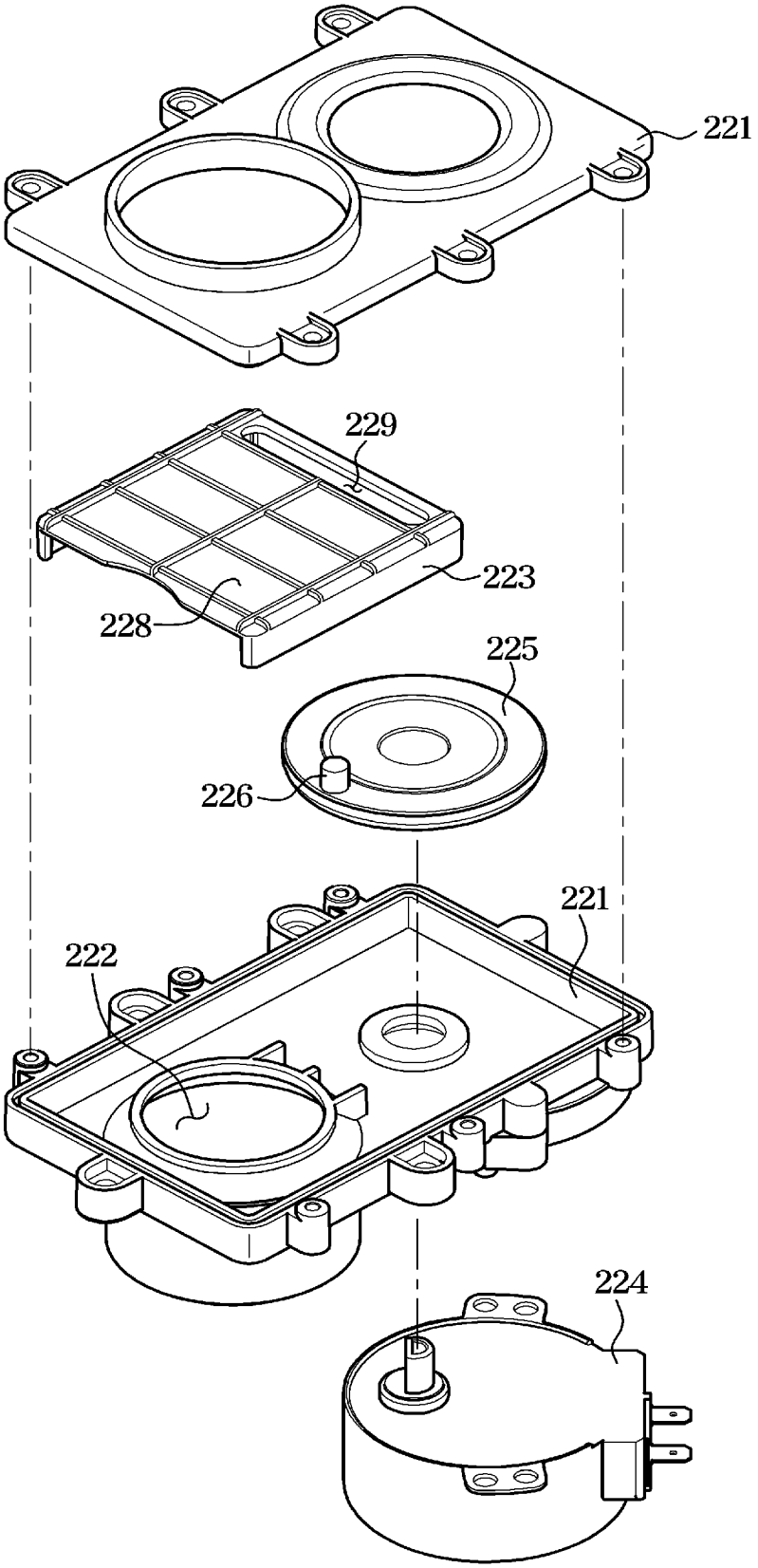
FIG. 34 is an exploded perspective view of a flow rate regulator according to the tenth embodiment of the disclosure.
Figure 35:
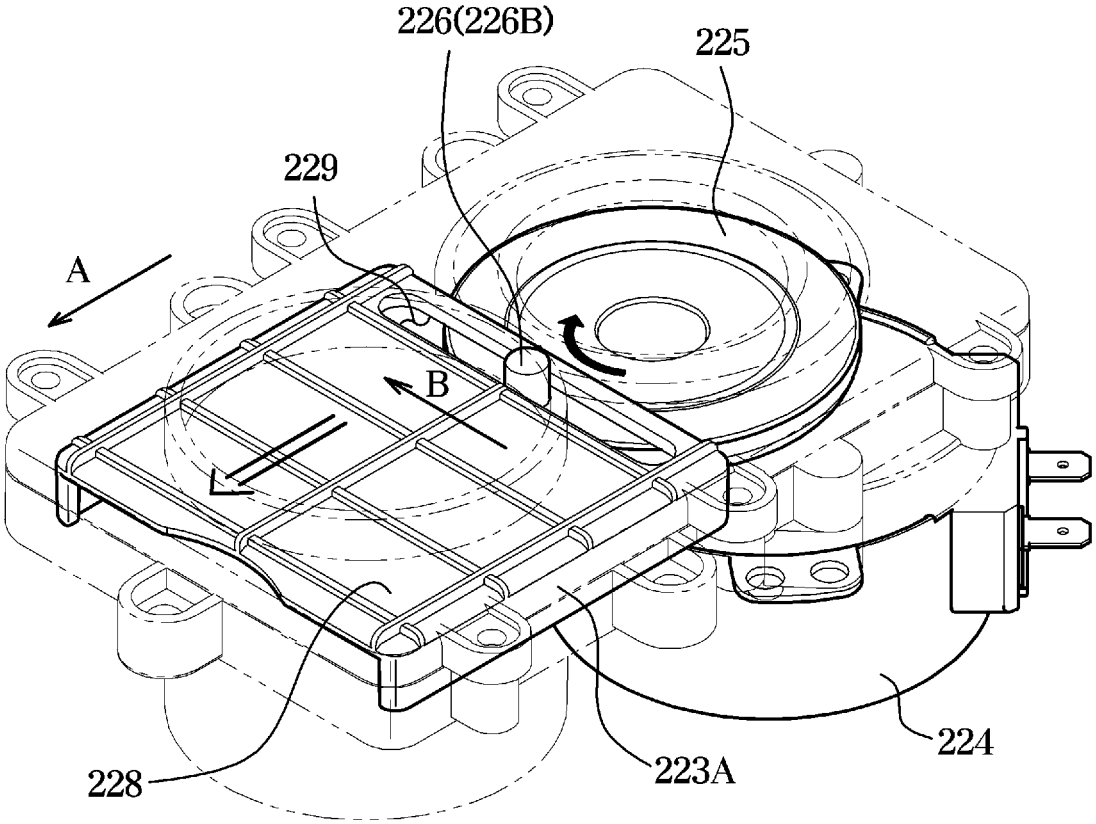
FIG. 35 is a view illustrating a state in which the flow rate regulator of FIG. 34 closes a connecting flow path.
Figure 36:
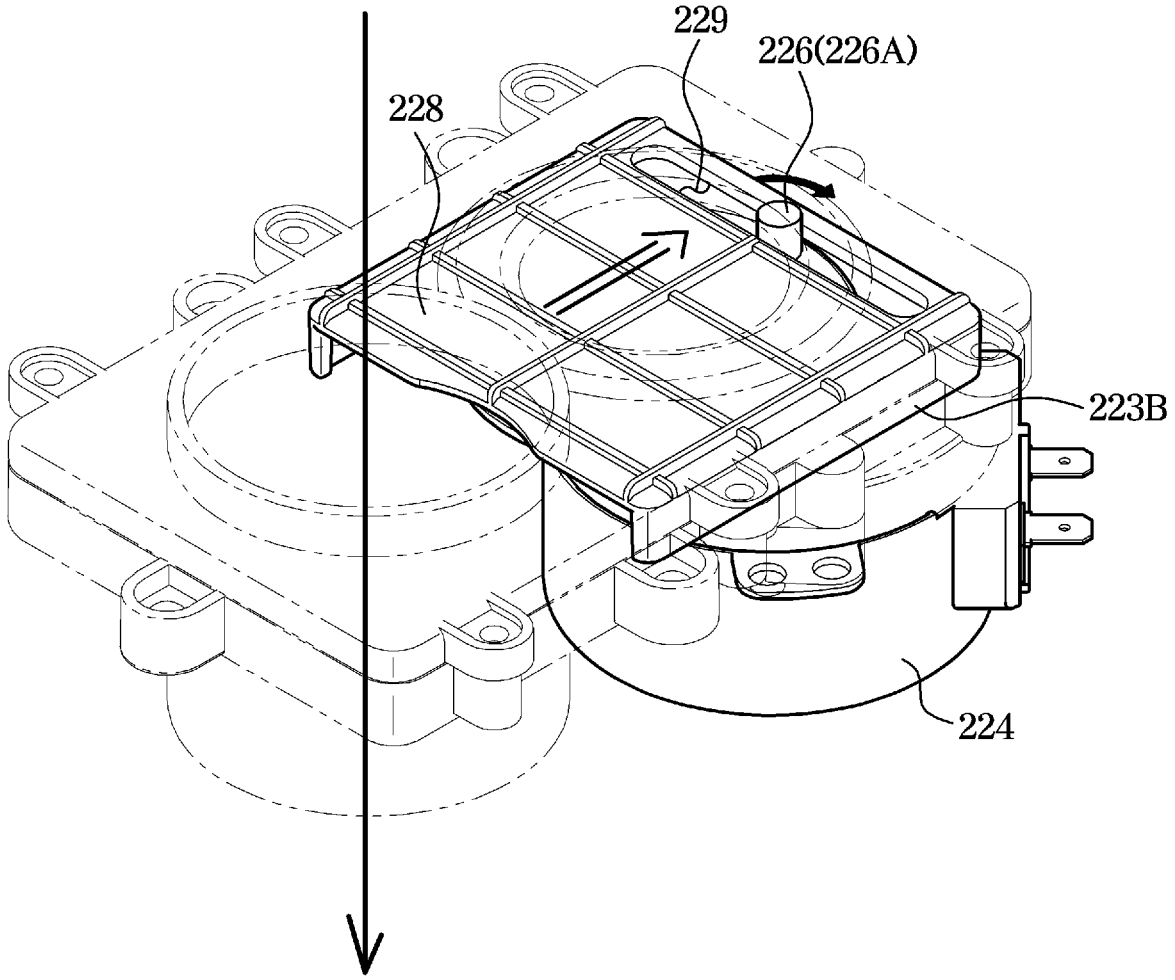
FIG. 36 is a view illustrating a state in which the flow rate regulator of FIG. 34 opens the connecting flow path.

FIG. 34 is an exploded perspective view of a flow rate regulator according to the tenth embodiment of the disclosure, FIG. 35 is a view illustrating a state in which the flow rate regulator of FIG. 34 closes a connecting flow path, and FIG. 36 is a view illustrating a state in which the flow rate regulator of FIG. 34 opens the connecting flow path.

Referring to FIGS. 34 to 36, the flow rate regulator 220 may include a flow path housing 221 forming a connecting flow path 222 configured to connect the collector 450 to the suction device 430.

Particularly, the connecting flow path 222 may be configured to connect the collector 450 to the suction device 430 and to allow air to flow. Accordingly, the collector 450 and the suction device 430 may communicate with each other through the connecting flow path 222, and the intake air flow generated by the suction device 430 may move to the collector 450 through the connecting flow path 222.

The connecting flow path 151 disclosed in the first to sixth embodiments may be connected to the dust collecting guide 30 and configured to allow the outside air to flow to the dust collecting guide 30, but the connecting flow path 212 according to the eighth embodiment and the connecting flow path 222 according to the tenth embodiment may be configured to connect the suction device 430 to the collector 450.

The flow rate regulator 220 may include a flow path valve 223 arranged on the connecting flow path 222 and configured to open and close the connecting flow path 222 to regulate the intake air flow in the connecting flow path 222.

The flow rate regulator 220 may include a drive motor 224 configured to allow the flow path valve 223 to open and close the connecting flow path 222 by using the rotation thereof.

A rotating member 225 may be arranged on a rotation axis of the drive motor 224. The rotating member 225 may be provided in a disk shape and may be rotated about the rotation axis of the drive motor 224.

A shaft 226 may be arranged on one side of the rotating member 225. The shaft 226 may be arranged on the outside of the rotation axis of the rotating member 225. Accordingly, the shaft 226 may revolve around the rotation axis of the drive motor 224 upon driving of the drive motor 224.

The flow path valve 223 may include a slit 229 into which the shaft 226 is inserted.

The slit 229 may allow the flow path valve 223 to reciprocate in a first direction A in conjunction with the revolution of the shaft 226 inserted into the slit 229.

The first direction A may be a left-right direction or a front-rear direction perpendicular to the vertical direction in which the connecting flow path 222 extends.

The shaft 226 may move the slit 229 to the first direction A and a direction opposite to the first direction A while the shaft 226 reciprocates in a second direction B perpendicular to one direction in the slit 229.

The second direction B is a direction perpendicular to the first direction A and the vertical direction in which the connecting flow path 222 extends. Therefore, when the first direction A is the left and right direction, the second direction B may be the front and rear direction, and when the first direction A is the front and rear direction, the second direction B may be the left and right direction.

The flow path valve 223 may include a plate 228 configured to perform translational motion in the first direction A in conjunction with the slit 229, and configured to selectively open and close the connecting flow path 222 through translational motion.

The plate 228 may be integrally formed with the slit 229. Therefore, in response to the movement of the slit 229 in the first direction A, the plate 228 may be moved in the first direction A together with the slit 229.

The plate 228 may be provided to reciprocate on the connecting flow path 222.

In response to the rotation of the shaft 226 in one direction by the rotation of the drive motor 224, the plate 228 and the slit 229 may be moved in the first direction A and then translated in the opposite direction of the first direction A in conjunction with the rotation of the shaft 226.

That is, in response to a single revolution of the shaft 226, the plate 228 may reciprocate once in the first direction A. In response to the completion of the single revolution of the shaft 226, the plate 228 may open the connecting flow path 222 once and close the connecting flow path 222 once.

It may be assumed that a starting position of the shaft 226 in the revolution of the shaft 226 is a first position 226A and a return point corresponding to an intermediate position during the revolution of the shaft 226 is a second position 226B. In response to the first position 226A of the shaft 226, the flow path valve 223 may open the connecting flow path 222, and in response to the second position 226B of the shaft 226, the flow path valve 223 may close the connecting flow path 222.

Referring to FIG. 35, when the shaft 226 revolves in one direction and moves from the first position 226A to the second position 226B, the slit 229 may be pressed in the first direction A and the plate 228 may be arranged on the connecting flow path 222. At this time, the intake air flow may be blocked by the plate 228. The intake air flow may be blocked by the plate 228 and thus the intake air flow may not flow from the suction device 430 to the collector 450. Therefore, the intake air flow may not be supplied to the dust collecting chamber 50.

That is, it may be assumed that when the plate 228 is placed on the connecting flow path 222 while the flow path valve 223 reciprocates in the first direction A in conjunction with the shaft 226, a position of the flow path valve 223 is a closed position 223A. In response to the closed position 223A of the flow path valve 223 during the reciprocating motion, the intake air flow may not be supplied to the dust collecting chamber 50.

In contrast, referring to FIG. 36, when the shaft 226 continues to revolve in one direction and moves from the second position 226B to the first position 226A, the slit 229 may be pressed in an opposite direction of the first direction A and the plate 228 may be arranged on the outside of the connecting flow path 222. At this time, the intake air flow may flow along the connecting flow path 222 without the limitation. The intake air flow may flow from the suction device 430 to the collector 450 without the limitation of the plate 228, and thus the intake air flow may be supplied to the dust collecting chamber 50.

That is, it may be assumed that when the plate 228 is placed on the outside of the connecting flow path 222 while the flow path valve 223 reciprocates in the first direction A in conjunction with the shaft 226, a position the flow path valve 223 is an open position 223B. In response to the open position 223B of the flow path valve 223 during the reciprocating motion, the intake air flow may be supplied to the dust collecting chamber 50.

According to the opening and closing of the flow path valve 223, the intake air flow may be supplied to the dust collecting chamber 50 or the supply of the intake air flow may be stopped. Accordingly, the air pressure inside the dust collecting chamber 50 may be changed.

When the intake air flow is supplied to the dust collecting chamber 50 upon the opening of the flow path valve 223, the air pressure inside the dust collecting chamber 50 may decrease, and when the supply of the intake air flow is stopped upon the closing of the flow path valve 223, the air pressure inside the dust collecting chamber 50 may increase.

As mentioned, the flow path valve 223 may periodically open and close the connecting flow path 222 and thus the air pressure inside the dust collecting chamber 50 may decrease and increase. Accordingly, the flow direction of the air inside the dust collecting chamber 50 may vary.

When the dust collecting chamber 50 is seated on the seating portion 442, the docking of the dust collecting chamber 50 may be detected by a switch unit (not shown), and thus the flow rate regulator 220 may be driven.

The controller (not shown) may control the drive motor 224 to allow the flow path valve 223 to be arranged at the open position 213B for a predetermined period of time. That is, the shaft 226 may be arranged in the first position 226A without the rotation.

After the predetermined period of time elapses, the controller (not shown) may control the drive motor 224 to allow the flow path valve 223 to be arranged in the closed position 223 B for another predetermined period of time.

That is, the controller (not shown) may control the drive motor 224 to allow the flow path valve 223 to be sequentially arranged at the open position 223A and the closed position 223B at a predetermined interval.

It is appropriate that the controller (not shown) may control the drive motor (not shown) to allow a period of time in which the flow path valve 223 is in the open position 223A to be longer than a period of time in which the flow path valve 223 is arranged in the closed position 223B. This is to increase the amount of intake air flow supplied to the dust collecting chamber 50.

As mentioned above, the flow rate regulator 220 may selectively change the amount of intake air flow supplied to the dust collecting chamber 50. As the intake air flow amount supplied to the dust collecting chamber 50 is changed, the air pressure inside the dust collecting chamber 50 may be changed according to the intake air flow amount, and accordingly, the flow of air in the dust collecting chamber 50 may be variously generated. The suction efficiency may be increased.

However, the disclosure is not limited thereto, and the controller (not shown) may control the air flow amount by changing the size of a region in which the plate 228 of the flow path valve 223 closes the connecting flow path 222.

Because the flow path valve 223 is configured to be arranged at any middle position between the open position 223A and the closed position 223B using the rotation of the drive motor 224, it is possible to change the intake air flow amount, which is supplied to the dust collecting chamber 50, to be less than that when the flow path valve 223 is in the open position 223A and it is possible to change the intake air flow amount, which is supplied to the dust collecting chamber 50, to be greater than that when the flow path valve 223 is in the closed position 223B.

That is, the flow rate regulator 220 may vary the amount of intake air flow supplied to the dust collecting chamber 50 by the reciprocating motion of the flow path valve 223, and accordingly, the air pressure inside the dust collecting chamber 50 may be variously changed.

In addition, the above mentioned description is not limited to the tenth embodiment, and thus it is possible to regulate the intake air flow amount by using components of the flow path covers 152, 172, and 182 according to the first to fifth embodiments and components of the flow path valve 213 according to the eighth embodiment. That is, by arranging the flow rate regulators 150, 170, 180 and 210 according to the first to fifth embodiments and the eighth embodiment between the collector 450 and the suction device 430, and by arranging the flow path covers 152, 172, and 182 and the flow path valve 213 on the connecting flow path 222, it is possible to regulate the intake air flow amount supplied to the dust collecting chamber 50.

Hereinafter technical features in which the dust collecting chamber 50 according to the tenth embodiment of the disclosure is docked to the docking station 400 will be described in detail. The dust collecting chamber 50 according to the tenth embodiment may be applied to the cleaning apparatus 1 according to the first embodiment or the cleaning apparatus 1' according to the eighth embodiment.

Figure 37:
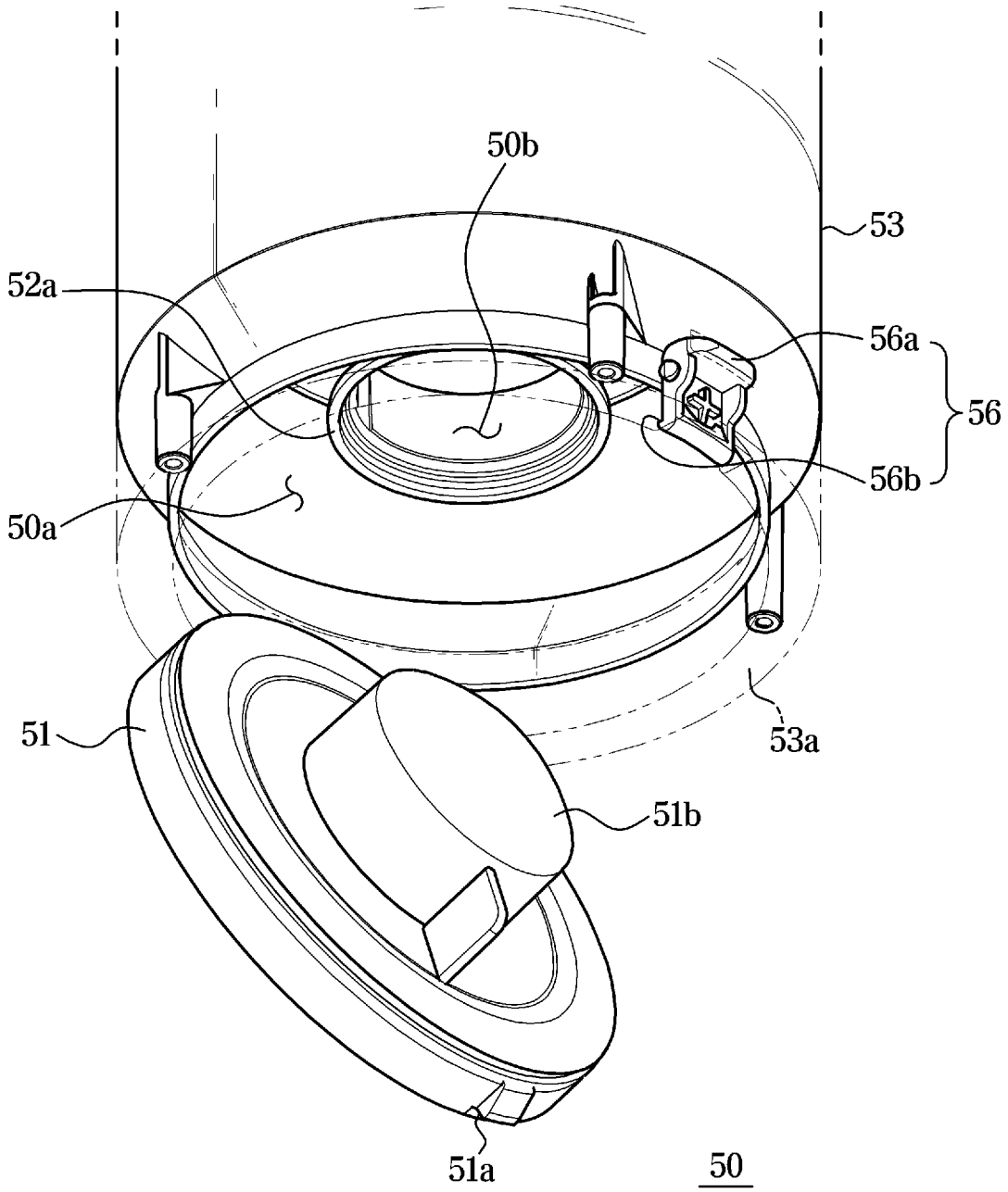
FIG. 37 is a view of a part of the dust collecting chamber according to the tenth embodiment of the disclosure.
Figure 38:
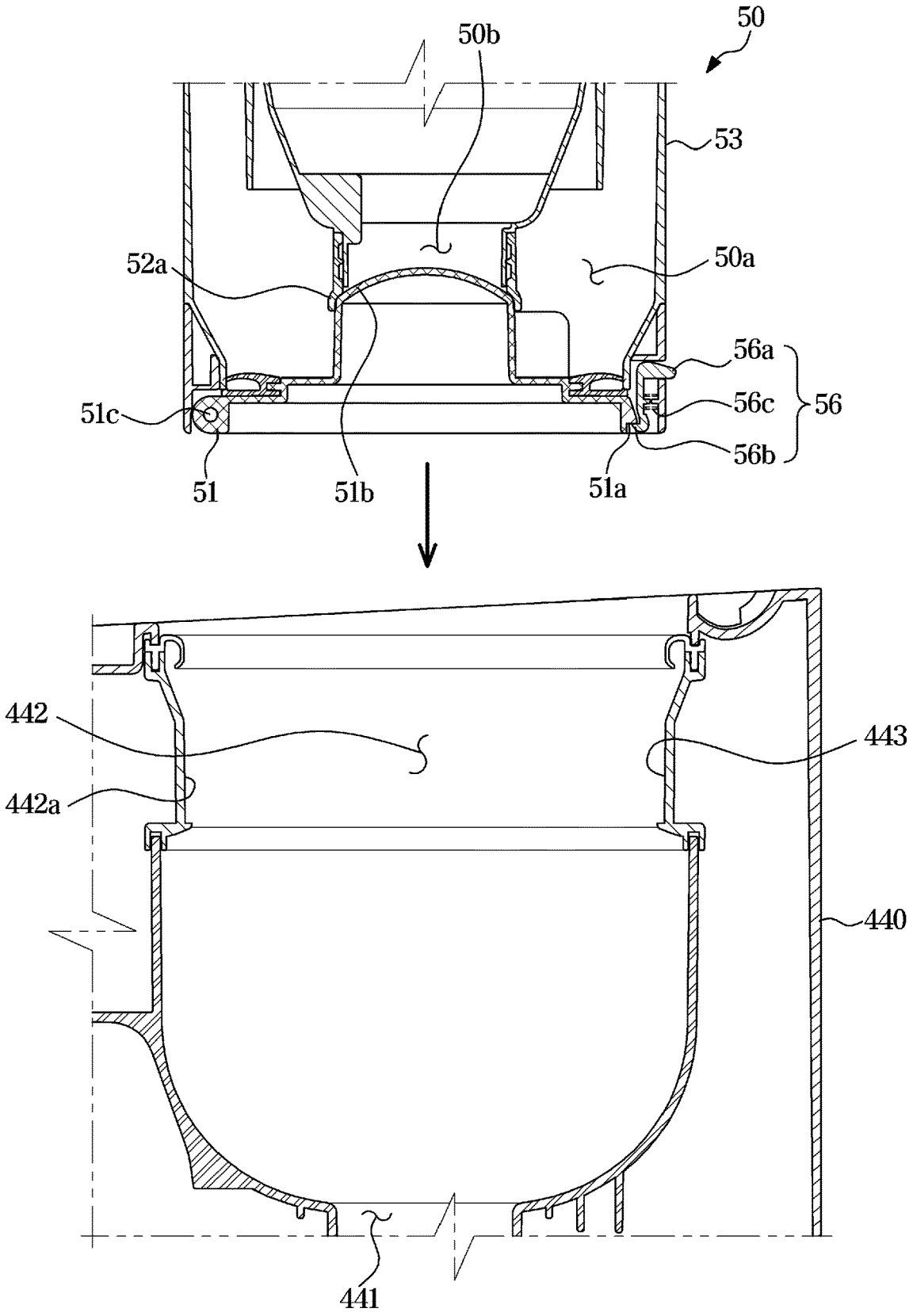
FIG. 38 is a view illustrating a state before the dust collecting chamber is docked to the docking station according to the tenth embodiment of the disclosure.
Figure 39:
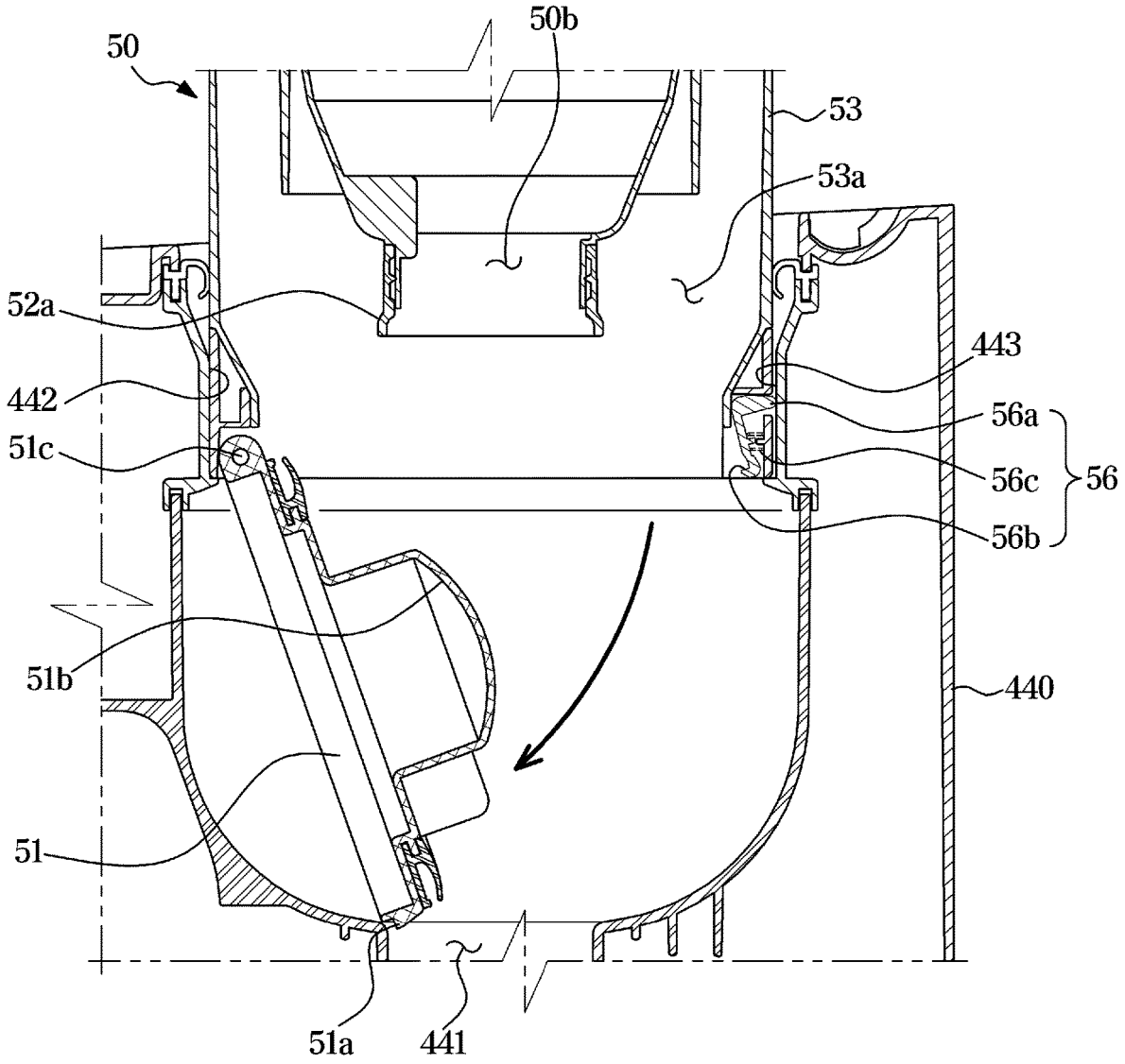
FIG. 39 is a view illustrating a state after the dust collecting chamber is docked to the docking station according to the tenth embodiment of the disclosure.

FIG. 37 is a view of a part of the dust collecting chamber according to the tenth embodiment of the disclosure, FIG. 38 is a view illustrating a state before the dust collecting chamber is docked to the docking station according to the tenth embodiment of the disclosure, and FIG. 39 is a view illustrating a state after the dust collecting chamber is docked to the docking station according to the tenth embodiment of the disclosure.

Referring to FIGS. 37 and 38, the dust collecting chamber 50 may include a dust collecting chamber body 53 and the dust collecting chamber door 51 configured to open and close the dust collecting chamber body 53 upon the docking to the docking station 400.

The dust collecting chamber body 53 may be provided in a cylindrical shape. However, the shape of the dust collecting chamber body 53 is not limited thereto, and thus the dust collecting chamber body 53 may be provided in a polygonal tubular shape.

The dust collecting chamber door 51 may be arranged at a lower end of the dust collecting chamber body 53 and open and close the lower end of the dust collecting chamber body 53.

As illustrated above, the dust collecting chamber 50 may include the first dust collector 50*a* configured to collect foreign substances which are primarily collected and have a relatively large size, and the second dust collector 50*b* configured to collect foreign substance, which are collected by the multi-cyclone 52 and have a relatively small size.

Both the first dust collector 50*a* and the second dust collector 50*b* may be configured to be opened to the outside upon opening of the dust collecting chamber door 51. At this time, upon opening of the dust collecting chamber door 51, both the first dust collector 50*a* and the second dust collector 50*b* may be opened to the outside.

The dust collecting chamber door 51 may include an engaging protrusion 51*a* engaged with the dust collecting chamber body 53 to maintain the dust collecting chamber 50 at a closed state, and a cap portion 51*b* configured to prevent foreign substances, which are collected in the second dust collector 50*b*, from being scattered to the outside upon the closing of the dust collecting chamber 50.

The dust collecting chamber door 51 may open and close the lower end of the dust collecting chamber body 53 while being rotated about a rotary shaft 51*c* arranged at one side of the lower end of the dust collecting chamber body 53.

The dust collecting chamber 50 may include a fixing member 56 arranged at the other side of the lower end of the dust collecting chamber body 53 and configured to prevent the dust collecting chamber door 51 from being separated from the lower end of the dust collecting chamber body 53 by supporting the engaging protrusion 51*a*.

The fixing member 56 may be hooked to the engaging protrusion 51*a* to prevent the engaging protrusion 51*a* from being separated from the dust collecting chamber body 53.

The fixing member 56 may include a pusher 56*a* configured to release a hooked engagement with the engaging protrusion 51*a* by being rotated upon the application of an external force, and a hook 56*b* interlocked with the pusher 56*a* and hook-engaged with the engaging protrusion 51*a*.

The fixing member 56 may include an elastic member 56*c* configured to maintain the hook 56*b* and the engaging protrusion 51*a* in a hooked state in response to a state of the fixing member 56 not being pressed by the pusher 56*a*.

The elastic member 56*c* is biased to allow the hook 56*b* to be pressed in the direction of the engaging protrusion 51*a* so as to maintain the hooked engagement of the hook 56*b* and the engaging protrusion 51*a* in the closed state of the dust collecting chamber door 51.

That is, the elastic member 56*c* may press the hook 56*b* toward the engaging protrusion 51*a* side by pressing the hook 56*b* toward the opposite direction of the radial direction of the dust collecting chamber body 53.

Upon pressing the pusher 56*a* with a force greater than the elastic force of the elastic member 56*c*, the hook 56*b* may be rotated in conjunction with the pusher 56*a*, and the hooked engagement of the hook 56*b* and the engaging protrusion 51*a* may be released.

The pusher 56*a* and the hook 56*b* may be arranged in opposite directions about the rotation axis of the fixing member 56. Accordingly, in response to the pressing of the pusher 56*a*, the hook 56*b* may be moved in an opposite direction of the pressing direction of the pusher 56*a*.

Therefore, upon pressing of the pusher 56*a* with the external force in an opposite direction of the radial direction of the dust collecting chamber body 53, the pusher 56*a* may be rotated in the opposite direction of the radial direction of the dust collecting chamber body 53, and thus the hook 56*b* may be rotated in the opposite direction of the radial direction of the dust collecting chamber body 53 and then moved in a direction away from the engaging protrusion 51*a*.

At this time, the dust collecting chamber door 51 may be separated from the dust collecting chamber body 53 by gravity and rotated downward with respect to the rotary shaft 51*c*, and thus the lower end of the dust collecting chamber body 53 may be opened.

The pusher 56*a* may protrude outward of an outer circumferential surface of the dust collecting chamber body 53 in the radial direction of the central axis of the dust collecting chamber body 53. A user can easily press the pusher 56*a* of the fixing member 56 protruding outward of the outer circumferential surface of the dust collecting chamber body 53, thereby opening the dust collecting chamber 50.

As for the docking station 400, the dust collecting chamber door 51 may be configured to be opened in response to docking of the dust collecting chamber 50 to the seating portion 442 of the docking station 400.

The docking station 400 may include an opening guide 443 configured to press the pusher 56*a* to open the dust collecting chamber door 51 upon seating the dust collecting chamber 50 on the seating portion 442.

The opening guide 443 may be arranged on the inner circumferential surface 442*a* of the seating portion 442 forming the seating portion 442.

The opening guide 443 may be formed as a partial region of the inner circumferential surface 442*a* of the seating portion 442 in the same manner as an embodiment of the disclosure. However, the disclosure is not limited thereto, and the opening guide 443 may be provided in the shape of a region or a protruding surface that protrudes toward the center from the inner circumferential surface 442*a* of the seating portion 442, and a shape such as a protrusion or rib that protrudes toward the center from the inner circumferential surface 442*a*.

The inner circumferential surface 442*a* of the seating portion 442 may be provided to have a size substantially corresponding to the outer circumferential surface of the dust collecting chamber body 53. Particularly, a circumference of the inner circumferential surface 442*a* of the seating portion 442 and a circumference of the dust collecting chamber body 53 may substantially correspond to each other.

That is, upon docking the dust collecting chamber 50 to the docking station 400, the inner circumferential surface 442*a* of the seating portion 442 and the outer circumferential surface of the dust collecting chamber body 53 may face at a predetermined distance.

Accordingly, upon seating the dust collecting chamber 50 on the seating portion 442, referring to FIG. 39, the outer circumferential surface of the dust collecting chamber body 53 may move downward along the inner circumferential surface 442*a* of the seating portion 442.

At this time, the pusher 56*a* protruding outward than the outer circumferential surface of the dust collecting chamber body 53 may be pressed downward and at the same time, pressed by the opening guide 443 that is formed as a part of the inner circumferential surface 442*a* of the seating portion 442.

Particularly, while the dust collecting chamber 50 is pressed downward, the pusher 56*a* arranged on the outside of the outer circumferential surface of the dust collecting chamber body 53 may be pressed in the vertical direction by the opening guide 443, and thus the pusher 56*a* may be rotated in the opposite direction of the radial direction of the outer circumferential surface of the dust collecting chamber body 53. Therefore, the hooked engagement of the hook 56*b* and the engaging protrusion 51*a* may be released and thus the dust collecting chamber door 51 may be opened.

Therefore, upon docking the dust collecting chamber 50 to the seating portion 442, the pusher 56*a* may be automatically pressed by the opening guide 443 and thus the dust collecting chamber door 51 may be opened upon the docking of the dust collecting chamber 50 to the docking station 400.

Hereinafter a dust collecting chamber 50' of a cleaning apparatus according to an eleventh embodiment of the disclosure will be described. A configuration other than the dust collecting chamber 50' described below is the same as that of the cleaning apparatus 1" and the dust collecting chamber 50 according to the tenth embodiment of the disclosure and thus a description thereof will be omitted. In addition, the dust collecting chamber of the cleaning apparatus according to the eleventh embodiment may be applied to the cleaning apparatus 1 according to the first embodiment or the cleaning apparatus 1' according to the eighth embodiment.

Figure 40:
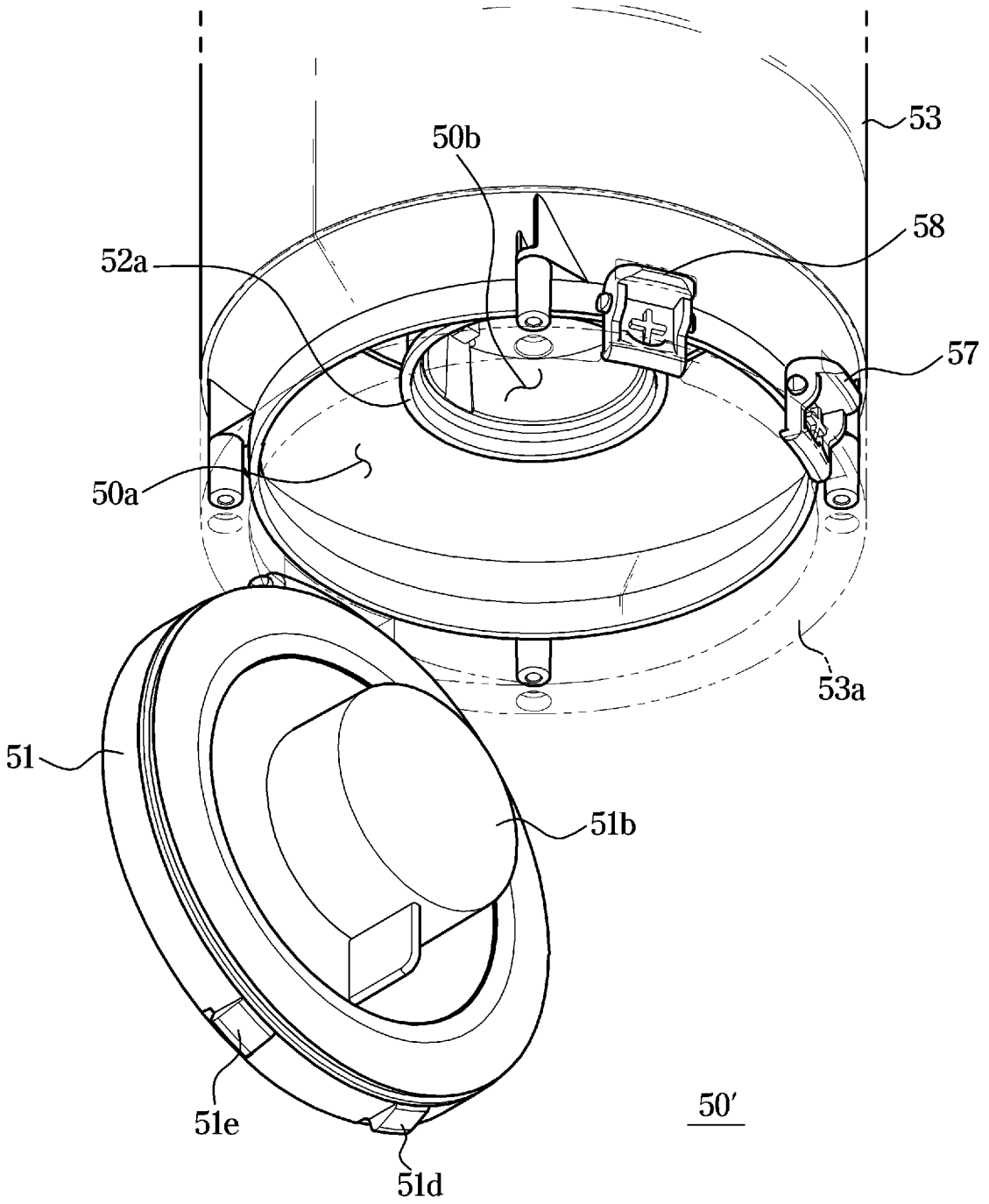
FIG. 40 is a view of a part of a dust collecting chamber according to an eleventh embodiment of the disclosure.

FIG. 40 is a view of a part of a dust collecting chamber according to an eleventh embodiment of the disclosure.

Referring to FIG. 40, the dust collecting chamber 50' according to the eleventh embodiment of the disclosure may include a first fixing member 57 and a second fixing member 58.

The first fixing member 57 and the second fixing member 58 may be respectively hooked to a first engaging protrusion 51*d* and a second engaging protrusion 51*e* arranged on the dust collecting chamber door 51.

The first fixing member 57 and the second fixing member 58 each has the same configuration as that of the fixing member 56 according to the tenth embodiment of the disclosure, and thus a description thereof will be omitted.

Upon operating the cleaner 10 by a user, the dust collecting chamber 50 may be opened because the user accidentally presses the fixing member 26 during the operation. That is, the fixing member 26 may open the dust collecting chamber door 51 using a pressure, and the fixing member 26 may be pressed to open the dust collecting chamber 50 regardless of a user intention.

In order to ease this difficulty, the dust collecting chamber 50' according to the eleventh embodiment of the disclosure may be provided with two fixing members 57 and 58 for fixing the dust collecting chamber door 51.

Accordingly, it is possible to ease the difficulty that the dust collecting chamber 50' is opened regardless of a user intention while driving the cleaner 10. Particularly, two fixing members 57 and 58 in which an engagement with the dust collecting chamber door 51 is released by the external force may be provided and thus even when a user accidentally presses one fixing member 57, the other fixing member 58 may fix the dust collecting chamber door 51, thereby maintaining the closed state of the dust collecting chamber door 51.

In order to open the dust collecting chamber door 51, a user must press both fixing members 57 and 58. That is, only when the first and second fixing members 57 and 58 are pressed at the same time, the restriction on the first engaging protrusion 51*d* and the second engaging protrusion 51*e* may be released so as to open the dust collecting chamber door 51.

The first fixing member 57 and the second fixing member 58 may be spaced apart from each other. A separation distance between the first fixing member 57 and the second fixing member 58 may vary.

In the same manner as the fixing member 56 of the tenth embodiment of the disclosure, upon docking to the docking station 400, the first fixing member 57 and the second fixing member 58 may be pressed by the opening guide 443 and the hooked engagement with the first engaging protrusion 51*d* and the second engaging protrusion 51*e* may be released and thus the dust collecting chamber door 51 may be opened.

The opening guide 443 may maintain a pressed state of the first fixing member 57 and the second fixing member 58 at the same time, and thus the dust collecting chamber door 51 may be opened.

That is, although a plurality of fixing members 57 and 58 is provided, the plurality of fixing members 57 and 58 may be pressed by the opening guide 443 upon docking to the docking station 400, and thus the dust collecting chamber door 51 may be automatically opened.

At this time, the opening guide 443 may be formed on the entire inner circumferential surface 442*a* of the seating portion 442. That is, the opening guide 443 may be formed along the circumferential direction of the inner circumferential surface 442*a* of the seating portion 442 although not shown in the drawing.

Therefore, the first and second fixing members 57 and 58 may be always pressed by the opening guide 443 even when the dust collecting chamber 50' is docked to the docking station 400 in any direction in the circumferential direction of the outer circumferential surface of the dust collecting chamber body 53.

Alternatively, the docking station 400 may include a guide (not shown) configured to allow the dust collecting chamber 50' to be seated in a specific direction in the circumferential direction of the outer circumferential surface of the dust collecting chamber body 53 upon seating the dust collecting chamber 50' on the seating portion 442.

The guide (not shown) may guide the dust collecting chamber 50' to allow the dust collecting chamber 50' to be docked in a direction in which the first and second fixing members 57 and 58 substantially overlap with the opening guide 443 in the vertical direction.

As mentioned above, only when the first and second fixing members 57 and 58 are pressed, the dust collecting chamber door 51 may be opened. Therefore, upon docking the dust collecting chamber 50' to the docking station 400, the first and second fixing members 57 and 58 may be consequentially pressed by the opening guide 443 and thus the dust collecting chamber door 51 may be opened upon the docking of the dust collecting chamber 50'.

Hereinafter a dust collecting chamber 50" of a cleaning apparatus according to a twelfth embodiment of the disclosure will be described. A configuration other than the dust collecting chamber 50" described below is the same as that of the cleaning apparatus 1" and the dust collecting chamber 50 according to the tenth embodiment of the disclosure and thus a description thereof will be omitted. In addition, the dust collecting chamber of the cleaning apparatus according to the twelfth embodiment may be applied to the cleaning apparatus 1 according to the first embodiment or the cleaning apparatus 1' according to the eighth embodiment.

Figure 41:
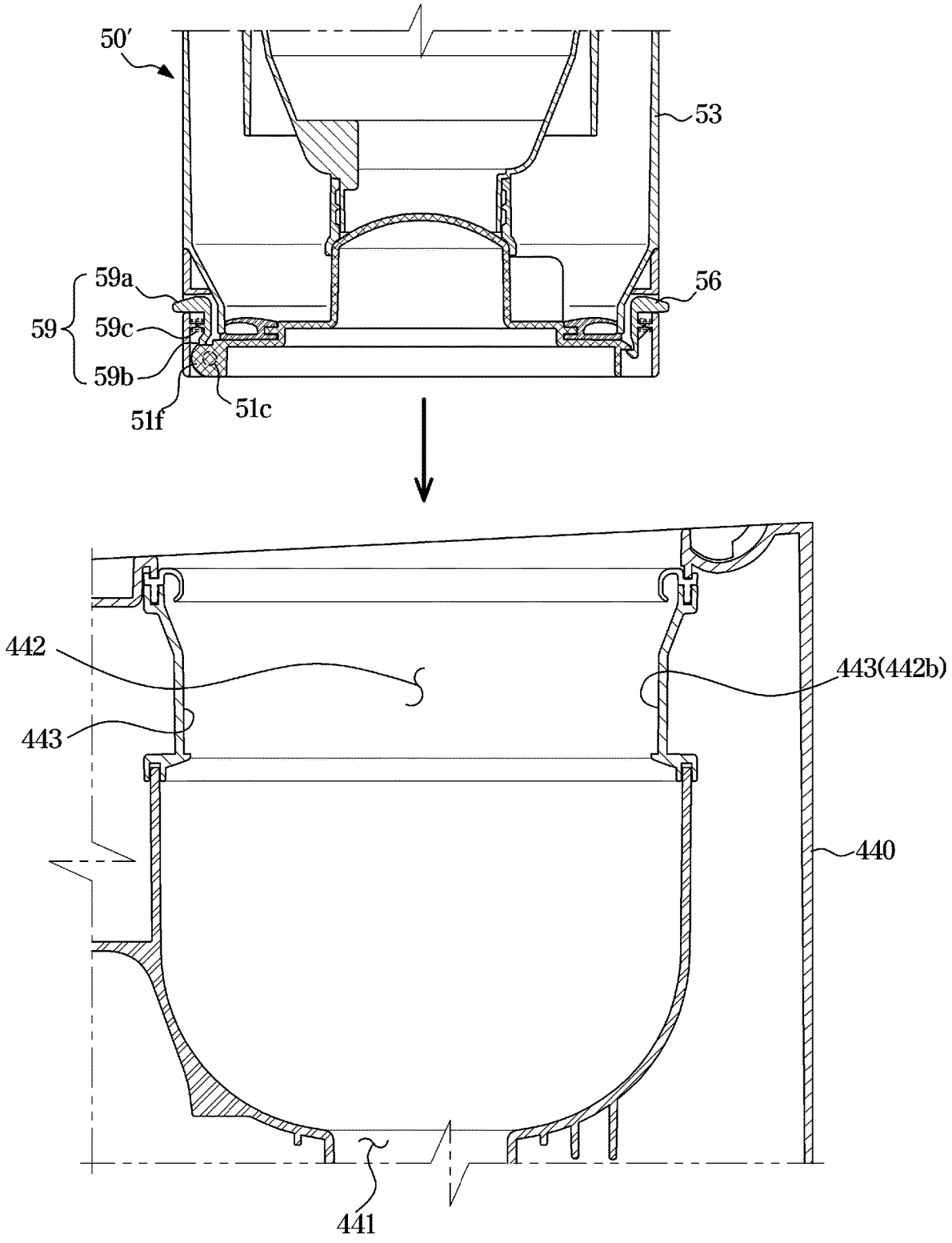
FIG. 41 is a view illustrating a state before a dust collecting chamber is docked to a docking station according to a twelfth embodiment of the disclosure.
Figure 42:
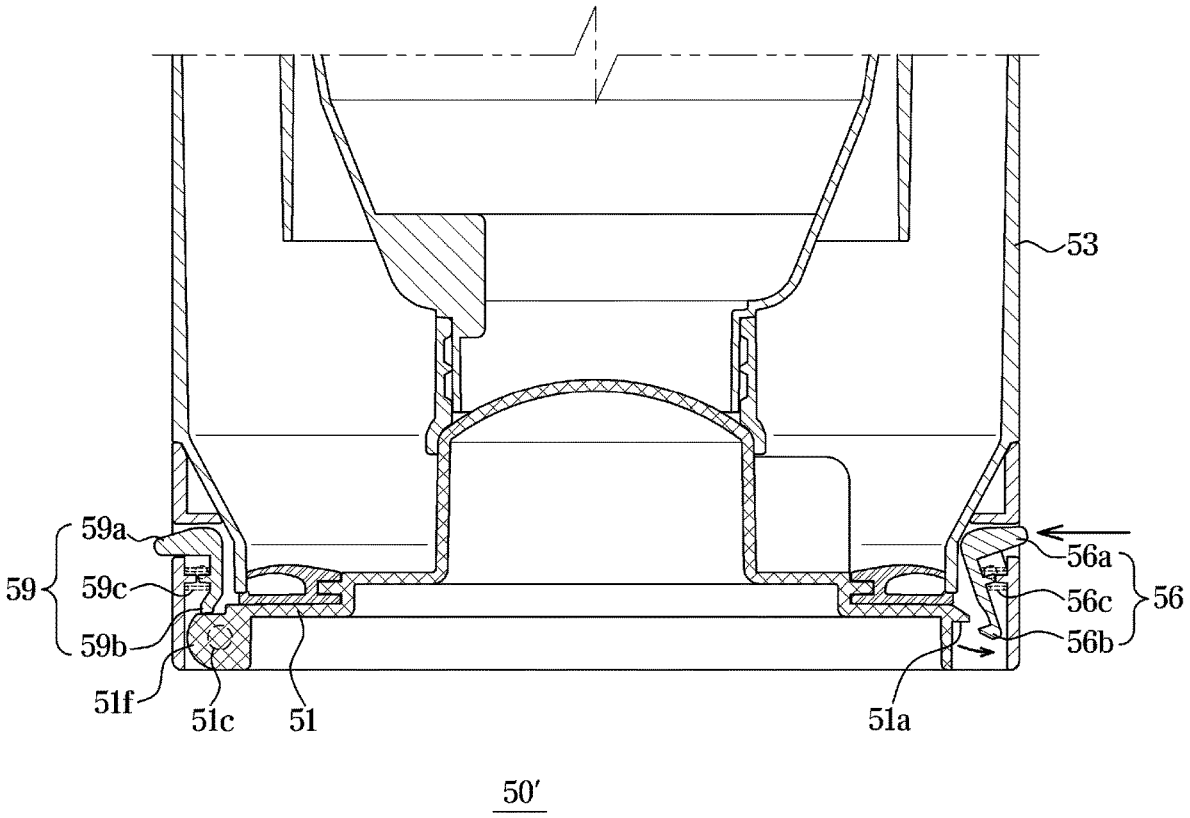
FIG. 42 is a view illustrating a state in which an external force is applied to a fixing member of the dust collecting chamber according to the twelfth embodiment of the disclosure.
Figure 43:
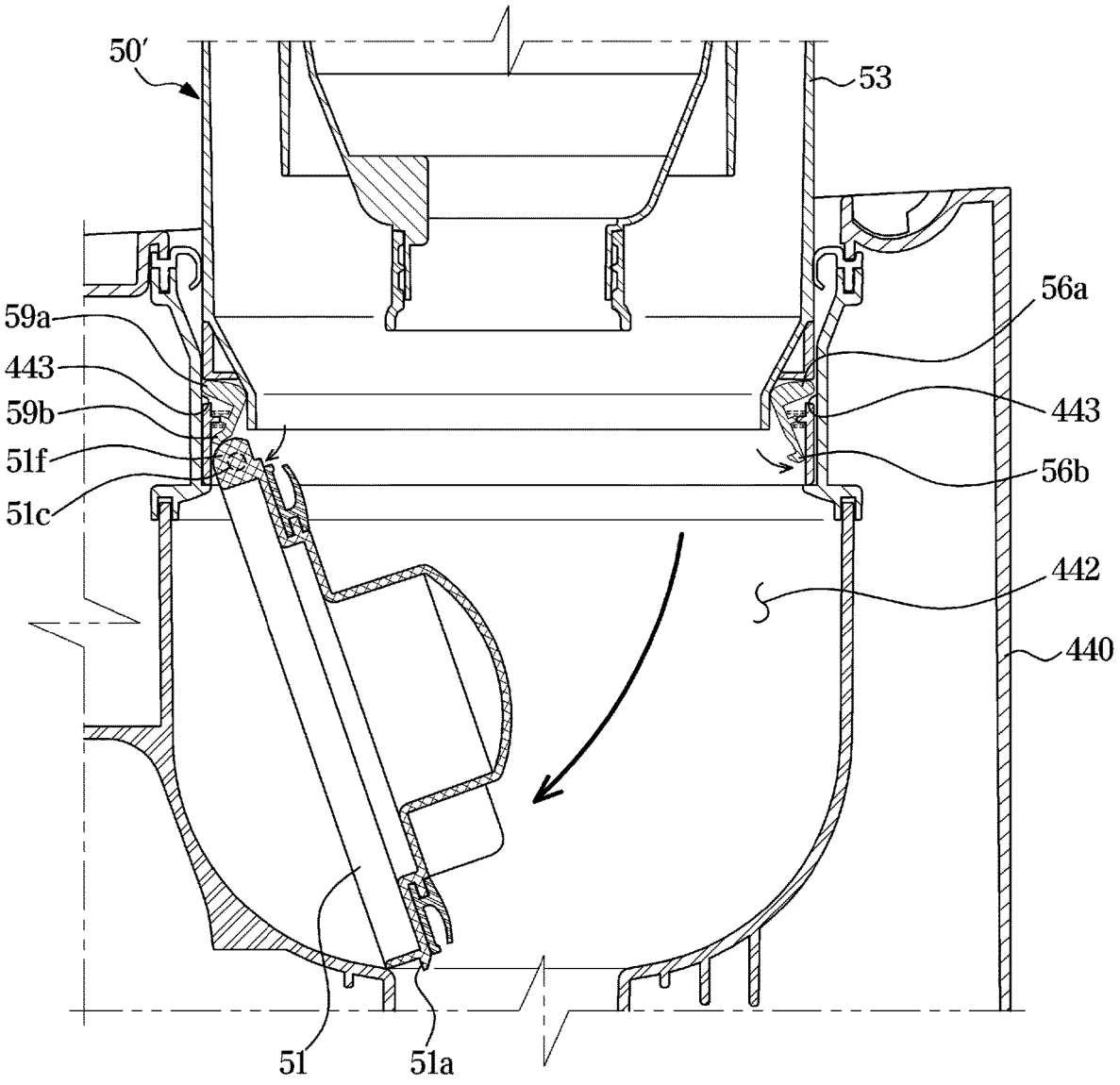
FIG. 43 is a view illustrating a state after the dust collecting chamber is docked to the docking station according to the twelfth embodiment of the disclosure.

FIG. 41 is a view illustrating a state before the dust collecting chamber is docked to a docking station according to a twelfth embodiment of the disclosure, FIG. 42 is a view illustrating a state in which an external force is applied to a fixing member of the dust collecting chamber according to the twelfth embodiment of the disclosure, and FIG. 43 is a view illustrating a state after the dust collecting chamber is docked to the docking station according to the twelfth embodiment of the disclosure.

Referring to FIG. 41, the dust collecting chamber 50" may include a fixing member 26 and an auxiliary fixing member 29 configured to fix a dust collecting chamber door 51 together with the fixing member 26. A configuration of the dust collecting chamber 50" according to the twelfth embodiment other than the auxiliary fixing member 29 is the same as that of the dust collecting chamber 50 according to the tenth embodiment, and thus a description thereof will be omitted.

The dust collecting chamber door 51 may open and close the lower end of the dust collecting chamber body 53 while being rotated about a rotary shaft 51*c* arranged at one side of the lower end of the dust collecting chamber body 53.

The fixing member 56 may be arranged on the other side of the lower end of the dust collecting chamber body 53 and configured to support the engaging protrusion 51*a* so as to prevent the dust collecting chamber door 51 from being separated from the lower end of the dust collecting chamber body 53.

The fixing member 56 may be hooked to the engaging protrusion 51*a* to prevent the engaging protrusion 51*a* from being separated from the dust collecting chamber body 53.

The auxiliary fixing member 29 may prevent a case in which the dust collecting chamber door 51 is opened regardless of the use intention. That is, it is possible to prevent a case in which the dust collecting chamber door 51 is opened and foreign substances are scattered because the user accidentally presses the fixing member 56.

The auxiliary fixing member 29 may be arranged on the rotary shaft 51*c* of the dust collecting chamber door 51 so as to limit a rotation of a rotary portion 51*f* of the dust collecting chamber door 51, thereby fixing the dust collecting chamber door 51 to the dust collecting chamber body 53.

The auxiliary fixing member 59 may include a pusher 59*a* configured to release the limitation of the rotation of the rotary portion 51*f* by being rotated upon being pressed by an external force, and a limiter 59*b* interlocked with the pusher 59*a* and configured to limit the rotation of the rotary portion 51*f* by pressing the rotary portion 51*f* to an opposite direction of the rotation direction of the rotary portion 51*f*.

The pusher 59*a* may be provided to protrude outward of an outer circumferential surface of the dust collecting chamber body 53 in the radial direction of the central axis of the dust collecting chamber body 53. A user can easily press the pusher 59*a* of the auxiliary fixing member 59 protruding outward of the outer circumferential surface of the dust collecting chamber body 53, thereby easily opening the dust collecting chamber 50".

The auxiliary fixing member 59 may include an elastic member 56*c* configured to maintain a pressed state of the rotary portion 51*f* by allowing the limiter 59*b* to press the rotary portion 51*f* when the auxiliary fixing member 59 is not pressed by the pusher 59*a*.

The elastic member 59*c* is biased to allow the limiter 59*b* to press the rotary portion 51*f* toward an opposite direction of the rotation direction of the rotary portion 51*f* in the closed state of the dust collecting chamber door 51. Therefore, a state in which the limiter 59*b* limits the rotation of the rotary portion 51*f* may be maintained.

That is, the elastic member 59*c* may press the limiter 59*b* toward an opposite direction of the radial direction of the dust collecting chamber body 53 to allow the limiter 59*b* to be maintained at a position in which the limiter 59*b* limits the rotation of the rotary portion 51*f*.

The pusher 59*a* and the limiter 59*b* may be arranged in opposite directions about the rotation axis of the auxiliary fixing member 59. Accordingly, upon pressing of the pusher 59*a*, the limiter 59*b* may be moved in an opposite direction of the pressing direction of the pusher 59*a*.

Therefore, upon pressing the pusher 59*a* with the external force in an opposite direction of the radial direction of the dust collecting chamber body 53, the pusher 59*a* may be rotated in the opposite direction of the radial direction of the dust collecting chamber body 53, and thus the limiter 59*b* may be rotated in the opposite direction of the radial direction of the dust collecting chamber body 53 and then moved in a direction away from the rotary portion 51*f*.

As the limiter 59*b* is moved in a direction away from the rotary portion 51*f*, the limiter 59*b* may be separated from the position pressed in an opposite direction of the rotational direction of the rotary portion 51*f*.

In a state in which the hooked engagement of the engaging protrusion 51*a* and the hook 56*b* is released because the fixing member 56 is pressed, when the limiter 59*b* is separated from the position pressed in the opposite direction of the rotation direction of the rotary portion 51*f*, the dust collecting chamber door 51 may be separated from the dust collecting chamber body 53 by gravity, and the dust collecting chamber door 51 may be rotated downward about the rotary shaft 51*c*, and thus the lower end of the dust collecting chamber body 53 may be opened.

Accordingly, when the user presses only the fixing member 26 without pressing the auxiliary fixing member 29 as shown in FIG. 42, the limiter 59*b* of the dust collecting chamber door 51 may limit the rotation of the rotary portion 51*f* and thus the dust collecting chamber door 51 may be fixed to the dust collecting chamber body 53 without rotating and moving downward.

In order to open the dust collecting chamber door 51, the user must press both the fixing member 56 and the auxiliary fixing member 59. That is, only when the fixing member 56 and the auxiliary fixing member 59 are simultaneously pressed, the fixation of the engaging protrusion 51*a* may be released, and the restriction of the rotation of the rotary portion 51*f* may be released, and thus the dust collecting chamber door 51 may be opened.

The fixing member 56 and the auxiliary fixing member 59 may be spaced apart from each other. A separation distance between the fixing member 56 and the auxiliary fixing member 59 may vary. However, the auxiliary fixing member 59 may be arranged to substantially correspond to the rotary shaft 51*c* of the dust collecting chamber door 51, in which the rotary portion 51*f* is arranged, in the vertical direction.

Referring to FIG. 43, in the same manner as the first and second fixing members 57 and 58 according to the eleventh embodiment, when the fixing member 56 and the auxiliary fixing member 59 are docked to the docking station 400, the fixing member 56 and the auxiliary fixing member 59 may be pressed by the opening guide 443 to release the hooked engagement between the engaging protrusion 51*a* and the hook 56*b*, and the rotation restriction of the rotary portion 51*f* by the limiter 59*b* may be released. Accordingly, the dust collecting chamber door 51 may be opened.

The opening guide 443 may maintain the pressed state of the fixing member 56 and the auxiliary fixing member 59 at the same time and thus the dust collecting chamber door 51 may be opened.

That is, even when a plurality of configurations configured to fix the dust collecting chamber door 51, such as the fixing member 56 and the auxiliary fixing member 59 is provided, all the plurality of configurations may be pressed by the opening guide 443 upon the docking to the docking station 400, and thus the dust collecting chamber door 51 may be automatically opened.

At this time, the opening guide 443 may be formed on the entire inner circumferential surface 442*a* of the seating portion 442. That is, the opening guide 443 may be formed along the circumferential direction of the inner circumferential surface 442*a* of the seating portion 442 although not shown in the drawing.

Therefore, even when the dust collecting chamber 50" is docked to the docking station 400 in any one direction in the circumferential direction of the outer circumferential surface of the dust collecting chamber body 53, the fixing member 56 and the auxiliary fixing member 59 may be pressed by the opening guide 443.

Alternatively, the docking station 400 may include a guide (not shown) configured to allow the dust collecting chamber 50" to be seated in a specific direction in the circumferential direction of the outer circumferential surface of the dust collecting chamber body 53 upon seating the dust collecting chamber 50" on the seating portion 442.

As mentioned above, only when the fixing member 56 and the auxiliary fixing member 59 are pressed, the dust collecting chamber door 51 may be opened. Therefore, upon docking the dust collecting chamber 50" to the docking station 400, the fixing member 56 and the auxiliary fixing member 59 may be consequentially pressed by the opening guide 443 and thus the dust collecting chamber door 51 may be opened upon the docking of the dust collecting chamber 50".

Hereinafter technical features in which, a dust collecting chamber 60 according to a thirteenth embodiment of the disclosure is docked to the docking station 400, will be described in detail. The dust collecting chamber 60 according to the thirteenth embodiment may be applied to the cleaning apparatus 1 according to the first embodiment or the cleaning apparatus 1' according to the eighth embodiment.

Figure 44:
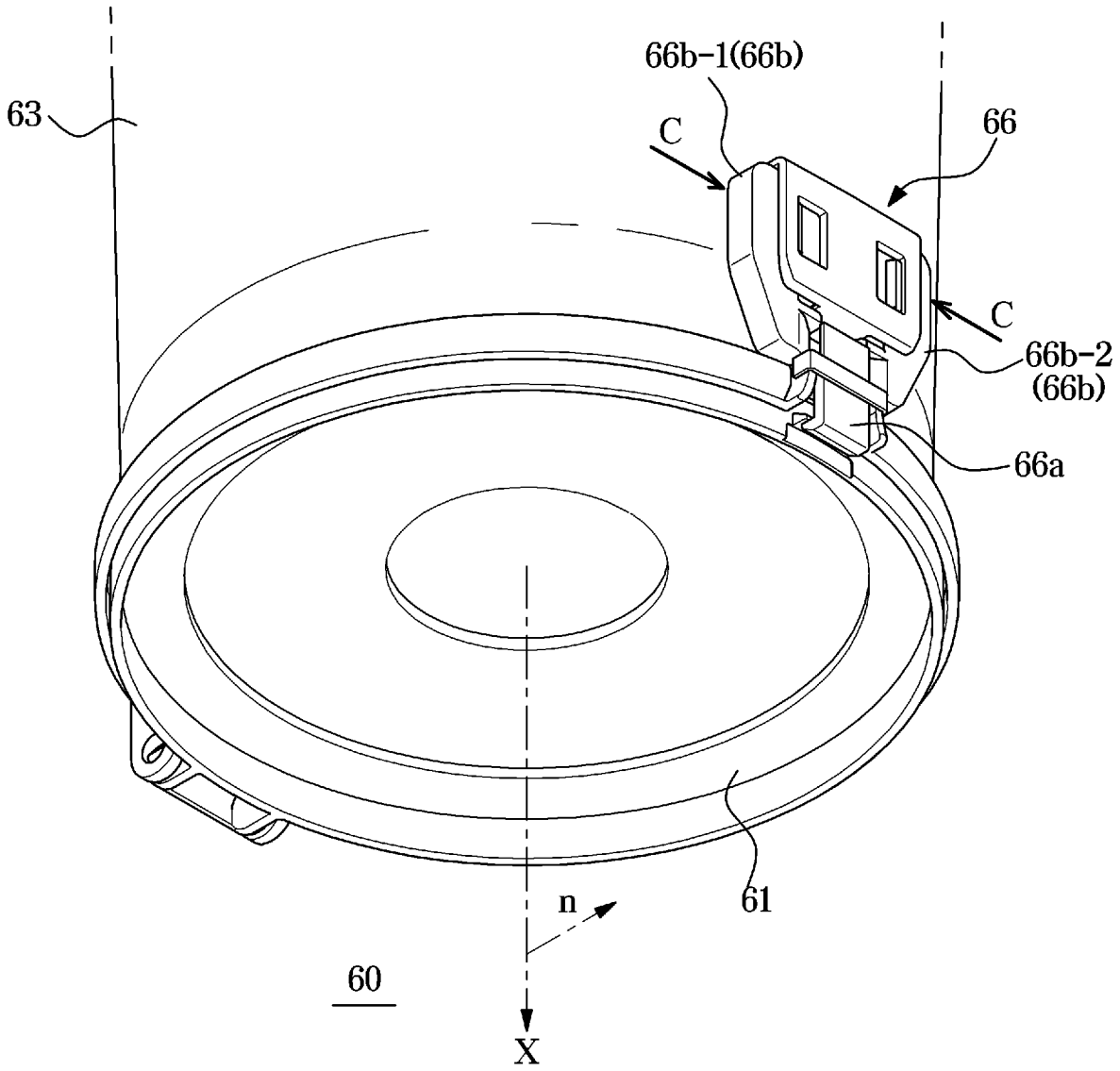
FIG. 44 is a view illustrating a part of a dust collecting chamber in a closed state according to a thirteenth embodiment of the disclosure.
Figure 45:
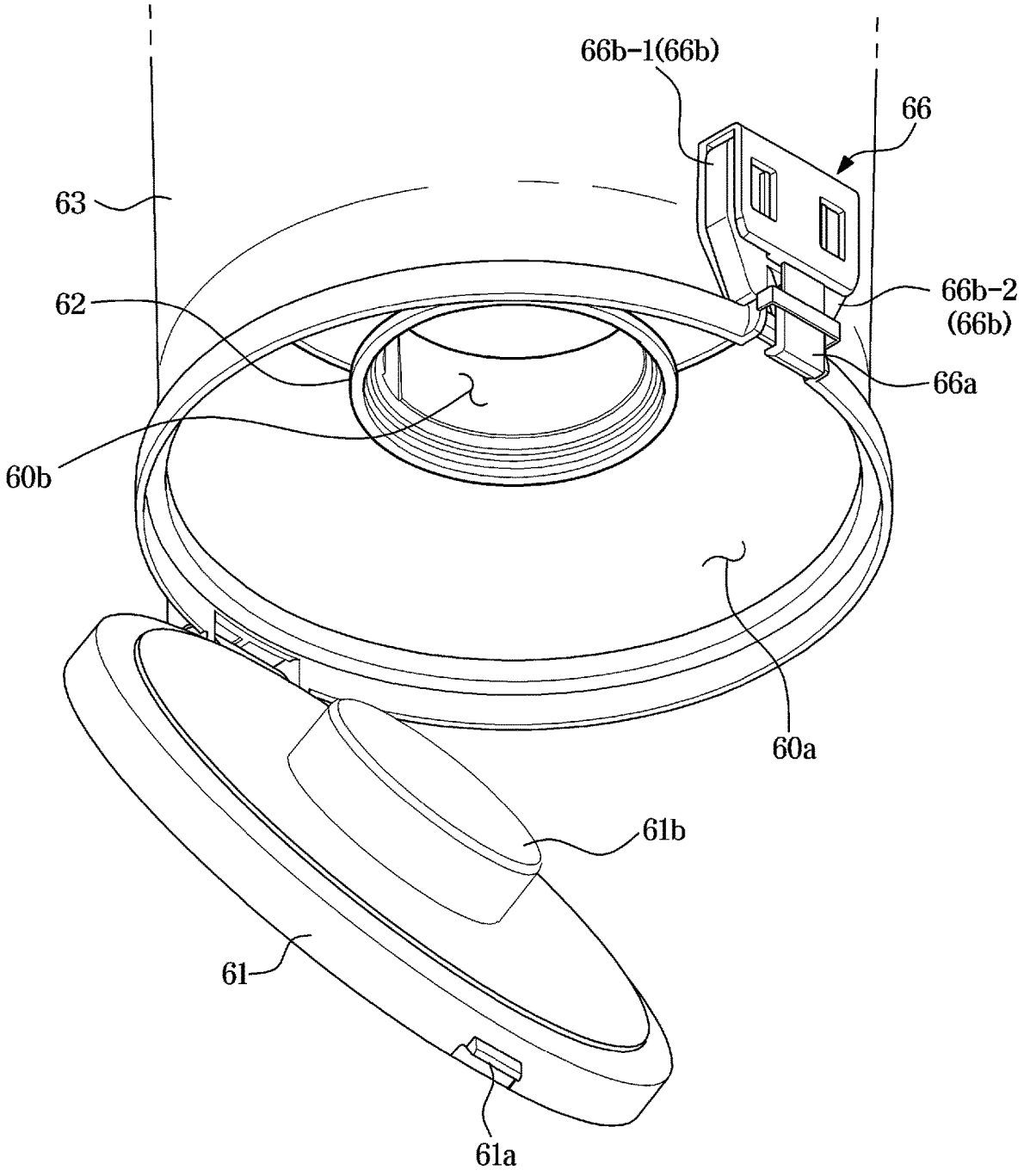
FIG. 45 is a view illustrating a part of the dust collecting chamber in an open state according to the thirteenth embodiment of the disclosure.
Figure 46:
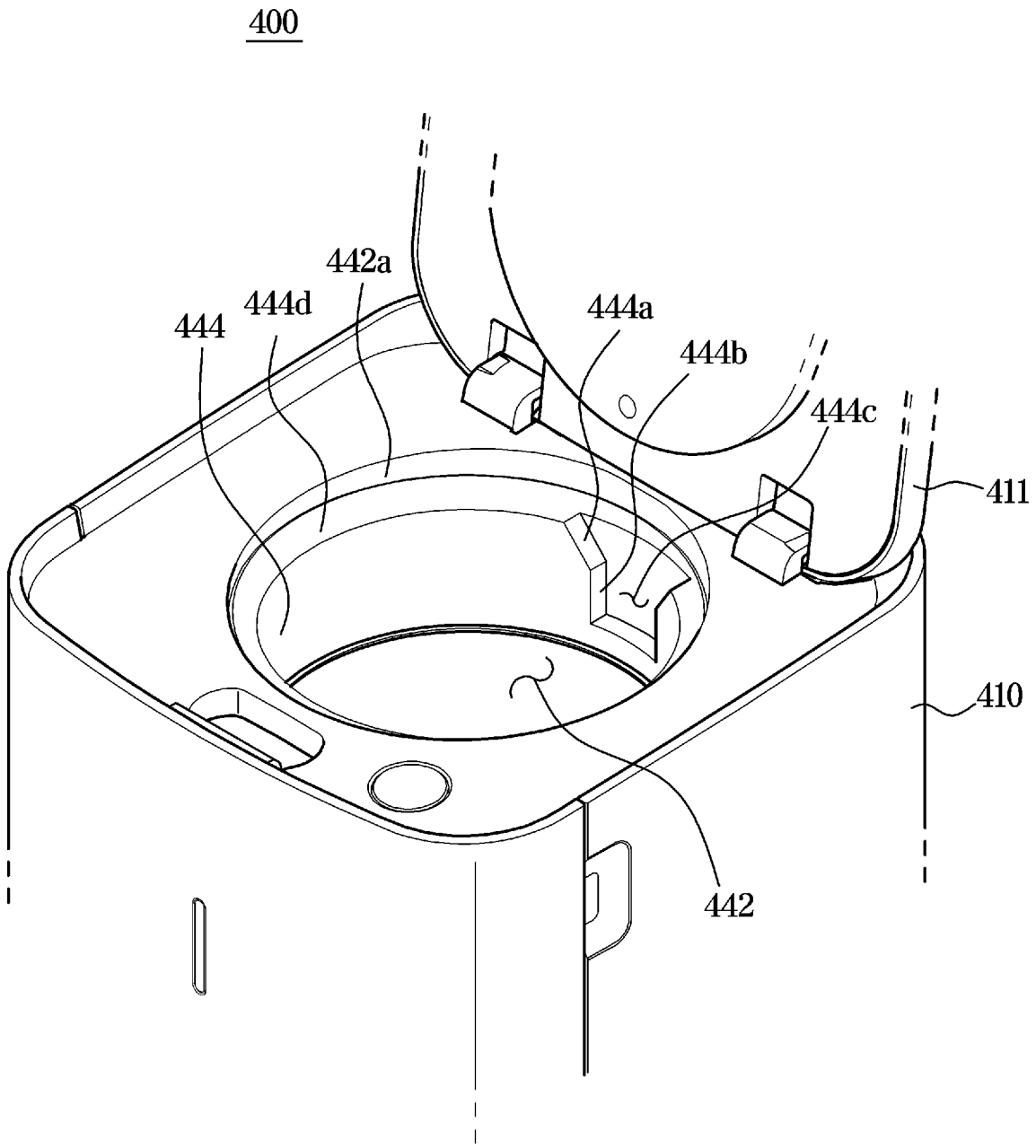
FIG. 46 is a view illustrating a seating portion according to the thirteenth embodiment of the disclosure.
Figure 47:
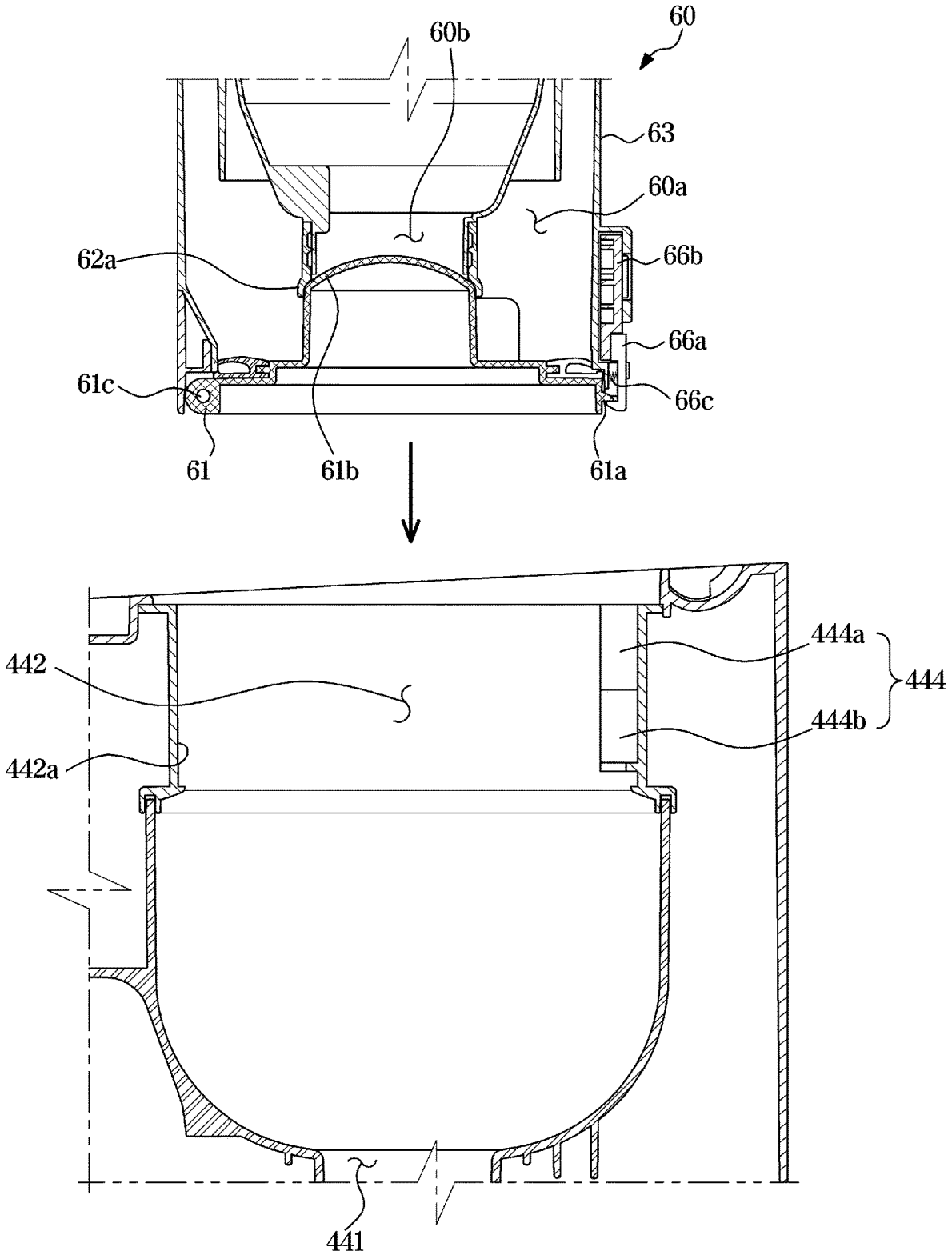
FIG. 47 is a view illustrating a state before the dust collecting chamber is docked to a docking station according to the thirteenth embodiment of the disclosure.

FIG. 44 is a view illustrating a part of a dust collecting chamber in a closed state according to the thirteenth embodiment of the disclosure, FIG. 45 is a view illustrating a part of the dust collecting chamber in an open state according to the thirteenth embodiment of the disclosure, FIG. 46 is a view illustrating a seating portion according to the thirteenth embodiment of the disclosure, and FIG. 47 is a view illustrating a state before the dust collecting chamber is docked to a docking station according to the thirteenth embodiment of the disclosure.

Referring to FIGS. 44 to 47, the dust collecting chamber 60 may include a dust collecting chamber body 63 and a dust collecting chamber door 61 configured to open and close the dust collecting chamber body 63 upon the docking of the dust collecting chamber body 63 to the docking station 400.

The dust collecting chamber body 63 may include a cylindrical shape extending in a long axis X of the dust collecting chamber or in a long axis X of the dust collecting chamber body 63. However, the shape of the dust collecting chamber body 63 is not limited thereto, and thus the dust collecting chamber body 63 may be provided in a polygonal tubular shape.

The dust collecting chamber door 61 may be arranged at a lower end of the dust collecting chamber body 63 and configured to open and close the lower end of the dust collecting chamber body 63.

As illustrated above, the dust collecting chamber 60 may include a first dust collector 60*a* configured to collect foreign substances which are primarily collected and have a relatively large size, and a second dust collector 60*b* configured to collect foreign substance, which are collected by a multi-cyclone 62 and have a relatively small size.

Both the first dust collector 60*a* and the second dust collector 60*b* may be opened to the outside upon opening of the dust collecting chamber door 61. At this time, upon opening of the dust collecting chamber door 61, both the first dust collector 60*a* and the second dust collector 60*b* may be opened to the outside.

The dust collecting chamber door 61 may include an engaging protrusion 61*a* engaged with the dust collecting chamber body 63 to maintain the dust collecting chamber 60 at a closed state, and a cap portion 61*b* configured to prevent foreign substances, which are collected in the second dust collector 60*b*, from being scattered to the outside upon the closing of the dust collecting chamber 60.

The dust collecting chamber door 61 may open and close the lower end of the dust collecting chamber body 63 while being rotated about a rotary shaft 61*c* arranged at one side of the lower end of the dust collecting chamber body 63.

The dust collecting chamber 60 may include a fixing device 66 arranged at the other side of the lower end of the dust collecting chamber body 63 and configured to support the engaging protrusion 61*a* so as to prevent the dust collecting chamber door 61 from being separated from the lower end of the dust collecting chamber body 63.

The fixing device 66 may include a hook 66*a* configured to be hooked to the engaging protrusion 61*a* to prevent the engaging protrusion 61*a* from being separated from the dust collecting chamber body 63.

The fixing device 66 may include a pusher 66*b* configured to release the hook engagement between the hook 66*a* and the engaging protrusion 61*a* by being moved upon the application of an external force.

The pusher 66*b* may be configured to be pressed by a user so as to move the hook 66*a*, thereby releasing the engagement between the hook 66*a* and the engaging protrusion 61*a*.

The dust collecting chamber 50, 50', and 50" disclosed in the tenth to twelfth embodiments described above are provided to allow a user to press the pusher toward an opposite direction of a radial direction r of the dust collecting chamber body with respect to the long axis X of the dust collecting chamber body 63 so as to move the fixing member toward a radial direction r of the dust collecting chamber body, thereby separating the fixing member from the engaging protrusion.

However, the dust collecting chamber 60 according to the thirteenth embodiment of the disclosure may be provided to allow a user to press the pusher 66*b* toward a circumferential direction c of the dust collecting chamber body 63 with respect to the long axis X of the dust collecting chamber body 63, thereby opening the dust collecting chamber door 61.

As the pusher 66*b* moves in the circumferential direction c of the dust collecting chamber body 63, the pusher 66*b* may press the hook 66*a* toward the radial direction r of the dust collecting chamber body 63, and accordingly, the hook engagement between the hook 66*a* and the engaging protrusion 61*a* may be released.

The fixing device 66 may include an elastic member 66*c* configured to maintain the hook state between the hook 66*a* and the engaging protrusion 61*a* in response to a state of the hook 66*a* not being pressed by the pusher 66*b*.

The elastic member 66*c* may be configured to allow the hook 66*a* to be biased in the direction of the engaging protrusion 61*a* so as to maintain the hook engagement between the hook 66*a* and the engaging protrusion 61*a* in the closed state of the dust collecting chamber door 61.

While moving in the circumferential direction c of the dust collecting chamber body 63, the pusher 66*b* may press the hook 66*a* toward the radial direction r of the dust collecting chamber body 63 that is an opposite direction of a direction in which the hook 66*a* is biased.

That is, although not shown in the drawing, the pusher 66*b* may include an inclined surface provided in a part in contact with the hook 66*a* caused by the movement thereof, and thus the hook 66*a* may be pressed in the radial direction r of the dust collecting chamber body 63 along the inclined surface.

Upon operating a cleaner 10 by a user, the dust collecting chamber 60 may be opened because the user accidentally presses the pusher 66*b* of the fixing device 66 during the manipulation. That is, the fixing device 66 may open the dust collecting chamber door 61 by a pressure of the pusher 66*b*, and the fixing device 66 may be pressed regardless of a user intention, thereby opening the dust collecting chamber 60.

In order to ease this difficulty, the fixing device 66 of the dust collecting chamber 60 according to the thirteenth embodiment of the disclosure may include two pushers 66*b*-1 and 66*b*-2.

The two pushers 66*b*-1 and 66*b*-2 may be configured to be pressed in a direction and an opposite direction, respectively, with respect to the circumferential direction c of the dust collecting chamber body 63.

Only in response to a pressure in a direction and an opposite direction, respectively, with respect to the circumferential direction c of the dust collecting chamber body 63, the two pushers 66*b*-1 and 66*b*-2 may press the hook 66*a* so as to allow the dust collecting chamber door 61 to be opened.

For example, upon pressing the pusher 66*b* with a force greater than the elastic force of the elastic member 66*c*, the hook 66*a* may be moved in connection with the pusher 66*b* and thus the hook engagement between the hook 66*a* and the engaging protrusion 61*a* may be released.

At this time, the elastic force of the elastic member 66*c* may have a force greater than a force that is applied to the hook 66*a* by any one pusher 66*b*-1 or 66*b*-2 upon pressing the hook 66*a* by any one pusher 66*b*-1 or 66*b*-2. Therefore, it is possible to prevent a case in which the hook 66*a* is separated from the engaging protrusion 61*a* upon pressing only one pusher 66*b*-1 or 66*b*-2.

That is, in response to the hook 66*a* being pressed by the two pushers 66*b*-1 and 66*b*-2 because the two pushers 66*b*-1 and 66*b*-2 are pushed, a force greater than the elastic force of the elastic member 66*c* may be transferred to the hook 66*a*.

Accordingly, even when a user accidentally presses any one of the two pushers 66*b*-1 and 66*b*-2 during cleaning, the dust collecting chamber door 61 may be fixed to the fixing device 66 without being separated from the dust collecting chamber body 63.

The docking station 400 may be configured to allow the dust collecting chamber door 61 to be opened in response to docking of the dust collecting chamber 60 to the seating portion 442 of the docking station 400.

The docking station 400 may include an opening guide 444 configured to press the pusher 66*b* to open the dust collecting chamber door 61 in response to seating the dust collecting chamber 60 on the seating portion 442.

The opening guide 444 may be arranged on an inner circumferential surface 442*a* of the seating portion 442 forming the seating portion 442.

The opening guide 444 may be provided in a shape protruding toward the center of the seating portion 442 from the inner circumferential surface 442*a* of the seating portion 442 in the same manner as an embodiment of the disclosure. However, the disclosure is not limited thereto, and thus the opening guide 444 may be formed as a partial region of the inner circumferential surface 442*a*. Alternatively, the opening guide 444 may be formed as shapes such as a protruding surface, a protrusion or a rib that protrude toward the center from the inner circumferential surface 442*a* of the seating portion 442.

The inner circumferential surface 442*a* of the seating portion 442 may have a diameter substantially greater than a diameter of an outer circumferential surface of the dust collecting chamber body 63. This is because the opening guide 444 is formed to protrude toward the center of the seating portion 442.

However, the disclosure is not limited thereto, and the inner circumferential surface 442*a* of the seating portion 442 may have a size substantially corresponding to a diameter of the outer circumferential surface of the dust collecting chamber body 63 in response to the shape of the opening guide 444 formed in a partial region of the inner circumferential surface 442*a*.

In response to docking of the dust collecting chamber 60 to the docking station 400, the inner circumferential surface 442*a* of the seating portion 442 and the outer circumferential surface of the dust collecting chamber body 63 may face to each other at a predetermined distance.

Accordingly, as illustrated in FIGS. 46 and 47, in response to seating of the dust collecting chamber 60 on the seating portion 442, the outer circumferential surface of the dust collecting chamber body 63 may move downward along the inner circumferential surface 442*a* of the seating portion 442.

The opening guide 444 may be provided in a ring shape extending in the circumferential direction of the inner circumferential surface 442*a* of the seating portion 442 and protruding toward the center direction of the seating portion 442.

The opening guide 444 may include an open region 444*c* provided in the opening guide 444 in the circumferential direction of the inner circumferential surface 442*a* of the seating portion 442. That is, the open region 444*c* may be formed in a region where the ring-shaped opening guide 444 is cut.

The open region 444*c* is a region in which the fixing device 66 is seated in response to the docking of the dust collecting chamber 60 to the seating portion 442.

In response to the fixing device 66 and the open region 444*c* not being placed at a position corresponding to each other with respect to a direction, to which the dust collecting chamber 60 is docked, during the dust collecting chamber 60 is docked to the seating portion 442, the docking of the dust collecting chamber 60 may be restricted by a protruding portion 444*d* of the opening guide 444.

The protruding portion 444*d* of the opening guide 444 may guide the dust collecting chamber 60 to allow the fixing device 66 and the open region 444*c* to be placed in a corresponding position with respect to a direction to which the dust collecting chamber 60 is docked.

The opening guide 444 may include an inclined portion 444*a* disposed at a portion, in which the opening guide 444 is cut, and provided to be inclined with respect to the direction to which the dust collecting chamber 60 is docked.

The opening guide 444 may include a pressure holding portion 444*b* provided to extend from the inclined portion 444*a* and configured to press the pusher 66*b* to maintain the pusher 66*b*, which is pressed by the inclined portion 444*a*, in a pressed state.

The pressure holding portion 444*b* may be provided to extend downward from the lower end of the inclined portion 444*a*. The pressure holding portion 444*b* may be provided to extend from the lower end of the inclined portion 444*a* toward a direction corresponding to the docking direction of the dust collecting chamber 60.

The fixing device 66, which protrudes outward from the outer circumferential surface of the dust collecting chamber body 66, may be docked to the seating portion 442 together with the dust collecting chamber body 63 and come in contact with the inclined portion 444*a* of the opening guide 444 and then be pressed toward the circumferential direction c of the dust collecting chamber body 63 along the inclined portion 444*a*.

Particularly, as the dust collecting chamber 60 is pressed downward, the fixing device 66 may move downward on the open region 444*c* and then the pusher 66*b* may come into contact with the inclined portion 444*a*.

Due to the continuous pressure of the dust collecting chamber 60, the pusher 66*b* may be lowered along the inclined portion 444*a* and at the same time, the pusher 66*b* may be pressed by the inclined portion 444*a*.

That is, the inclined portion 444*a* may press the pusher 66*b* toward the circumferential direction c of the dust collecting chamber body 63, and accordingly, the hook engagement between the hook 66*a* and the engaging protrusion 61*a* may be released. Therefore, the dust collecting chamber door 61 may be opened in the seating portion 442.

In response to the docking of the dust collecting chamber 60 to the seating portion 442, the pusher 66*b* may be maintained at a state of being pressed by the pressure holding portion 444*b* in the circumferential direction c of the dust collecting chamber body 63.

Accordingly, in response to the docking of the dust collecting chamber 60 to the seating portion 442, the dust collecting chamber 60 may be opened as the dust collecting chamber door 61 is docked to the seating portion 442 by the opening guide 444.

Hereinafter technical features in which a dust collecting chamber 50 according to a fourteenth embodiment of the disclosure is docked to the docking station 400 will be described in detail. A configuration other than a lighting device 90 of the docking station 400 according to the fourteenth embodiment described below is the same as that of the docking station 400 and the dust collecting chamber 50 according to the tenth embodiment of the disclosure, and thus a description thereof will be omitted.

In addition, the lighting device 90 described below may be easily applied to the docking stations 100, 300, and 400 disclosed in the first, eighth, and tenth embodiments described above.

Figure 48:
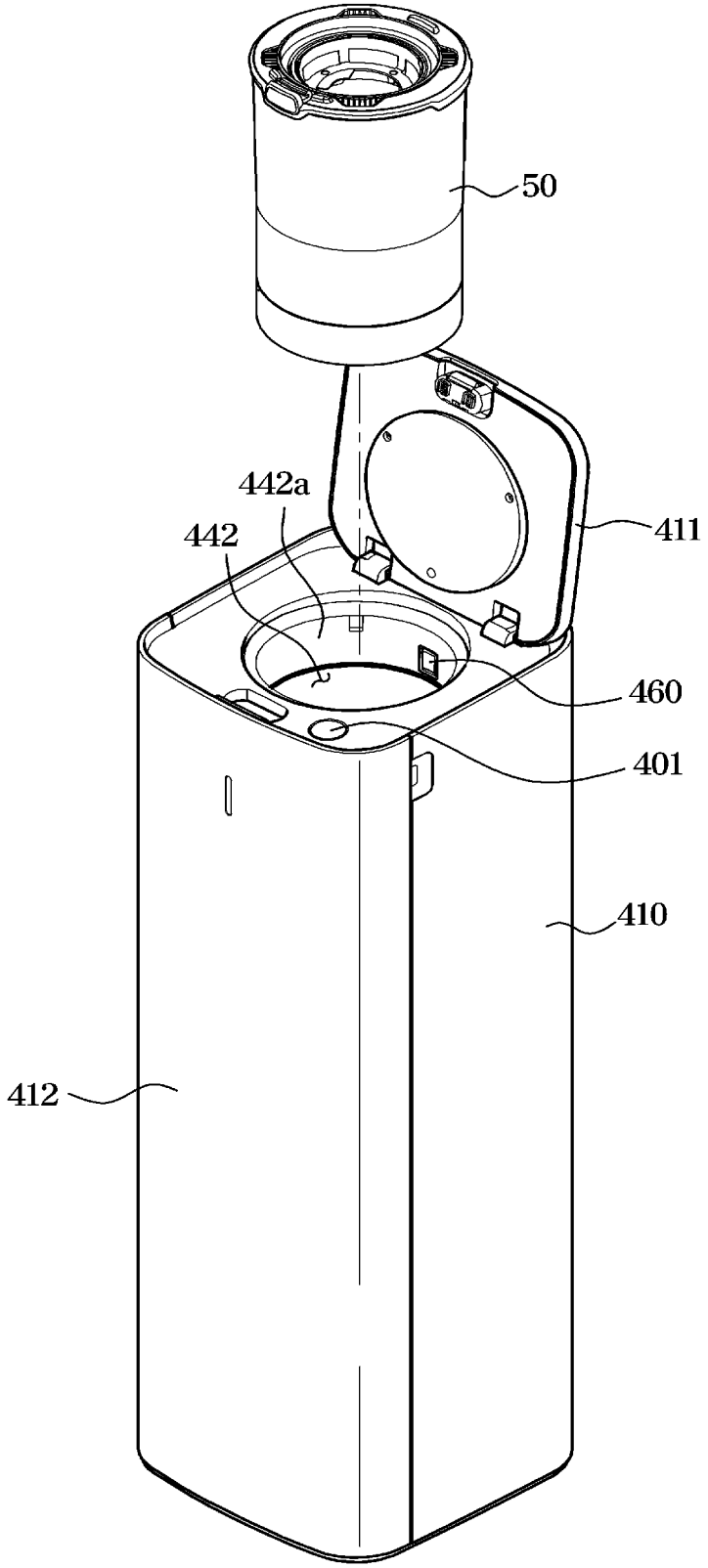
FIG. 48 is a view illustrating a state in which a dust collecting chamber is being docked to a docking station according to a fourteenth embodiment of the disclosure.
Figure 49:
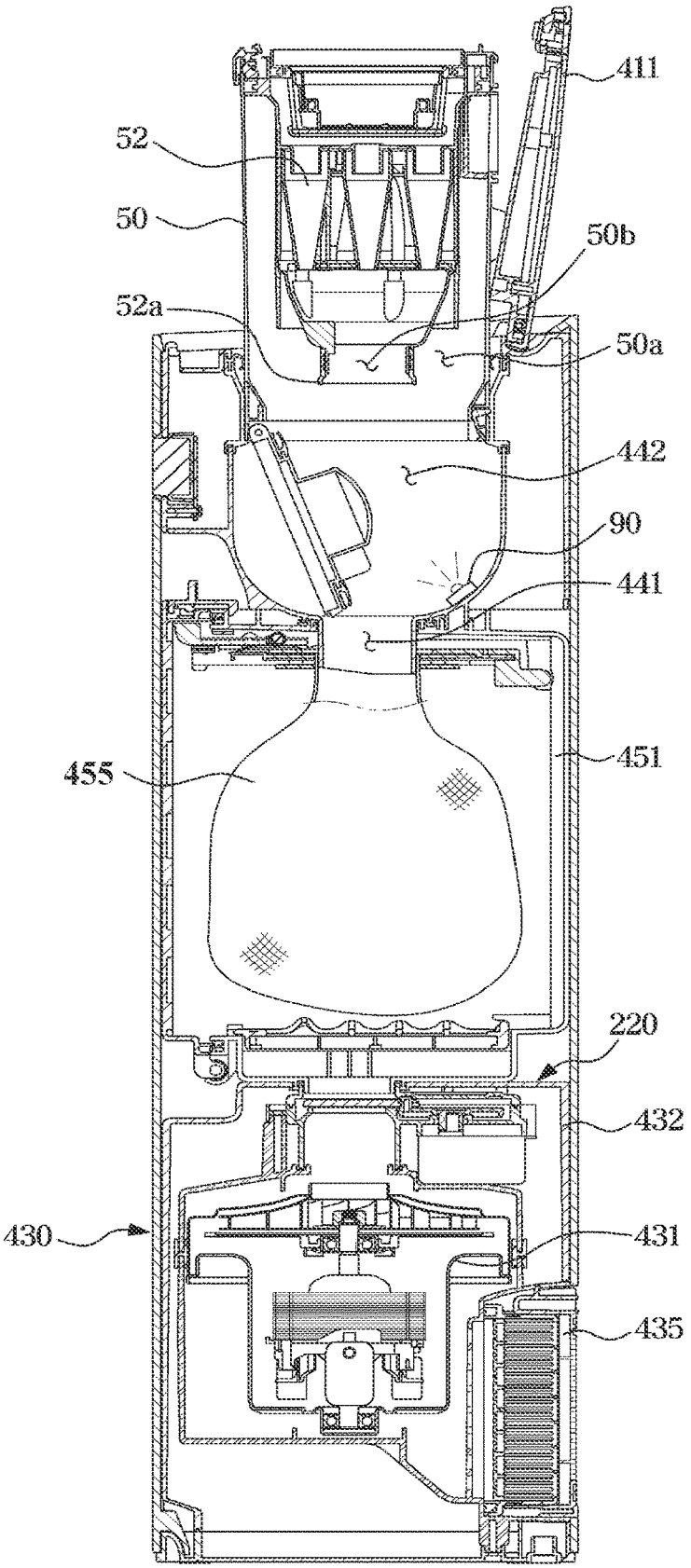
FIG. 49 is a side cross-sectional view of the docking station according to the fourteenth embodiment of the disclosure.

FIG. 48 is a view illustrating a state in which a dust collecting chamber is being docked to a docking station according to an embodiment of the disclosure, and FIG. 49 is a side cross-sectional view of the docking station according to an embodiment of the disclosure.

Referring to FIGS. 48 and 49, the docking station 400 may include the lighting device 90 configured to emit light to the dust collecting chamber 50 in the seating portion 442 in response to the docking of the dust collecting chamber 50 to the seating portion 442.

The lighting device 90 may be configured to emit light toward the dust collecting chamber 50 to allow a user to recognize a process of removing dust from the inside of the dust collecting chamber 50.

That is, the recognition about foreign substances remaining inside the dust collecting chamber 50 may be increased by the lighting device 90.

In some cases, in response to the foreign substances inside the dust collecting chamber 50 not being completely removed, a user can easily determine this state with the naked eye and input a restart signal to the docking station 400.

The lighting device 90 may be disposed inside the seating portion 442. Particularly, the lighting device 90 may be installed at a lower portion of the seating portion 442 and configured to emit light toward the dust collecting chamber 50.

The lighting device 90 may include a light emitting device such as a light emitting diode (LED). However, the disclosure is not limited thereto, and the lighting device 90 may include components configured to emit light toward the dust collecting chamber 50.

The docking station 400 may include a switch unit 460 configured to detect the docking of the dust collecting chamber 50 to the docking housing 440 and transmit a signal for driving the suction device 430, the flow rate regulator 220, and the lighting device 90.

The docking station 400 may include a controller (not shown) and may drive the suction device 430 and the flow rate regulator 220 by receiving an electrical signal of the switch unit 460.

The switch unit 460 may be disposed on the inner circumferential surface 442*a* of the seating portion 442. In response to the docking of the dust collecting chamber 50 to the seating portion 442, the switch unit 460 may be pressed against the outer circumferential surface of the dust collecting chamber body 53 and then turned on.

In response to turning on of the switch unit 460, a signal may be transmitted to the controller (not shown), and the controller (not shown) may control each configuration to allow the suction device 430, the flow rate regulator 220, and the lighting device 90 to be driven.

The suction device 430, the flow rate regulator 220, and the lighting device 90 may be driven for a predetermined period of time after the switch unit 460 is turned on, and then the driving of the suction device 430, the flow rate regulator 220, and the lighting device 90 may be terminated.

The docking station 400 may include an inputter 401 configured to transmit a signal to the controller (not shown) so as to re-drive the suction device 430 and the flow rate regulator 220 in which driving thereof is terminated.

Upon pressing the inputter 401 by a user, a signal may be transmitted to the controller (not shown) so as to allow the suction device 430 and the flow rate regulator 220, in which driving thereof is terminated, to be driven again. In addition, the lighting device 90 may be configured to be driven again by the inputter 401.

As mentioned above, the suction device 430, the flow rate regulator 220, and the lighting device 90 may be driven for a predetermined period of time after the switch unit 460 is turned on, and then the driving thereof may be terminated. However, the foreign substances in the dust collecting chamber 50 may not be completely removed during a driving time.

A user can drive the suction device 430 and the flow rate regulator 220 by pressing the inputter 401 as needed because the user can easily observe the inside of the dust collecting chamber 50 by the lighting device 90.

The inputter 401 may be provided in a configuration such as a button or a switch, but is not limited thereto. Therefore, the inputter 401 may be formed as a touch display configured to recognize a user's touch.

Hereinafter a flow rate regulator 220 according to a fifteenth embodiment of the disclosure will be described. A configuration other than a return switch 227 of the flow rate regulator 220 according to the fifteenth embodiment described below is the same as that of the flow rate regulator 220 according to the tenth embodiment of the disclosure, and thus a description thereof will be omitted.

In addition, the return switch 227 described below may be included in not only the flow rate regulator 220 according to the above-described tenth embodiment, but also the return switch 227 may be included in the flow rate regulator 150, 170, 180, and 210 disclosed in each of the above-described embodiments.

As described in the tenth embodiment, the flow rate regulator 220 may include the plate 228 configured to selectively open and close the connecting flow path 222. The plate 228 may be configured to open or close the connecting flow path 222 by being translated in one direction.

In addition, as described above, the flow rate regulator 220 may be driven for a predetermined time after the dust collecting chamber 50 is docked to the docking station 400, and then the driving thereof may be terminated.

In this case, the rotation of the drive motor 224 may be terminated in response to the termination of the driving, and the plate 228 may be disposed according to a position at which a shaft 226, which is interlocked with the drive motor 224, is disposed.

That is, in response to the termination of the driving of the flow rate regulator 220, the plate 280 may be arranged at a position of fully opening the connecting flow path 222, at a position of fully closing the connecting flow path 222 or at a position of closing at least one portion of the connecting flow path 222.

The connecting flow path 222 may allow the suction device 430 to communicate with the collector 450, and in response to the termination of the driving of the flow rate regulator 220 in a state in which at least one portion of the connecting flow path 222 is open, foreign substances scattered in the collector 450 may flow into the suction device 430 through the connecting flow path 222.

The suction device 430 may include electrical components such as a suction fan 431 configured to suction air, and the suction device 430 may be damaged by foreign substances continuously flowing into the connecting flow path 222 or contaminated intake airflow may be formed by the introduced foreign substances introduced through the suction fan 431.

Figure 50:
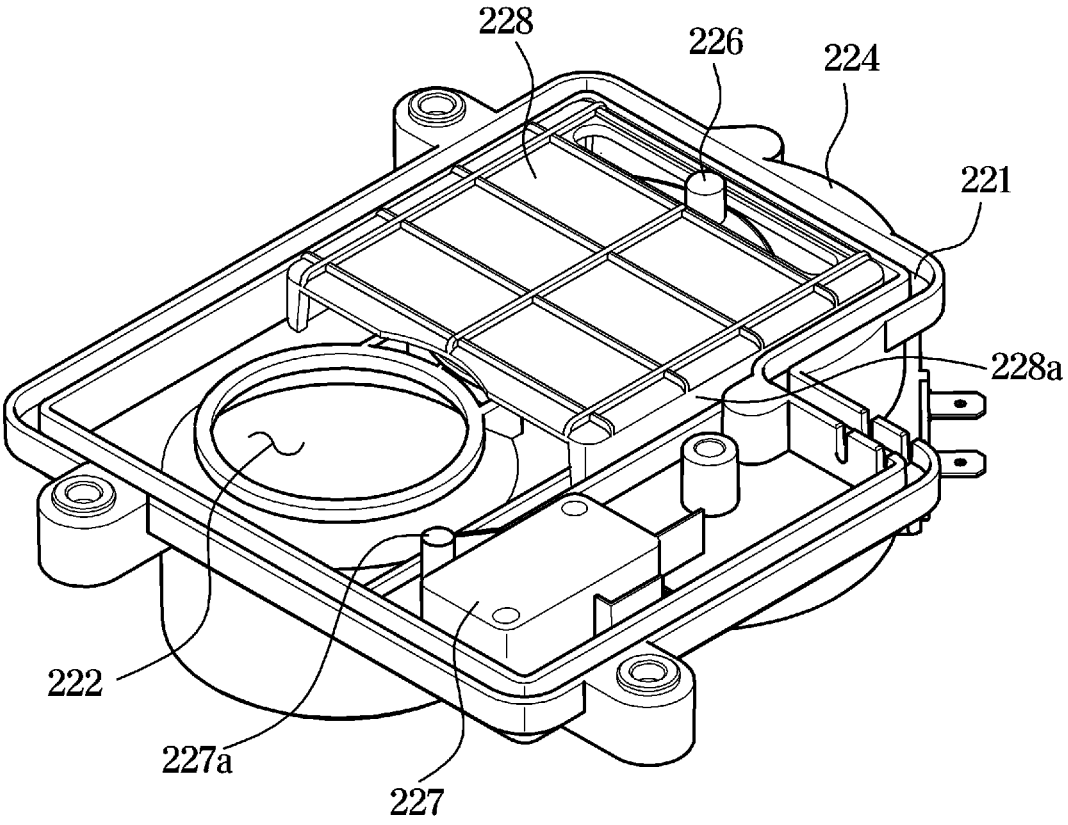
FIG. 50 is a view illustrating a state in which a flow rate regulator opens a connecting flow path according to a fifteenth embodiment of the disclosure.
Figure 51:
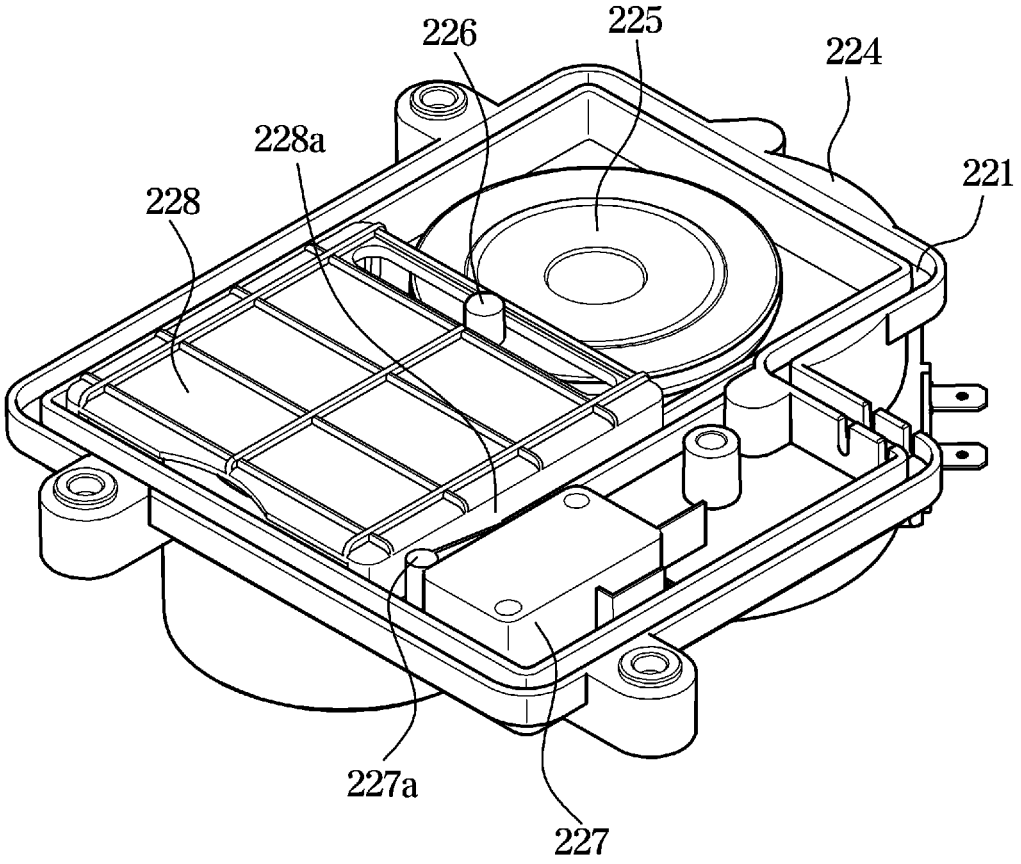
FIG. 51 is a view illustrating a state in which the flow rate regulator closes the connecting flow path according to the fifteenth embodiment of the disclosure.

FIG. 50 is a view illustrating a state in which a flow rate regulator opens a connecting flow path according to an embodiment of the disclosure, and FIG. 51 is a view illustrating a state in which the flow rate regulator closes the connecting flow path according to an embodiment of the disclosure.

In order to prevent this, referring to FIGS. 50 and 51, the flow rate regulator 220 may detect a position of the plate 228 after the driving of the flow rate regulator 220 is terminated according to a driving end signal transmitted from the controller (not shown). Accordingly, the flow rate regulator 220 may perform the additional driving so that the driving of the flow rate regulator 220 is terminated after the plate 228 is moved to the position of fully closing the connecting flow path 222.

That is, although the driving end signal is transmitted to the flow rate regulator 220 from the controller (not shown), the plate 228 may not be placed in the position of closing the connecting flow path 222 at the time of the termination of the driving of the flow rate regulator 220.

At this time, the flow rate regulator 220 may detect the position of the plate 228, and additionally drive the drive motor 224 to move the plate 228 to the position of closing the connecting flow path 222, thereby arranging the plate 228 to the position of closing the connecting flow path 222.

The flow rate regulator 220 may be configured to terminate the entire driving thereof in response to detecting the position of the plate 228 corresponding to the position of closing the connecting flow path 222.

The flow rate regulator 220 may include the return switch 227 configured to detect a position of the plate 228.

The return switch 227 may include a detector 227*a* provided in contact with a side surface 228*a* of the plate 228 and configured to detect a position of the plate 228 based on whether to be in contact with the side surface 228*a* of the plate 228.

The return switch 227 may be disposed adjacent to the connecting flow path 222. Particularly, the return switch 227 may be disposed parallel to the connecting flow path 222 in a direction perpendicular to the direction in which the plate 228 is translated.

Accordingly, the position of the plate 228, in a state in which the side surface 228*a* of the plate 228 presses the detector 227*a*, may be a position where the plate 228 closes the connecting flow path 222.

In contrast, the position of the plate 228, in a state in which the side surface 228*a* of the plate 228 is moved and does not press the detector 227*a*, may be a position where the plate 228 is away from the connecting flow path 222 and the plate 228 opens the connecting flow path 222.

In response to the detector 227*a* being pressed against the side surface 228*a* of the plate 228, the return switch 227 may be turned off, and in response to the detector 227*a* not being pressed against the side surface 228*a* of the plate 228, the return switch 227 may be turned on.

The position of the plate 228 may be detected depending on whether the detector 227*a* is pressed. That is, in response to the turn-on of the return switch 227, the controller (not shown) may detect a position of the plate 228 as the position in which the plate 228 opens the connecting flow path 222, and in response to the turn-off of the return switch 227, the controller (not shown) may detect a position of the plate 228 as the position in which the plate 228 closes the connecting flow path 222.

Accordingly, the controller (not shown) may terminate the entire driving of the flow rate regulator 220 in response to the turn-off of the return switch 227 at the point of time in which the driving of the flow rate regulator 220 and the suction device 430 is terminated after a predetermined time elapses from when the dust collecting chamber 50 is docked to the docking station 400.

In contrast, in response to the turn-on of the return switch 227 at the point of time in which the driving of the flow rate regulator 220 and the suction device 430 is terminated after the predetermined time elapses from when the dust collecting chamber 50 is docked to the docking station 400, the controller (not shown) may additionally drive the drive motor 224 until the return switch 227 of the flow rate regulator 220 is turned off, and accordingly, the controller (not shown) may terminate the entire driving thereof in response to the turn off of the return switch 227 by the plate 228 being additionally moved.

Hereinafter a flow rate regulator 230 according to a sixteenth embodiment of the disclosure will be described. A configuration other than a bypass 240 of the flow rate regulator 230 according to the sixteenth embodiment described below is the same as that of the flow rate regulator 220 according to the tenth and the fifth embodiment of the disclosure, and thus a description thereof will be omitted.

In addition, the bypass 240 described below may be included in not only the flow rate regulator 220 according to the above-described tenth and fifth embodiment, but also the bypass 240 may be included in the flow rate regulator 150, 170, 180, and 210 disclosed in each of the above-described embodiments.

Figure 52:
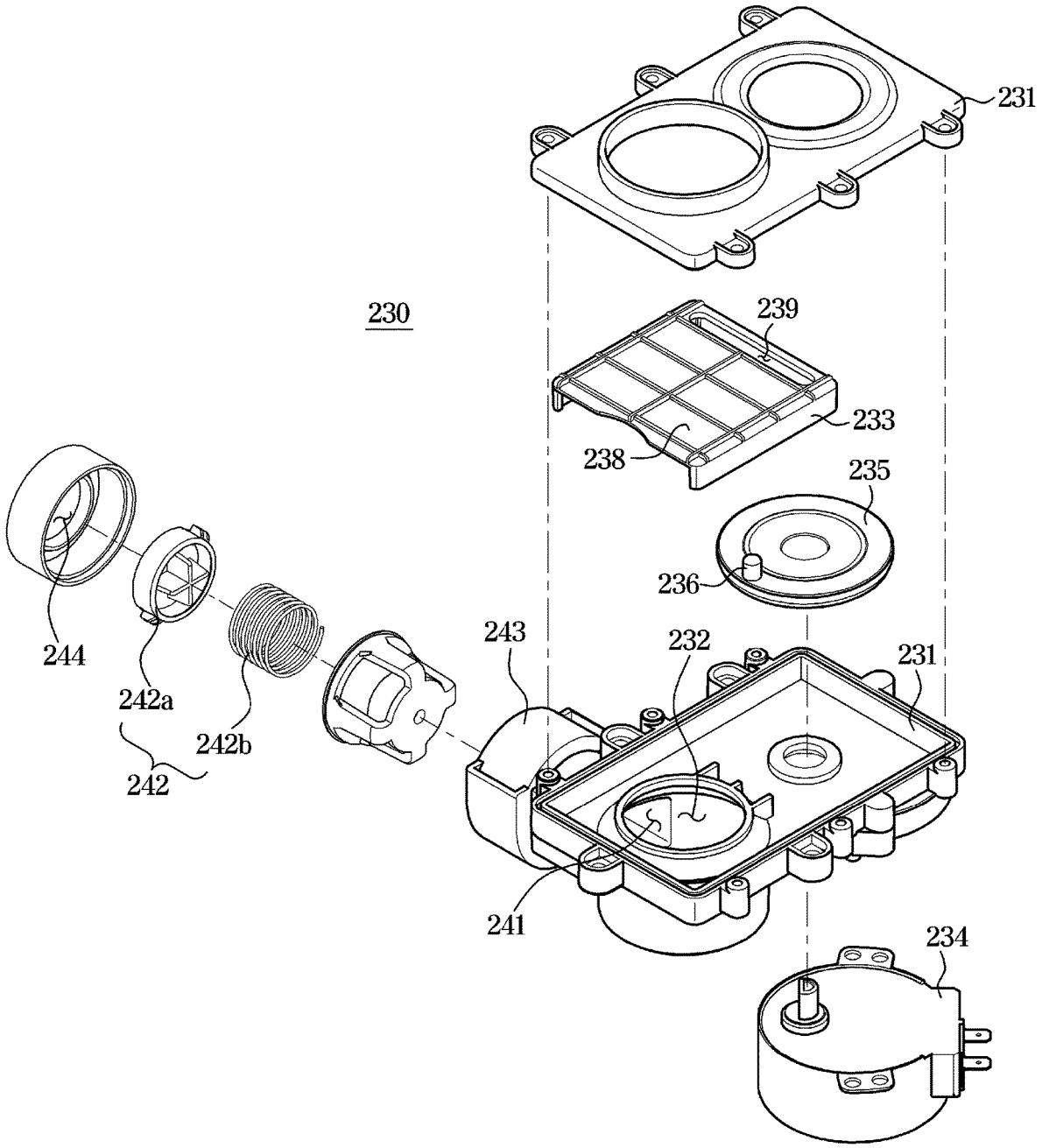
FIG. 52 is an exploded perspective view of a flow rate regulator according to a sixteenth embodiment of the disclosure.
Figure 53:
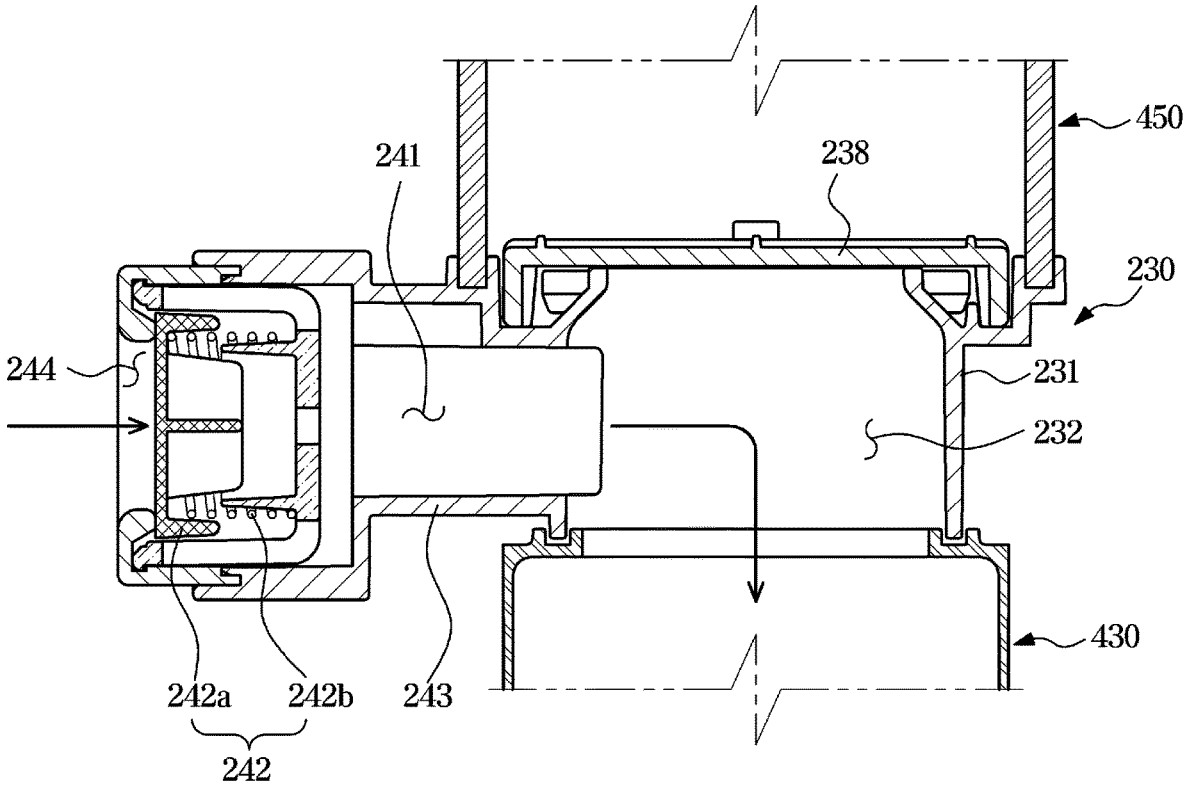
FIG. 53 is a side cross-sectional view illustrating a state in which a damper is closed in the flow rate regulator according to the sixteenth embodiment of the disclosure.
Figure 54:
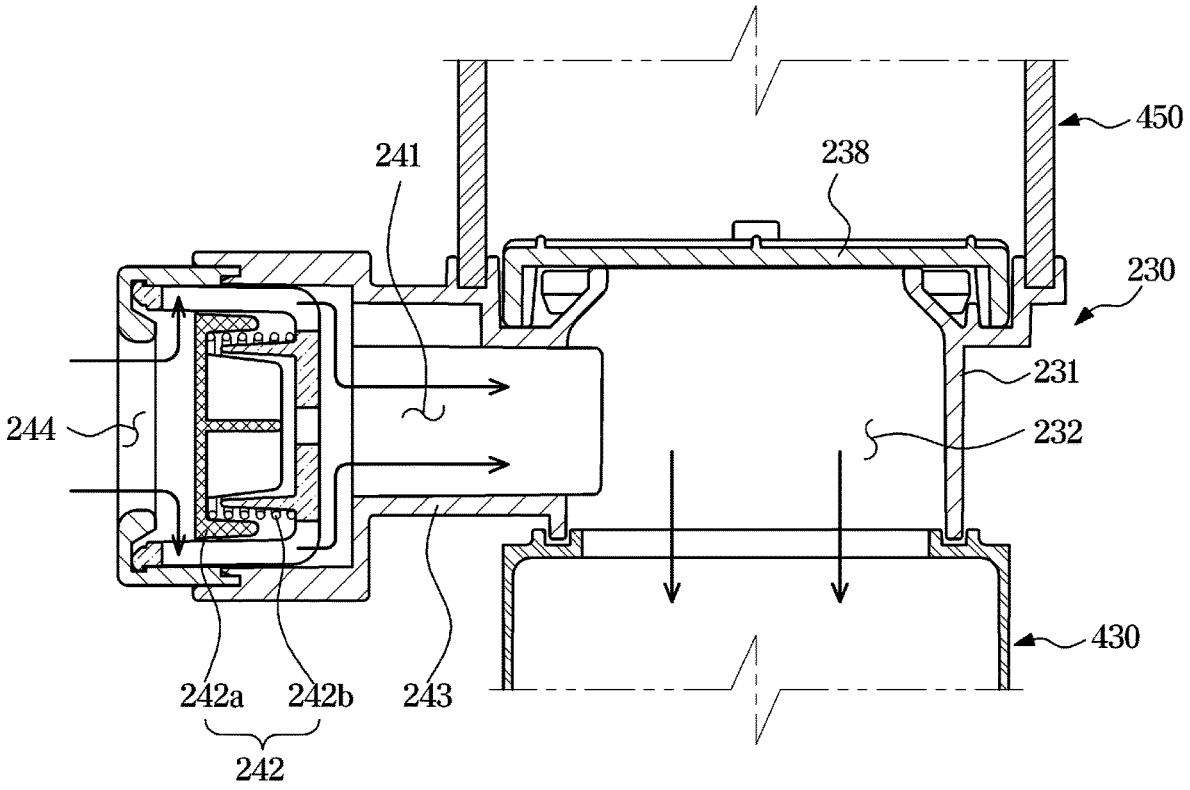
FIG. 54 is a side cross-sectional view illustrating a state in which the damper is closed in the flow rate regulator according to the sixteenth embodiment of the disclosure.

FIG. 52 is an exploded perspective view of a flow rate regulator according to a sixteenth embodiment of the disclosure, FIG. 53 is a side cross-sectional view illustrating a state in which a damper is closed in the flow rate regulator according to the sixteenth embodiment of the disclosure, and FIG. 54 is a side cross-sectional view illustrating a state in which the damper is closed in the flow rate regulator according to the sixteenth embodiment of the disclosure.

Referring to FIGS. 52 to 54, the flow rate regulator 230 may include a flow path housing 231 forming a connecting flow path 232 configured to connect a collector 450 to a suction device 430.

Particularly, the connecting flow path 232 may be configured to connect the collector 450 to the suction device 430 and to allow air to flow. Accordingly, the collector 450 and the suction device 430 may communicate with each other through the connecting flow path 232, and the intake air flow generated by the suction device 430 may move to the collector 450 through the connecting flow path 232.

The connecting flow path 151 disclosed in the first to sixth embodiments may be connected to the dust collecting guide 30 and configured to allow the outside air to flow to the dust collecting guide 30, but the connecting flow path 212 according to the eighth embodiment, the connecting flow path 222 according to the tenth embodiment, and the connecting flow path 232 according to the sixteenth embodiment may be configured to connect the suction device 430 to the collector 450.

The flow rate regulator 230 may include a flow path valve 233 arranged on the connecting flow path 232 and configured to open and close the connecting flow path 232 to regulate the intake air flow in the connecting flow path 232.

The flow rate regulator 230 may include a drive motor 234 configured to allow the flow path valve 233 to open and close the connecting flow path 232 by using the rotation thereof.

A rotating member 235 may be arranged on a rotation axis of the drive motor 234. The rotating member 235 may be provided in a disk shape and may be rotated about the rotation axis of the drive motor 234.

A shaft 236 may be arranged on one side of the rotating member 235. The shaft 236 may be arranged on the outside of the rotation axis of the rotating member 235. Accordingly, the shaft 236 may revolve around the rotation axis of the drive motor 234 upon driving of the drive motor 234.

The flow path valve 233 may include a slit 239 into which the shaft 236 is inserted. The slit 229 may allow the flow path valve 233 to reciprocate in conjunction with the revolution of the shaft 236 inserted into the slit 239.

The flow path valve 233 may include a plate 228 configured to perform translational motion in conjunction with the slit 239, and configured to selectively open and close the connecting flow path 232 through translational motion.

An operation, in which the flow path valve 233 selectively opens and closes the connecting flow path 232 while moving, is the same as the operation of the flow rate regulator 220 according to the tenth embodiment, and a description thereof will be omitted.

In response to closing of the connecting flow path 232 by the plate 238 of the flow path valve 233, a vacuum pressure on the suction device 430 and the connecting flow path 232 may increase. Accordingly, because the suction device 430, in particular, the suction fan 431 is overloaded, the reliability of the docking station 400 may be deteriorated.

In addition, as the vacuum pressure between the suction device 430 and the connecting flow path 232 increases, noise may be generated more than necessary.

Accordingly, the flow rate regulator 230 according to the sixteenth embodiment may maintain a smooth flow of the intake air flow even when the plate 238 closes the connecting flow path 232, thereby preventing noise and overload on the suction fan 431.

Particularly, the flow rate regulator 230 may include the bypass 240 configured to allow intake air flow to be smoothly formed even in a closed state of the connecting flow path 232 by the plate 238.

The bypass 240 may include a bypass flow path 241 in communication with one side of the connecting flow path 232 and a damper 242 connected to the other end of the bypass flow path 241 and configured to be opened to the outside in response to the vacuum pressure equal to or higher than a certain value in the bypass flow path 241.

The bypass 240 may include a bypass pipe 243 forming the bypass flow path 241.

One end of the bypass pipe 243 may be connected to the connecting flow path 232 and the other end of the bypass pipe 243 may include a communication hole 244 communicating with the outside of the bypass pipe 243.

The bypass pipe 243 may have a hollow shape, and the bypass flow path 241 may be formed inside the bypass pipe 243.

The bypass pipe 243 may be provided to extend from one side of the flow path housing 231 to the outside of the flow path housing 231.

The damper 242 may include a mass body 242*a* disposed inside the bypass pipe 243 and movable inside the bypass pipe 243, and an elastic member 242*b* configured to transmit an elastic force to the mass body 242*a*.

The damper 242 may be configured to stably maintain the vacuum pressure inside the connecting flow path 232 while opening and closing the communication hole 244. The damper 242 may be configured to lower the vacuum pressure by opening the communication hole 244 in response to the increase in the vacuum pressure in the connecting flow path 232 and the suction device 430 connected thereto caused by the closing of the connecting flow path 232.

That is, the damper 242 may close the communication hole 244 in the open state of the connecting flow path 232, and the damper 242 may open the communication hole 244 in response to the increase in the vacuum pressure in the connecting flow path 232 and the suction device 430 in the closed state of the connecting flow path 232.

Particularly, the mass body 242*a* of the damper 242 may be disposed inside the bypass pipe 243, and the elastic member 242*b* configured to press the mass body 242*a* may transmit the elastic force to the mass body 242*a* to allow the mass body 242*a* to be biased toward the communication hole 244.

A diameter of the mass body 242*a* may greater than a diameter of the communication hole 244 and thus even when the mass body 242*a* is biased toward the communication hole 244, the mass body 242*a* may be prevented from being separated toward the outside of the flow rate regulator 230 through the communication hole 244.

The mass body 242*a* may be biased toward the communication hole 244 and thus the communication hole 244 may be maintained in a closed state. That is, in response to the external force that is not transmitted to the mass body 242*a* or in response to a force, which is less than the elastic force transmitted by the elastic member 242*b*, being transmitted to the mass body 242*a*, the damper 242 may maintain the closed state of the communication hole 244.

In response to closing of the connecting flow path 232 by the plate 238, the intake air flow formed toward the collector 450 may be blocked, and accordingly, the intake air flow may flow in the connecting flow path 232 and the suction device 430. Therefore, the vacuum pressure in the connecting flow path 232 and the suction device 430 may increase.

In this case, the intake air flow may be transmitted to the damper 242 through the bypass flow path 341. The intake air flow may transmit the suction force to the mass body 242*a*, and in response to the suction power of the intake air flow being greater than the elastic force of the elastic member 242*b*, the mass body 242*a* may be moved in an opposite direction of the biased direction by the intake air flow.

As the mass body 242*a* is moved by the intake air flow, the communication hole 244 may be opened, and the intake air flow may flow from the outside of the flow rate regulator 230 through the communication hole 244. Therefore, the vacuum pressure in the connecting flow path 232 and the suction device 430 may be maintained at a predetermined level.

That is, in response to the increase in the vacuum pressure in the connecting flow path 232 and the suction device 430, the mass body 242*a* may be moved by the internal vacuum pressure, and accordingly, the communication hole 244, which is closed by the mass body 242*a*, may be opened.

The connecting flow path 232 may communicate with the outside through the bypass flow path 241, and the vacuum pressure in the connecting flow path 232 and the suction device 430 connected to the connecting flow path 232 may be lowered, thereby reducing noise and relieving the overload.

Therefore, even when the connecting flow path 232 is closed by the flow rate regulator 230, the suction device 430 may be driven in the same manner. However, by using the bypass 240, the vacuum pressure in the connecting flow path 232 and the suction device 430 may be prevented from increasing to a predetermined value regardless of whether the connecting flow path 232 is closed or not.

As is apparent from the above description, the cleaning apparatus may automatically remove the foreign substances collected in the dust collecting chamber of the vacuum cleaner and may charge the battery of the vacuum cleaner through the docking station of the vacuum cleaner.

Particularly, in the process of removing the foreign substance collected in the dust collecting chamber, the cleaning apparatus may effectively remove the collected foreign substances by changing the flow rate while suctioning the inside of the dust bag.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A cleaning system comprising:

a vacuum cleaner comprising a dust collecting chamber including a cyclone, the vacuum cleaner capable of collecting foreign substances through centrifugal separation; and a dust collecting station capable of connecting with the dust collecting chamber of the vacuum cleaner and configured to remove the foreign substances collected in the dust collecting chamber, wherein the dust collecting station comprises:

a station body having a box shape, wherein a long axis extends in a vertical direction of the box shape, the station body including:

a front surface;

a rear surface extending along the long axis;

a pair of side surfaces disposed between the front surface and the rear surface;

a panel forming an exterior of the front surface, wherein the panel extends in the vertical direction and exposes a cover to be accessible from outside of the station body;

an upper cover rotatably provided on an upper side of the station body about a rotation shaft provided adjacent to the rear surface; and an inputter arranged on the upper side of the station body, wherein the inputter is configured to generate an input signal in response to receiving an input at the inputter, a seating portion comprising an opening configured to communicate with an inside of the dust collecting chamber, wherein the dust collecting chamber is configured to be seated on the seating portion, a suction device configured to generate a suction airflow, and a collecting portion comprising:

a dust bag arranged between the opening of the seating portion and the suction device, the dust bag being configured to collect the foreign substances from the dust collecting chamber through the opening of the seating portion by the suction airflow;

a housing forming an internal space, wherein the dust bag is configured to be detachably seated within the internal space of the housing; and the cover configured to selectively allow access to the internal space of the housing from outside the collecting portion, wherein the upper cover of the station body is rotated in the vertical direction about the rotation shaft to open the upper side of the station body, wherein the panel of the station body is configured to selectively allow the cover of the collecting portion to be exposed toward the front surface of the panel, wherein the cover is configured to open the housing in a direction facing the front surface of the station body such that the dust bag is withdrawn in the direction in which the front surface faces, and wherein the dust bag is configured to be withdrawn in the direction in which the front surface of the station body faces in a case that the panel and the cover are in an open position.

2. The cleaning system of claim 1, wherein the seating portion, the collecting portion, and the suction device are sequentially arranged on the station body in the vertical direction from the upper side of the station body.

3. The cleaning system of claim 1, wherein the inputter is a touch display.

4. The cleaning system of claim 1, wherein the opening of the seating portion is disposed at the upper side of the station body, and provided to be exposed from the outside of the station body when the upper cover is opened.

5. The cleaning system of claim 4, wherein the upper cover and the inputter are arranged above the seating portion.

6. The cleaning system of claim 1, wherein the dust collecting station further comprises a flow path control device, wherein a flow path is formed between the opening of the seating portion and the suction device in a case that the suction airflow is generated, and wherein the flow path control device is configured to selectively block a portion of the flow path.

7. The cleaning system of claim 6, wherein the flow path control device includes a flow path cover configured to modify the flow path.

8. The cleaning system of claim 7, wherein the flow path cover configured to be moved within the flow path to block the portion of the flow path thereby opening and closing the flow path.

9. A dust collecting station capable of being connected to a dust collecting chamber of a vacuum cleaner to remove foreign substances collected in the dust collecting chamber, the dust collecting station comprising:

a station body having a box shape, wherein a long axis extends in a vertical direction of the box shape, the station body including:

a front surface, a rear surface extending along the long axis, a pair of side surfaces disposed between the front surface and the rear surface, a panel forming an exterior of the front surface, wherein the panel extends in the vertical direction and exposes a cover to be accessible from outside of the station body, an upper cover rotatably provided on an upper side of the station body about a rotation shaft provided adjacent to the rear surface, and an inputter arranged on the upper side of the station body, wherein the inputter is configured to generate an input signal in response to receiving an input at the inputter;

a seating portion comprising an opening configured to communicate with an inside of the dust collecting chamber, wherein the dust collecting chamber is configured to be seated on the seating portion;

a suction device configured to generate a suction airflow; and a collecting portion comprising:

a dust bag arranged between the opening of the seating portion and the suction device, the dust bag being configured to collect the foreign substances from the dust collecting chamber through the opening of the seating portion by the suction airflow, a housing forming an internal space, wherein the dust bag is configured to be detachably seated within the internal space of the housing, and the cover configured to selectively allow access to the internal space of the housing from outside the collecting portion, wherein the upper cover of the station body is rotated in the vertical direction about the rotation shaft to open the upper side of the station body, wherein the panel of the station body is configured to selectively allow the cover of the collecting portion to be exposed toward the front surface of the panel, wherein the cover is configured to open the housing in a direction facing the front surface such that the dust bag is withdrawn in the direction in which the front surface faces, and wherein the dust bag is configured to be withdrawn in the direction in which the front surface of the station body faces in a case that the panel and the cover of the collecting portion are in an open position.

10. The dust collecting station of claim 9, wherein the seating portion, the collecting portion, and the suction device are sequentially arranged on the station body in the vertical direction from the upper side of the station body.

11. The dust collecting station of claim 9, wherein the inputter is a touch display.

12. The dust collecting station of claim 9, wherein the dust collecting station further comprises a flow path control device, wherein a flow path is formed between the opening of the seating portion and the suction device in a case that the suction airflow is generated, and wherein the flow path control device is configured to selectively block a portion of the flow path.

13. The dust collecting station of claim 9, wherein the dust collecting station further comprises a flow path control device, wherein a flow path is formed between the opening of the seating portion and the suction device in a case that the suction airflow is generated, and wherein the flow path control device is configured to selectively block a portion of the flow path.

14. The dust collecting station of claim 9, wherein the opening of the seating portion is disposed at the upper side of the station body, and provided to be exposed from the outside of the station body when the upper cover is opened.

15. The dust collecting station of claim 14, wherein the upper cover and the inputter are arranged above the seating portion.

* * * * *